US009871311B2

(12) United States Patent
Fukui et al.

(10) Patent No.: US 9,871,311 B2
(45) Date of Patent: Jan. 16, 2018

(54) CONTACT CONNECTION STRUCTURE FOR REMOVING OXIDE BUILDUP

(71) Applicant: YAZAKI CORPORATION, Tokyo (JP)

(72) Inventors: Masayuki Fukui, Shizuoka (JP); Yoshitaka Ito, Shizuoka (JP); Takaya Kondou, Shizuoka (JP); Takahiro Matsuo, Shizuoka (JP); Kenzo Tanaka, Shizuoka (JP); Takahiro Yudate, Shizuoka (JP); Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/290,007

(22) Filed: Oct. 11, 2016

(65) Prior Publication Data

US 2017/0033485 A1 Feb. 2, 2017

Related U.S. Application Data

(63) Continuation of application No. PCT/JP2015/062546, filed on Apr. 24, 2015.

(30) Foreign Application Priority Data

Apr. 24, 2014 (JP) ..... 2014-090063
Apr. 24, 2014 (JP) ..... 2014-090125
(Continued)

(51) Int. Cl.
*H01R 13/24* (2006.01)
*H01R 13/03* (2006.01)
(Continued)

(52) U.S. Cl.
CPC ..... *H01R 13/03* (2013.01); *H01R 13/04* (2013.01); *H01R 13/11* (2013.01); *H01R 13/14* (2013.01);
(Continued)

(58) Field of Classification Search
CPC . H01R 13/2414; H01R 43/007; H01R 13/052
(Continued)

(56) References Cited

U.S. PATENT DOCUMENTS 2,480,280 A * 8/1949 Bergan ..... H01R 4/203 219/118
6,183,885 B1 2/2001 Nakamura et al.
(Continued)

FOREIGN PATENT DOCUMENTS

JP S52-097336 A 8/1977
JP H05-092971 U 12/1993
(Continued)

OTHER PUBLICATIONS

Official action dated Jul. 4, 2017 in the counterpart Japanese patent application.
(Continued)

*Primary Examiner* — Abdullah Riyami
*Assistant Examiner* — Justin Kratt
(74) *Attorney, Agent, or Firm* — Metrolexis Law Group, PLLC

(57) ABSTRACT

A contact connection structure includes: a first contact portion including an indent portion spherically protruding, the first contact portion including a plating layer formed on a surface of the first contact portion; and a second contact portion including a plating layer formed on a surface of the second contact portion. The indent portion of the first contact portion is slidable on a contact surface of the second contact portion. The indent portion of the first contact
(Continued)

portion at a terminal insertion completed position is in contact with the second contact portion. The contact surface of the second contact portion includes an oxide-film shaving portion having an annular arc portion curved along a circumference portion of the indent portion.

6 Claims, 67 Drawing Sheets

(30) Foreign Application Priority Data

| | | |
|---|---|---|
| Apr. 25, 2014 | (JP) | 2014-091642 |
| Apr. 25, 2014 | (JP) | 2014-091729 |
| May 16, 2014 | (JP) | 2014-102103 |
| Jul. 16, 2014 | (JP) | 2014-145565 |
| Apr. 13, 2015 | (JP) | 2015-081484 |
| Apr. 15, 2015 | (JP) | 2015-083260 |

(51) Int. Cl.

| | |
|---|---|
| ***H01R 13/04*** | (2006.01) |
| ***H01R 13/11*** | (2006.01) |
| ***H01R 13/14*** | (2006.01) |
| *H01R 13/05* | (2006.01) |
| *H01R 43/00* | (2006.01) |

(52) U.S. Cl.
CPC ..... *H01R 13/052* (2013.01); *H01R 13/2414* (2013.01); *H01R 43/007* (2013.01)

(58) Field of Classification Search
USPC ..... 439/86, 843, 851
See application file for complete search history.

(56) References Cited

U.S. PATENT DOCUMENTS

| | | | | |
|---|---|---|---|---|
| 6,770,383 | B2 * | 8/2004 | Tanaka | B32B 15/01 427/123 |
| 7,029,760 | B2 * | 4/2006 | Mori | B32B 15/017 205/226 |
| 8,342,895 | B2 | 1/2013 | Yoshida et al. | |
| 2010/0055998 | A1 * | 3/2010 | Aihara | H01R 4/185 439/877 |
| 2010/0105257 | A1 * | 4/2010 | Kumakura | H01R 4/185 439/877 |
| 2010/0190390 | A1 * | 7/2010 | Yoshida | C25D 5/10 439/886 |
| 2014/0248809 | A1 | 9/2014 | Onodera et al. | |

FOREIGN PATENT DOCUMENTS

| | | | | |
|---|---|---|---|---|
| JP | H10-294024 | A | 11/1998 | |
| JP | H10-302864 | A | 11/1998 | |
| JP | 2007-258156 | A | 10/2007 | |
| JP | 2007-280825 | A | 10/2007 | |
| JP | 2008-282802 | A | 11/2008 | |
| JP | 2013-101915 | A | 5/2013 | |
| JP | 2013101915 | A * | 5/2013 | H01R 13/03 |
| WO | 2014/034460 | A1 | 3/2014 | |

OTHER PUBLICATIONS

Official action dated Aug. 15, 2017 in the counterpart Japanese patent application.

* cited by examiner

CONTACT CONNECTION STRUCTURE FOR REMOVING OXIDE BUILDUP

CROSS REFERENCE TO RELATED APPLICATION

This application is a Continuation of PCT Application No. PCT/JP2015/062546, filed on Apr. 24, 2015, and claims the priorities of Japanese Patent Application Nos. 2015-081484 (filing date: Apr. 13, 2015), 2014-090125 (filing date: Apr. 24, 2014), 2014-091642 (filing date: Apr. 25, 2014), 2015-083260 (filing date: Apr. 15, 2015), 2014-145565 (filing date: Jul. 16, 2014), 2014-091729 (filing date: Apr. 25, 2014), 2014-090063 (filing date: Apr. 24, 2014), and 2014-102103 (filing date: May 16, 2014), the contents of which are incorporated herein by reference.

BACKGROUND

Technical Field

The disclosure relates to a contact connection structure that establishes electric connection between a first contact portion (a first terminal) and a second contact portion (a second terminal).

Related Art

JP 2008-282802 A is hereinafter called Patent Literature 1 and JP 2007-280825 A is hereinafter called Patent Literature 2.

Patent Literature 1 describes a contact connection structure including a female terminal 1051 and a male terminal 1061.

As illustrated in FIG. 1, the female terminal 1051 has a quadrangular box portion 1052 and an elastic bend portion 1053. The elastic bend portion 1053 is integrally provided to the box portion 1052 and is arranged in the box portion 1052.

The elastic bend portion 1053 includes an indent portion 1054 protruding toward the side of a base portion 1052*a* of the box portion 1052, provided thereto.

An outer circumferential surface of the indent portion 1054 (a surface on the side of the base portion 1052*a*) is substantially spherical and an apex of the center of the outer circumferential surface is positioned at the lowest place.

Note that, as illustrated in FIG. 2A, an entire region of an outer surface of a copper-alloy-made base material 1051A of the female terminal 1051 is plated (for example, tin plating) in terms of, for example, improvement of connection reliability under a high temperature environment and improvement of corrosion resistance under a corrosive environment, and includes a plating layer 1051B provided thereon, although the illustration is omitted in FIG. 1. An oxide film 1051C is formed on the side of an outer surface of the plating layer 1051B.

As illustrated in FIG. 1, the male terminal 1061 has a plate-like tab portion 1062.

Note that, as illustrated in FIG. 2B, an entire region of an outer surface of a copper-alloy-made base material 1061A of the male terminal 1061 is plated (for example, tin plating) in terms of, for example, improvement of connection reliability under a high temperature environment and improvement of corrosion resistance under a corrosive environment, and includes a plating layer 1061B provided thereon, although the illustration is omitted in FIG. 1. An oxide film 1061C is formed on the side of an outer surface of the plating layer 1061B.

In the above configuration, when the tab portion 1062 of the male terminal 1061 positioned at the position in FIG. 1 is inserted into the box portion 1052 of the female terminal 1051, the elastic bend portion 1053 bends and deforms due to a press of the tab portion 1062 so that the insertion of the tab portion 1062 is allowed.

During an inserting process of the tab portion 1062, the indent portion 1054 of the elastic bend portion 1053 slides on a contact surface 1062*a* of the tab portion 1062. At a terminal insertion completed position, as illustrated in FIG. 3, the indent portion 1054 of the elastic bend portion 1053 and the contact surface 1062*a* of the tab portion 1062 come in contact with each other.

As described above, when the indent portion 1054 comes in contact with the contact surface 1062*a* of the tab portion 1062, bend restoring force of the elastic bend portion 1053 acts as a contact load so that the oxide film 1051C formed on the indent portion 1054 is destroyed as illustrated in FIG. 4. In addition, the plating layer 1061B formed on the tab portion 1062 is thrust so that the oxide film 1061C is destroyed.

When the oxide films 1051C and 1061C are destroyed in this manner, pieces of metal (for example, tin) of the plating layers 1051B and 1061B enter cracks 1051Ca and 1061Ca of the oxide films 1051C and 1061C, respectively. As a result, the indent portion 1054 of the female terminal 1051 and the contact surface 1062*a* of the tab portion 1062 of the male terminal 1061 come in contact with each other through the pieces of metal.

Note that the oxide films 1051C and 1061C have electric resistance considerably higher than that of tin or copper.

Therefore, there is a need to destroy the oxide films 1051C and 1061C and to make contact surfaces (ohmic points) between the plating layers 1051B and 1061B in quantity (widely) in order to reduce contact resistance.

Patent Literature 2 describes a contact connection structure including a female terminal and a male terminal. As illustrated in FIGS. 6, 7, 8A and 8B, the female terminal 2051 has a quadrangular box portion 2052 and an elastic bend portion 2053. The elastic bend portion 2053 is integrally provided to the box portion 2052 and is arranged in the box portion 2052. The elastic bend portion 2053 includes an indent portion 2054 protruding toward the side of a base, provided thereto. An outer circumferential surface of the indent portion 2054 is substantially spherical and an apex of the center of the outer circumferential surface is positioned at the lowest place.

As illustrated in FIGS. 6, 7, 9A, and 9B, the male terminal 2060 has a plate-like tab portion 2061.

In the above configuration, when the tab portion 2061 of the male terminal 2060 positioned in FIG. 6 is inserted into the box portion 2052 of the female terminal 2051, the elastic bend portion 2053 bends and deforms so that the insertion of the tab portion 2061 is allowed. During an inserting process of the tab portion 2061, the indent portion 2054 of the elastic bend portion 2053 slides on a contact surface of the tab portion 2061. At a terminal insertion completed position, as illustrated in FIGS. 7 and 10, the indent portion 2054 of the elastic bend portion 2053 and the contact surface of the tab portion 2061 come in contact with each other. At the terminal insertion completed position, bend restoring force of the elastic bend portion 2053 acts as a contact load, and the indent portion 2054 of the female terminal 2051 and the contact surface of the tab portion 2061 of the male terminal 2060 electrically come in contact with each other.

Patent Literature 2 has proposed another contact connection structure including a female terminal 3100 and a male terminal 3200 as illustrated in FIGS. 12 to 15.

As illustrated in FIGS. 12 and 13, the female terminal 3100 has a quadrangular box portion 3101 and an elastic bend portion 3102. The elastic bend portion 3102 is provided to the box portion 3101 and is arranged in the box portion 3101.

The elastic bend portion 3102 includes an indent portion 3103 protruding toward the side of a base, provided thereto.

An outer circumferential surface of the indent portion 3103 is substantially spherical and an apex of the center of the outer circumferential surface is positioned at the lowest place.

The female terminal 3100 is plated with tin in terms of, for example, improvement of connection reliability under a high temperature environment and improvement of corrosion resistance under a corrosive environment.

The male terminal 3200 has a plate-like tab portion 3201. The male terminal 3200 is plated with tin in terms of, for example, improvement of connection reliability under a high temperature environment and improvement of corrosion resistance under a corrosive environment.

With these types of terminals, as illustrated in FIG. 13, when the tab portion 3201 of the male terminal 3200 is inserted into the box portion 3101 of the female terminal 3100, the elastic bend portion 3102 bends and deforms so that the insertion of the tab portion 3201 is allowed.

During an inserting process of the tab portion 3201, the tab portion 3201 slides on the indent portion 3103 of the elastic bend portion 3102. At a terminal insertion completed position, as illustrated in FIGS. 13 and 14, the indent portion 3103 of the elastic bend portion 3102 and a surface of the tab portion 3201 come in contact with each other.

In the above contact connection structure, bend restoring force of the elastic bend portion 3102 acts as a contact load, and the indent portion 3103 of the female terminal 3100 and the contact surface of the tab portion 3201 of the male terminal 3200 electrically come in contact with each other. When an electric current flows through the contact surface, energization is provided between the female terminal 3100 and the male terminal 3200.

Note that, tin plating treatment is performed over entire regions of outer surfaces of the elastic bend portion 3102 and the tab portion 3201. Both of the terminals are plated with tin. Furthermore, the plated terminals are subjected to reflow treatment. Thus, as illustrated in FIG. 15, a copper/tin alloy layer 3000B and a tin plating layer 3000C are formed on the side of an outer surface of each copper-alloy-made base material layer 3000A. In addition, an oxide film 3000D is generated on an outer surface of the tin plating layer 3000C.

The oxide films 3000D have electric resistivity considerably higher than that of tin or copper. Thus, there is a need to make contact surfaces (ohmic points) between the tin plating layers 3000C in quantity by destroying the oxide films 3000D in order to reduce contact resistance.

Patent Literature 2 has proposed a contact connection structure including a female terminal 4300 and a male terminal 4500 as illustrated in FIGS. 16 to 19.

As illustrated in FIGS. 16 and 17, the female terminal 4300 has a quadrangular box portion 4301 and an elastic bend portion 4301*a*. The elastic bend portion 4301*a* is provided to the box portion 4301 and is arranged in the box portion 4301.

The elastic bend portion 4301*a* includes an indent portion 4301*b* protruding toward the side of a base, provided thereto.

An outer circumferential surface of the indent portion 4301*b* is substantially spherical and an apex of the center of the outer circumferential surface is positioned at the lowest place.

The female terminal 4300 is plated with tin in terms of, for example, improvement of connection reliability under a high temperature environment and improvement of corrosion resistance under a corrosive environment.

The male terminal 4500 has a plate-like tab portion 4501. The male terminal 4500 is plated with tin in terms of, for example, improvement of connection reliability under a high temperature environment and improvement of corrosion resistance under a corrosive environment.

With these types of terminals, as illustrated in FIG. 17, when the tab portion 4501 of the male terminal 4500 is inserted into the box portion 4301 of the female terminal 4300, the elastic bend portion 4301*a* bends and deforms so that the insertion of the tab portion 4501 is allowed.

During an inserting process of the tab portion 4501, the tab portion 4501 slides on the indent portion 4301*b* of the elastic bend portion 4301*a*. At a terminal insertion completed position, as illustrated in FIGS. 17 and 18, the indent portion 4301*b* of the elastic bend portion 4301*a* and a surface of the tab portion 4501 come in contact with each other.

In Patent Literature 2, bend restoring force of the elastic bend portion 4301*a* acts as a contact load, and the indent portion 4301*b* of the female terminal 4300 and the contact surface of the tab portion 4501 of the male terminal 4500 electrically come in contact with each other. When an electric current flows through the contact surface, energization is provided between the female terminal 4300 and the male terminal 4500.

Note that tin plating treatment is performed over entire regions of outer surfaces of the elastic bend portion 4301*a* and the tab portion 4501. Both of the terminals are plated with tin. Furthermore, the plated terminals are subjected to reflow treatment. Thus, as illustrated in FIG. 19, a copper/tin alloy layer 4000B and a tin plating layer 4000C are formed on the side of an outer surface of each copper-alloy-made base material layer 4000A. In addition, an oxide film 4000D is generated on an outer surface of the tin plating layer 4000C.

The oxide films 4000D have electric resistivity considerably higher than that of tin or copper. Thus, there is a need to make contact surfaces (ohmic points) between the tin plating layers 4000C in quantity by destroying the oxide films 4000D in order to reduce contact resistance.

In the contact connection structure in Patent Literature 2, the contact load between the indent portion 4301*b* and the contact surface of the tab portion 4501 destroys the oxide films 4000D. A contact between the pieces of plating metal of the indent portion 4301*b* and the tab portion 4501 at a portion at which the oxide films 4000D have been destroyed, is acquired.

Patent Literature 2 has proposed another contact connection structure including a female terminal 5100 and a male terminal 5200 as illustrated in FIGS. 20 to 23.

As illustrated in FIGS. 20 and 21, the female terminal 5100 has a quadrangular box portion 5101 and an elastic bend portion 5102. The elastic bend portion 5120 is provided to the box portion 5101 and is arranged in the box portion 5101.

The elastic bend portion 5102 includes an indent portion 5103 protruding toward the side of a base, provided thereto.

An outer circumferential surface of the indent portion 5103 is substantially spherical and an apex of the center of the outer circumferential surface is positioned at the lowest place.

The female terminal 5100 is plated with tin in terms of, for example, improvement of connection reliability under a high temperature environment and improvement of corrosion resistance under a corrosive environment.

The male terminal 5200 has a plate-like tab portion 5201. The male terminal 5200 is plated with tin in terms of, for example, improvement of connection reliability under a high temperature environment and improvement of corrosion resistance under a corrosive environment.

With these types of terminals, as illustrated in FIG. 21, when the tab portion 5201 of the male terminal 5200 is inserted into the box portion 5101 of the female terminal 5100, the elastic bend portion 5102 bends and deforms so that the insertion of the tab portion 5201 is allowed.

During an inserting process of the tab portion 5201, the tab portion 5201 slides on the indent portion 5103 of the elastic bend portion 5102. At a terminal insertion completed position, as illustrated in FIGS. 21 and 22, the indent portion 5103 of the elastic bend portion 5102 and a surface of the tab portion 5201 come in contact with each other.

In the structure described in Patent Literature 2, bend restoring force of the elastic bend portion 5102 acts as a contact load, and the indent portion 5103 of the female terminal 5100 and the contact surface of the tab portion 5201 of the male terminal 5200 electrically come in contact with each other. When an electric current flows through the contact surface, energization is provided between the female terminal 5100 and the male terminal 5200.

Note that tin plating treatment is performed over entire regions of outer surfaces of the elastic bend portion 5102 and the tab portion 5201. Both of the terminals are plated with tin. Furthermore, the plated terminals are subjected to reflow treatment. Thus, as illustrated in FIG. 23, a copper/tin alloy layer 5000B and a tin plating layer 5000C are formed on the side of an outer surface of each copper-alloy-made base material layer 5000A. In addition, an oxide film 5000D is generated on an outer surface of the tin plating layer 5000C.

The oxide films 5000D have electric resistivity considerably higher than that of tin or copper. Thus, there is a need to make contact surfaces (ohmic points) between the tin plating layers 5000C in quantity by destroying the oxide films 5000D in order to reduce contact resistance.

In the structure in Patent Literature 2, the contact load between the indent portion 5103 and the contact surface of the tab portion 5201 destroys the oxide films 5000D. A contact between the pieces of plating metal of the indent portion 5103 and the tab portion 5201 at a portion at which the oxide films 5000D have been destroyed, is acquired.

Patent Literature 2 describes another contact connection structure including a female terminal and a male terminal. As illustrated in FIGS. 24 to 26B, the female terminal 6051 has a quadrangular box portion 6052. An elastic bend portion 6053 integrally provided to the box portion 6052, is arranged in the box portion 6052. The elastic bend portion 6053 includes an indent portion 6054 protruding toward the side of a base, provided thereto. An outer circumferential surface of the indent portion 6054 is substantially spherical and an apex of the center of the outer circumferential surface is positioned at the lowest place. A tin plating layer (not illustrated) is formed on an outer surface of the female terminal 6051 in terms of, for example, improvement of connection reliability under a high temperature environment and improvement of corrosion resistance under a corrosive environment.

As illustrated in FIGS. 24, 25, 27A, and 27B, the male terminal 6060 has a plate-like tab portion 6061. A tin plating layer (not illustrated) is formed on an outer surface of the male terminal 6060 in terms of, for example, improvement of connection reliability under a high temperature environment and improvement of corrosion resistance under a corrosive environment.

In the above configuration, when the tab portion 6061 of the male terminal 6060 positioned in FIG. 24 is inserted into the box portion 6052 of the female terminal 6051, the elastic bend portion 6053 bends and deforms so that the insertion of the tab portion 6061 is allowed. During an inserting process of the tab portion 6061, the tab portion 6061 slides on the indent portion 6054 of the elastic bend portion 6053. At a terminal insertion completed position, as illustrated in FIGS. 25 and 28, the indent portion 6054 of the elastic bend portion 6053 and a surface of the tab portion 6061 come in contact with each other.

In the structure in Patent Literature 2, bend restoring force of the elastic bend portion 6053 acts as a contact load, and the indent portion 6054 of the female terminal 6051 and the contact surface of the tab portion 6061 of the male terminal 6060 electrically come in contact with each other. When an electric current flows through the contact surface, energization is provided between the female terminal 6051 and the male terminal 6060.

Patent Literature 2 describes another contact connection structure including a female terminal and a male terminal. As illustrated in FIGS. 30 to 32B, the female terminal 7051 has a quadrangular box portion 7052 and an elastic bend portion 7053. The elastic bend portion 7053 is integrally provided to the box portion 7052 and is arranged in the box portion 7052. The elastic bend portion 7053 includes an indent portion 7054 protruding toward the side of a base, provided thereto. An outer circumferential surface of the indent portion 7054 is substantially spherical and an apex of the center of the outer circumferential surface is positioned at the lowest place.

As illustrated in FIGS. 30, 31, 33A, and 33B, the male terminal 7060 has a plate-like tab portion 7061.

In the above configuration, when the tab portion 7061 of the male terminal 7060 positioned in FIG. 30 is inserted into the box portion 7052 of the female terminal 7051, the elastic bend portion 7053 bends and deforms so that the insertion of the tab portion 7061 is allowed. During an inserting process of the tab portion 7061, the indent portion 7054 of the elastic bend portion 7053 slides on a contact surface of the tab portion 7061. At a terminal insertion completed position, as illustrated in FIGS. 31 and 34, the indent portion 7054 of the elastic bend portion 7053 and the contact surface of the tab portion 7061 come in contact with each other. At the terminal insertion completed position, bend restoring force of the elastic bend portion 7053 acts as a contact load, and the indent portion 7054 of the female terminal 7051 and the contact surface of the tab portion 7061 of the male terminal 7060 electrically come in contact with each other.

SUMMARY

In the contact connection structure described in Patent Literature 1, the contact load of the indent portion 1054 thrusts the oxide film 1061C into the plating layer 1061B at a portion 1000*x* (a leading end portion of the indent portion 1054; a bottom portion of a recess portion formed on the tab portion 1062) in FIG. 4. However, although reaction force of the plating layers 1051B and 1061B is high, the portion 1000*x* is flat. Thus, as illustrated in FIG. 5A, the oxide films 1051C and 1061C are only thrust without being cracked.

The contact load of the indent portion 1054 extends the oxide films 1051C and 1061C and then the cracks 1051Ca and 1061Ca occur in quantity at a region 1000*y* (a midway peripheral portion of the recess portion formed on the tab portion 1062) in FIG. 4.

Since the reaction force of the plating layers 1051B and 1061B is high, the pieces of metal of the plating layers 1051B and 1061B enter the cracks 1051Ca and 1061Ca of the oxide films 1051C and 1061C, respectively. Thus, the plating layer 1051B and the plating layer 1061B come in contact with each other.

The extension of the oxide films 1051C and 1061C due to the contact load of the indent portion 1054 decreases and the occurrence of the cracks 1051Ca and 1061Ca decreases at a portion 1000*z* (an upper end peripheral portion of the recess portion formed on the tab portion 1062) in FIG. 4.

The pieces of metal of the plating layers 1051B and 1061B move due to the contact load of the indent portion 1054 so that the reaction force of the plating layers 1051B and 1061B lowers. Thus, the pieces of metal of the plating layers 1051B and 1061B do not sufficiently enter the cracks 1051Ca and 1061Ca of the oxide films 1051C and 1061C, respectively. As a result, as illustrated in FIG. 5B, the plating layer 1051B and the plating layer 1061B do not come in contact with each other.

In this manner, the contact surfaces (ohmic points) between the plating layers 1051B and 1061B cannot be made in quantity. Therefore, it can be thought that a thrusting amount of the plating layer 1061B increases upon the contact between the terminals 1051 and 1061 at the terminal insertion completed position and contact pressure between the contact portions increases in order to destroy the oxide films 1051C and 1061C.

Note that, the plating layer 1061B is thin and the thrusting amount of the plating layer 1061B is small. Thus, the respective terminals 1051 and 1061 increase in size and become complicated.

Note that, in the structure described in Patent Literature 2, the indent portion 2054 of the female terminal 2051 is substantially spherical. The tab portion 2061 of the male terminal 2060 comes in contact with only the apex portion of the outer circumferential surface of the indent portion 2054. Here, contact surfaces at both of the portions are not necessarily and substantially in contact with each other over an entire region of an apparent contact surface 2000E2 (a contact surface diameter 2000D2). Only surfaces to be practically in contact (actual contact surfaces 2000A), in the apparent contact surface 2000E2, assume electric energization. The apparent contact surface 2000E2 is displayed with hatching for clarification in FIG. 11A.

The indent portion 2054 and the contact surface of the tab portion 2061 both are formed so as to have a flat and smooth surface. Practically, the surfaces include a small quantity of unevenness formed thereon. As illustrated in FIG. 11B, the number of actual contact surfaces 2000A within a range of the apparent contact surface 2000E2 decreases in contact between the above surfaces including a small quantity of unevenness formed thereon. Thus, contact resistance increases.

Here, it can be thought that the bend restoring force (a contact load) of the elastic bend portion increases and the contact portion (the indent portion 2054) increases in size in order to reduce the contact resistance with an increase in the apparent contact surface diameter. However, the terminals 2051 and 2060 increase in size and become complicated.

Note that, in the structure in Patent Literature 2, it can be thought that contact pressure between the contact portions increases in order to accelerate destruction of the oxide films. However, both of the terminals increase in size and become complicated.

Note that, in Patent Literature 2, an entire region of the contact surface between the contacts does not necessarily assume electric energization. Thus, it can be thought that the contact surface is an apparent contact surface 6000E2 (refer to FIG. 29). A surface to be practically in contact (an actual contact surface) within the apparent contact surface 6000E2 assumes the electric energization. The actual contact surface is formed at a point (an ohmic point) at which the oxide films formed on surfaces of the tin plating layers are destroyed and then the pieces of tin come in contact with each other.

In the structure in Patent Literature 2, the contact load between the indent portion 6054 and the contact surface of the tab portion 6061 destroys the oxide films. Therefore, it can be thought that the contact load of the contact portion (bend restoring force of the elastic bend portion 6053) increases and then the destruction of the oxide films is accelerated. However, when the bend restoring force of the elastic bend portion 6053 increases, the terminals 6051 and 6060 increase in size and become complicated.

Note that, in the structure of Patent Literature 2, the indent portion 7054 of the female terminal 7051 is substantially spherical and comes in contact with only the tab portion 7061 of the male terminal 7060 at the apex portion of the outer circumferential surface of the indent portion 7054. Thus, an apparent contact surface 7000E2 (a contact surface diameter 7000D2) is small. Contact surfaces at both of the portions are not necessarily and substantially in contact with each other over an entire region of the apparent contact surface 7000E2 (the contact surface diameter 7000D2). Surfaces at which the plating layers practically come in contact with each other (actual contact surfaces 7000A) within the apparent contact surface 7000E2 assume electric energization. The apparent contact surface 7000E2 is displayed with hatching for clarification in FIG. 35A.

In Patent Literature 2, the indent portion 7054 and the contact surface of the tab portion 7061 are formed so as to have a flat and smooth surface. Thus, the contact surfaces at both of the portions include a small quantity of unevenness formed thereon. In contact between both of the surfaces including a small quantity of unevenness formed thereon, destruction of the oxide films is not accelerated. Thus, the number of contact points (actual contact surfaces 7000A) between the plating layers is small. Therefore, as illustrated in FIG. 35B, the number of actual contact surfaces 7000A within a range of the apparent contact surface 7000E2 decreases. That is, in Patent Literature 2, the apparent contact surface 7000E2 is small and also the number of actual contact surfaces 7000A within the apparent contact surface 7000E2 is small. Thus, contact resistance increases.

Here, it can be thought that the bend restoring force (the contact load) of the elastic bend portion 7053 increases and the contact portion (the indent portion 7054) increases in size in order to reduce the contact resistance with an increase in the apparent contact surface diameter. However, the terminals 7051 and 7060 increase in size and become complicated.

An object of the disclosure is to provide a contact connection structure capable of reducing contact resistance without increasing terminals in size and causing the terminal to be complicated as much as possible.

A contact connection structure in accordance with some embodiments includes: a first contact portion including an indent portion spherically protruding, the first contact portion including a plating layer formed on a surface of the first contact portion; and a second contact portion including a plating layer formed on a surface of the second contact portion. The indent portion of the first contact portion is slidable on a contact surface of the second contact portion. The indent portion of the first contact portion at a terminal insertion completed position is in contact with the second contact portion. The contact surface of the second contact portion includes an oxide-film shaving portion having an annular arc portion curved along a circumference portion of the indent portion.

According to the above configuration, when the second contact portion is inserted to the first contact portion, the oxide-film shaving portion formed on the second contact portion comes in contact with the indent portion of the first contact portion. Thus, the oxide films generated on the indent portion and the contact surface of the second contact portion are destroyed. Then, the contact between the pieces of plating metal of the first contact portion and the second contact portion can be acquired at the portions at which the oxide films have been destroyed. Therefore, contact resistance can be reduced without the terminals increased in size and complicated as much as possible. Further, the annular arc portion can accelerate the destruction of the oxide film generated on the circumference portion of the indent portion, the oxide film being apt to crack, and the contact between the pieces of plating metal can be further securely acquired.

The oxide-film shaving portion may have a protruding shape with a leading end of the oxide-film shaving portion having an acute angle.

According to the above configuration, the leading end portion can shave and destroy the oxide film of the indent portion, and the contact between the pieces of plating metal can be further securely acquired.

DETAILED DESCRIPTION

First Embodiment

A first embodiment of the present invention will be described in detail with reference to FIGS. 36 to 40B.

Figure 36:
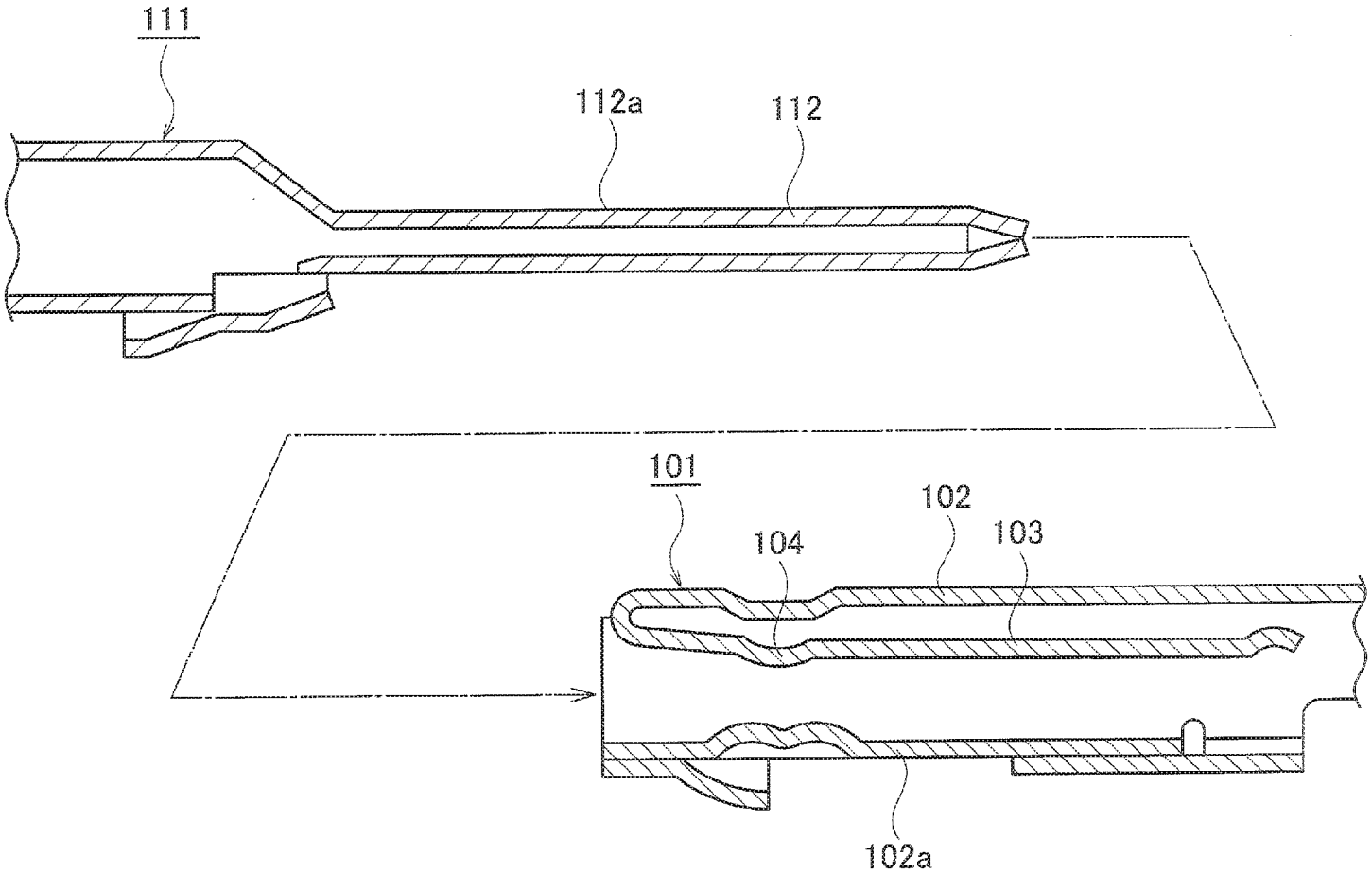
FIG. 36 is a sectional view of a female terminal and a male terminal before connection according to a first embodiment of the present invention.

In FIG. 36, a female terminal (a first terminal) 101 is arranged (housed) in a terminal housing space in a female-side connector housing (not illustrated). The female terminal 101 is formed by performing bending processing to conductive metal punched into a predetermined shape (for example, a copper alloy material, a forming material). The female terminal 101 has a box portion 102 that is a first contact portion. The box portion 102 is quadrangular and includes an opening on the front side thereof (on the left side in FIG. 36). An elastic bend portion 103 that has been bent at a front upper surface portion of the box portion 102 and extends from the front side to the rear side, is arranged in the box portion 102.

A substantially spherical indent portion 104 protruding toward the side of a base portion 102*a* of the box portion 102 is provided to the elastic bend portion 103. The indent portion 104 includes an apex of the center thereof positioned at the lowest place. The indent portion 104 is displaced upward due to elastic deformation of the elastic bend portion 103. The elastic bend portion 103 and the base portion 102*a* of the box portion 102 are arranged apart from each other, the base portion 102*a* being a fixed surface portion. A male terminal 111 illustrated in FIG. 36 is inserted between the elastic bend portion 103 and the base portion 102*a* of the box portion 102.

Figure 37A:
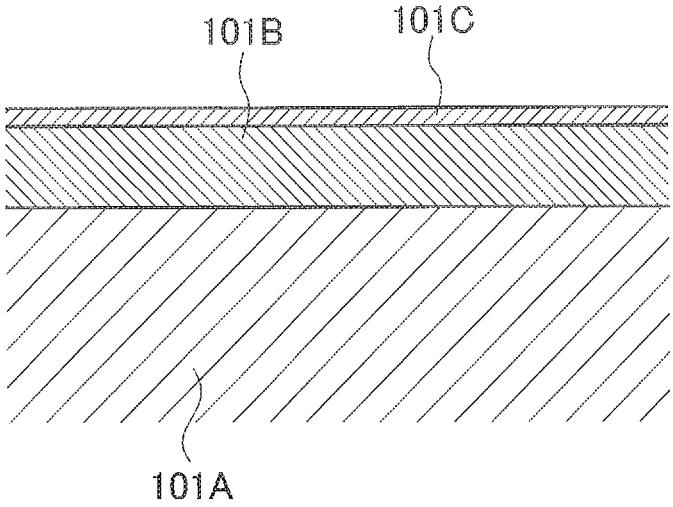
FIG. 37A is a schematic sectional view of a structure of a forming material for forming the female terminal according to the first embodiment.

As illustrated in FIG. 37A, an entire region of an outer surface of a conductive-metal-made base material 101A of the female terminal 101 is plated in terms of, for example, improvement of connection reliability under a high temperature environment and improvement of corrosion resistance under a corrosive environment, and includes a plating layer 101B provided thereon. An oxide film 101C is formed on the side of an outer surface of the plating layer 101B.

In FIG. 36, the male terminal (a second terminal) 111 is arranged (housed) in a terminal housing space in a male-side connector housing (not illustrated). The male terminal 111 is formed by performing bending processing to conductive metal punched into a predetermined shape (for example, a copper alloy material, a forming material). The male terminal 111 has a tab portion 112 that is a second contact portion. The tab portion 112 has a flat plate shape.

Figure 37B:
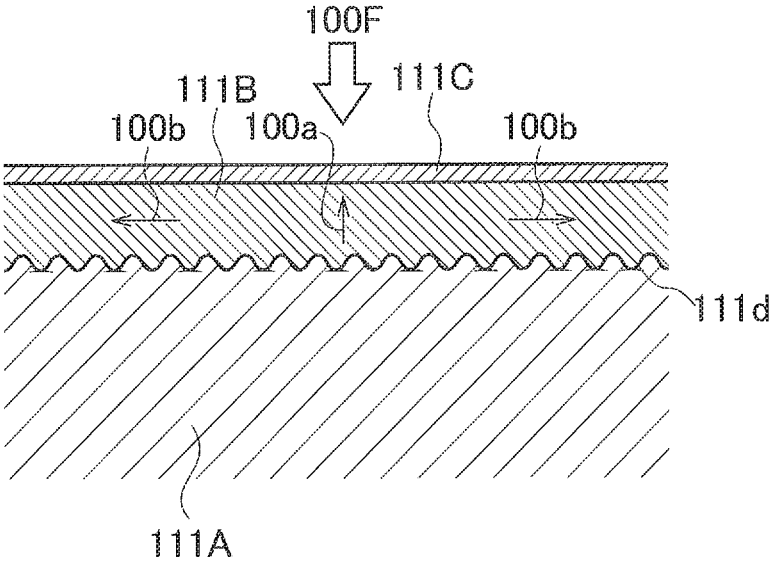
FIG. 37B is a schematic sectional view of a structure of a forming material for forming the male terminal according to the first embodiment.

As illustrated in FIG. 37B, the male terminal 111 includes a conductive-metal-made base material 111A, a plating layer 111B provided over an entire region of an outer surface of the conductive-metal-made base material 111A, and an oxide film 111C formed on the side of an outer surface of the plating layer 111B.

Unevenness 111*d* is provided on the outer surface of the base material 111A. For example, the unevenness 111*d* is formed when the base material 111A is rolled. The unevenness 111*d* is formed by making surface roughness of the base material rough. The unevenness 111*d* may be provided so as to be regularly arranged lengthwise and crosswise or may be provided at random. The unevenness 111*d* may be uniform in size or may be ununiform in size.

Next, connection between the female terminal 101 and the male terminal 111 will be described. When the tab portion 112 of the male terminal 111 positioned at a position in FIG. 36 is inserted into the box portion 102 of the female terminal 101, the elastic bend portion 103 bends and deforms due to a press of the tab portion 112 so that the insertion of the tab portion 112 is allowed.

Figure 38:
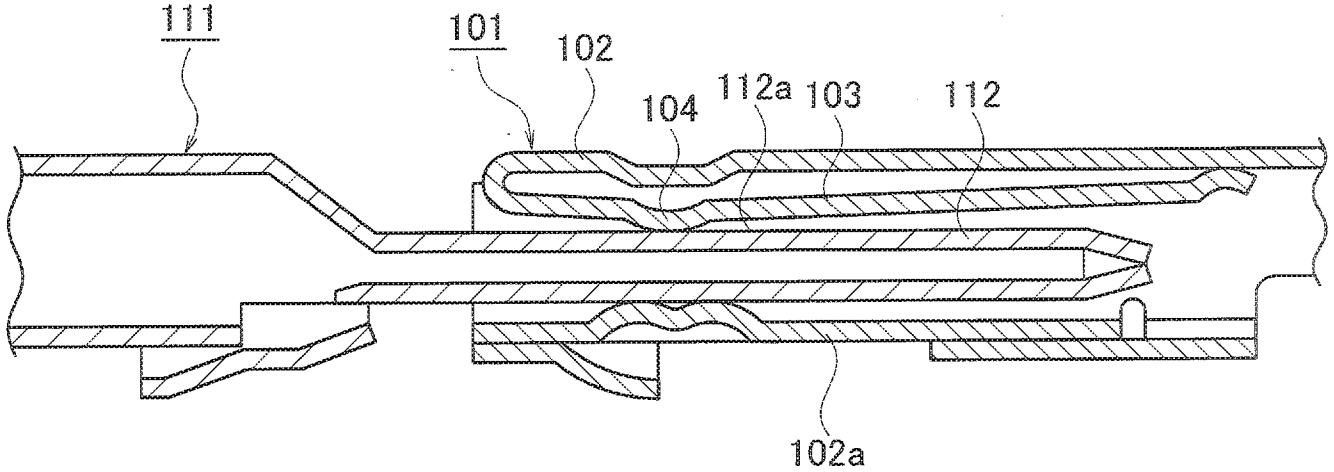
FIG. 38 is a sectional view of the female terminal and the male terminal after the connection according to the first embodiment.

During an inserting process of the tab portion 112, the indent portion 104 of the elastic bend portion 103 slides on a contact surface 112*a* of the tab portion 112. At a terminal insertion completed position, as illustrated in FIG. 38, the indent portion 104 of the elastic bend portion 103 comes in contact with the contact surface 112*a* of the tab portion 112.

Figure 39:
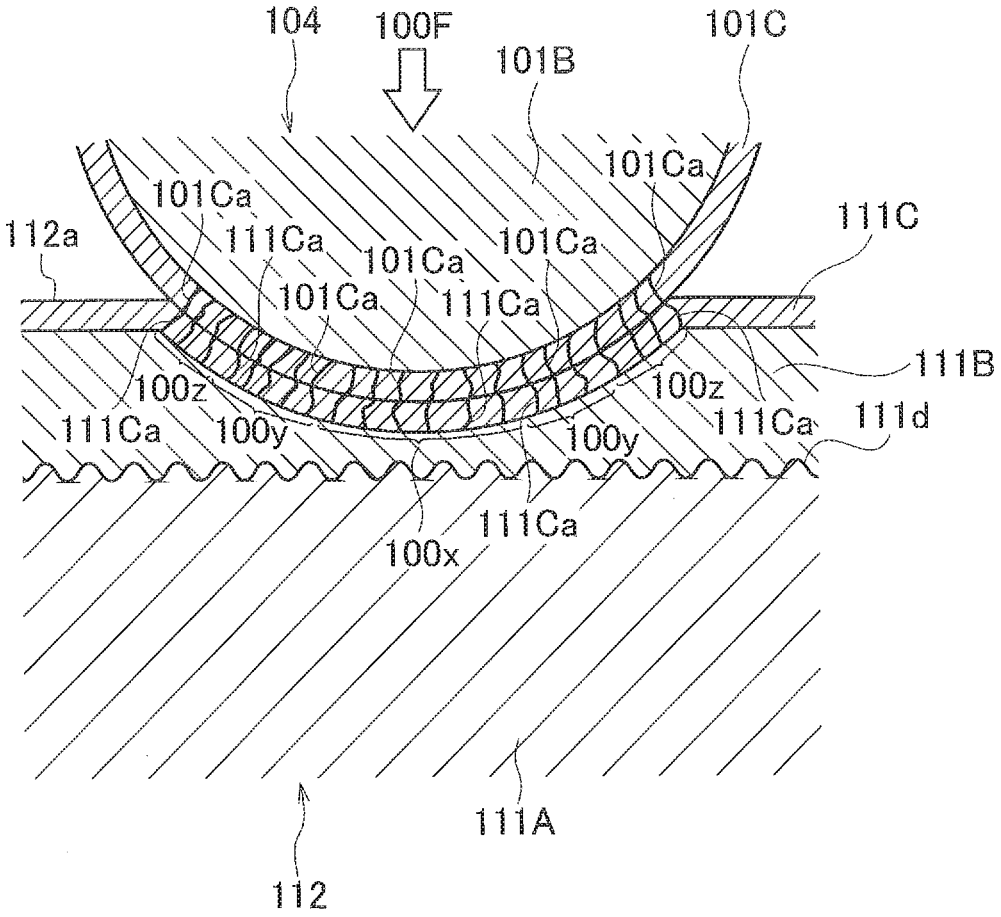
FIG. 39 is a schematic sectional view of an indent portion in contact with a tab portion according to the first embodiment.

As described above, when the indent portion 104 comes in contact with the contact surface 112*a* of the tab portion 112, bend restoring force of the elastic bend portion 103 acts as a contact load. Then, as illustrated in FIG. 39, the oxide film 101C formed on the indent portion 104 is destroyed. In addition, the plating layer 111B formed on the tab portion 112 is thrust so that the oxide film 111C is destroyed (cut).

The contact load 100F of the indent portion 104 thrusts the oxide film 111C into the plating layer 111B at a portion

Figure 40A:
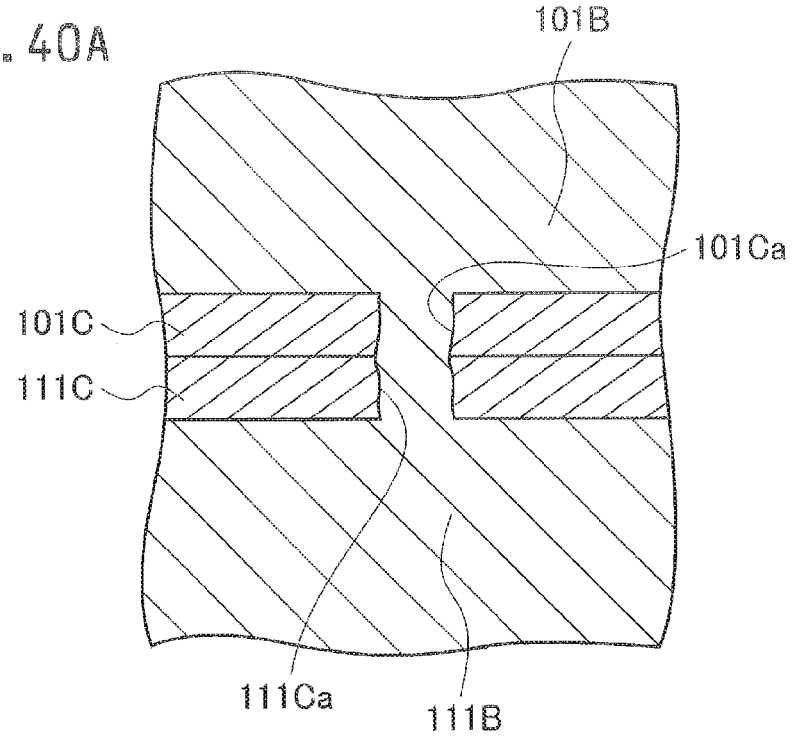
FIG. 40A is an enlarged sectional view of a portion 100*x* of FIG. 39.
Figure 40B:
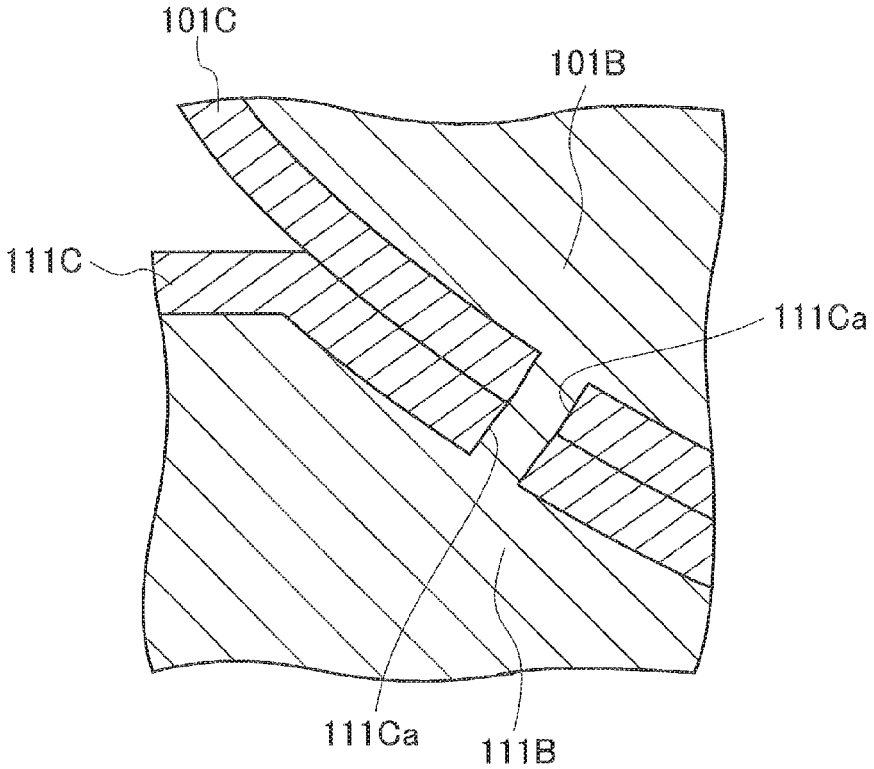
FIG. 40B is an enlarged sectional view of a portion 100*z* of FIG. 39.
Figure 41:
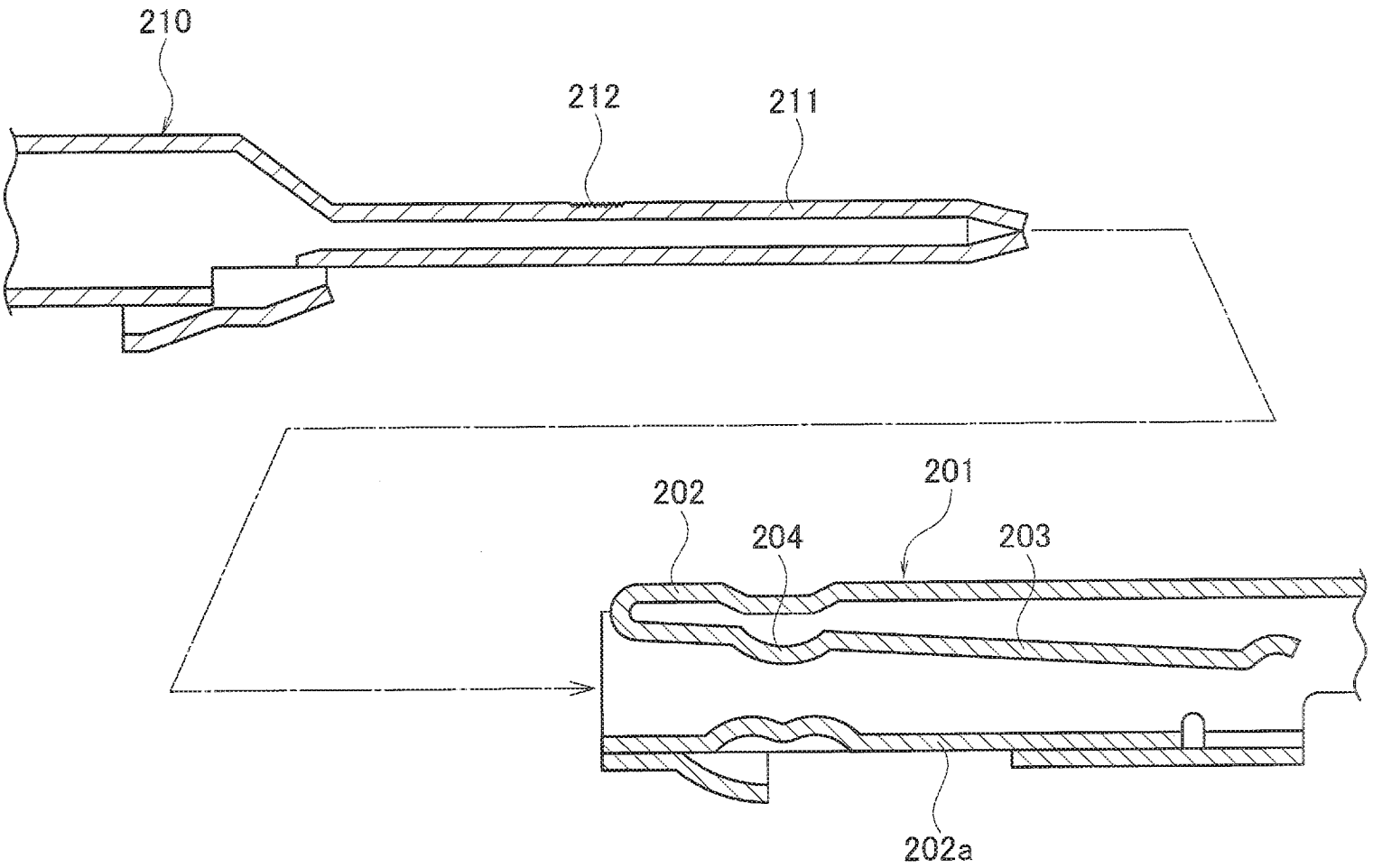
FIG. 41 is a sectional view of a female terminal and a male terminal before terminal connection according to a second embodiment of the present invention.

100*x* (a leading end portion of the indent portion 104, a bottom portion of a recess portion formed on the tab portion 112) in FIG. 39. Here, when receiving the contact load 100F, metal of the plating layer 111B is about to move outside, as illustrated with arrows 100*b* in FIG. 37B. However, the metal in a recess portion of the base material 111A cannot move outside due to protruding portions on both sides. Thus, reaction force of the metal in the recess portion in a direction of an arrow 100*a* increases. Accordingly, as illustrated in FIG. 40A, cracks 101Ca and 111Ca occur in the oxide films 101C and 111C. Then, pieces of metal are accelerated so as to enter the cracks 101Ca and 111Ca. Accordingly, the number of contact portions between the pieces of metal increases.

An extending amount of the plating layer 111B is large at a portion 100*y* (a midway peripheral portion of the recess portion formed on the tab portion 112) in FIG. 39 because the portion 100*x* is thrust toward the plating layer 111B. Therefore, occurrence of the cracks 101Ca and 111Ca of the oxide films 101C and 111C is accelerated due to the unevenness 111*d* of the base material 111A and the above reason although the portion is a portion at which the cracks easily occur in the plating layers 101B and 111B. Therefore, the number of contact portions between the pieces of metal increases in comparison to a case where the surface of the base material 111A is flat.

Only a small contact load acts on a portion 100*z* (an upper end peripheral portion of the recess portion formed on the tab portion 112) in FIG. 39. Thus, extension of the oxide film 111C is small. However, the cracks 101Ca and 111Ca of the oxide films 101C and 111C occur due to the unevenness 111*d* of the base material 111A and the above reason. Therefore, the number of contact portions between the pieces of metal increases in comparison to a case where the surface of the base material 111A is flat.

In this manner, forming (providing) the unevenness 111*d* on the base material 111A inhibits the movement of the metal of the plating layer 111B. Thus, the pieces of plating metal enter the cracks 101Ca and 111Ca of the oxide films 101C and 111C, and then the number of contact portions between the pieces of metal increases. As a result, a contact surface between the pieces of metal can expand.

Therefore, contact resistance can be reduced without the terminals increased in size and complicated as much as possible.

According to the first embodiment, the unevenness 111*d* is provided on the outer surface of the base material 111A of the female terminal 101. The plating layer 111B is formed on the unevenness 111*d*. Accordingly, when the indent portion 104 comes in contact with the contact surface 112*a* of the tab portion 112 due to the contact load 100F, the metal of the plating layer 111B is inhibited from moving.

In this manner, the movement of the metal of the plating layer 111B is inhibited. Thus, the pieces of metal of the plating layers 101B and 111B enter the cracks 101Ca and 111Ca of the oxide films 101C and 111C, respectively, and then the number of contact portions between the plating layers 101B and 111B increases. As a result, the contact surface between the plating layers 101B and 111B can expand.

Therefore, the contact resistance can be reduced without the terminals increased in size and complicated as much as possible.

According to the first embodiment, the exemplary female terminal 101 including the plating layer 111B formed on the surface of the base material 111A, the surface including the unevenness 111*d* formed thereon, has been described. Even when the male terminal include plating formed on a surface of a base material, the surface including unevenness formed thereon, the same effect can be acquired.

Therefore, even when at least one of the female terminal (the first contact portion) and the male terminal (the second contact portion) includes the plating layer formed on the surface of the base material, the surface including the unevenness formed thereon, the same effect can be acquired.

Second and third embodiments of the present invention will be described in detail below with reference to FIGS. 41 to 44C.

Second Embodiment

FIGS. 41 to 43B illustrate the second embodiment of the present invention. A contact connection structure according to the present invention is applied between a female terminal being a first terminal and a male terminal being a second terminal. The descriptions will be given below.

The female terminal 201 is arranged in a terminal housing space in a female-side connector housing (not illustrated). The female terminal 201 is formed by performing bending processing to conductive metal punched into a predetermined shape (for example, a copper alloy). A tin plating layer (not illustrated) is formed on an outer surface of the female terminal 201. The female terminal 201 has a quadrangular box portion 202 and an elastic bend portion 203. The box portion 202 includes an opening on the front side thereof. The male terminal 210 is inserted into the opening. The elastic bend portion 203 extends from an upper surface portion of the box portion 202, and is arranged in the box portion 202. The elastic bend portion 203 includes an indent portion 204 protruding toward the side of a base, provided thereto. An outer circumferential surface of the indent portion 204 is substantially spherical and an apex of the center of the outer circumferential surface is positioned at the lowest place. The female terminal 201 has a first contact portion formed of the elastic bend portion 203 and a base portion 202*a* of the box portion 202.

The male terminal 210 is arranged in a terminal housing space in a male-side connector housing (not illustrated). The male terminal 210 is formed by performing bending processing to conductive metal punched into a predetermined shape (for example, a copper alloy). A tin plating layer (not illustrated) is formed on an outer surface of the male terminal 210. The male terminal 210 has a plate-like tab portion 211. The male terminal 210 has a second contact portion formed of the tab portion 211. A surface 212 having rough surface roughness, namely, an unevenness surface is formed at a region at which the indent portion 204 is positioned at a terminal insertion completed position, on the side of an upper surface (the side of a contact surface) of the tab portion 211.

The surface 212 having rough surface roughness includes unevenness with an electric discharge texture pattern in the second embodiment. The unevenness surface with the electric discharge texture pattern is easily manufactured by pressing a die including electric discharge texture remaining thereon onto the contact surface of the tab portion 211. The surface 212 having rough surface roughness has an arithmetic mean roughness Ra in the following range: 2.5 μm<Ra<5 μm.

Figure 42A:
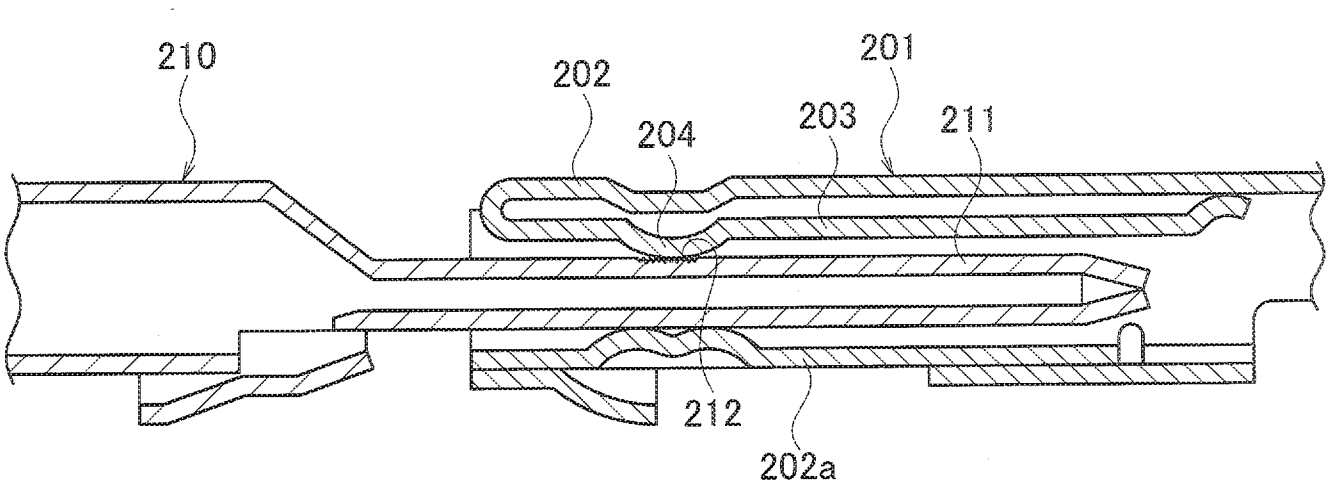
FIG. 42A is a sectional view of the female terminal and the male terminal in the terminal connection according to the second embodiment.
Figure 42B:
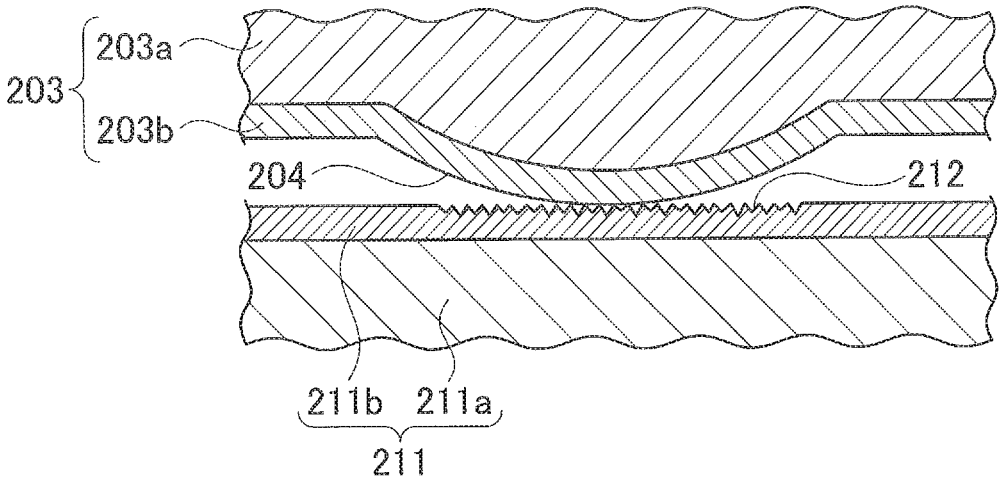
FIG. 42B is a sectional view of a main portion of a contact connection portion according to the second embodiment.
Figure 42C:
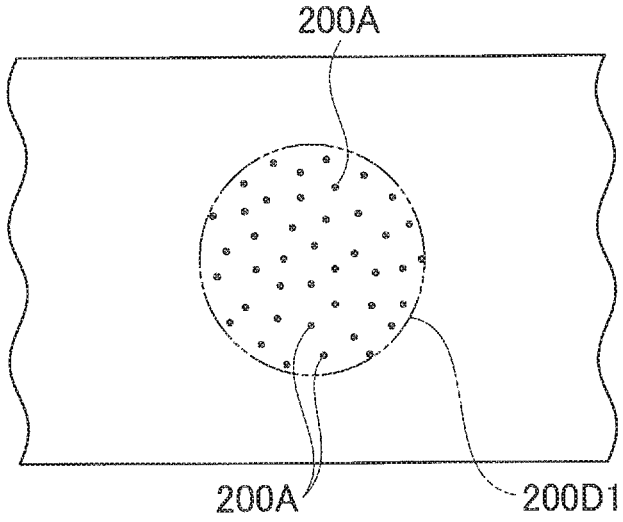
FIG. 42C is a view of an apparent contact surface and actual contact surfaces according to the second embodiment.
Figure 43A:
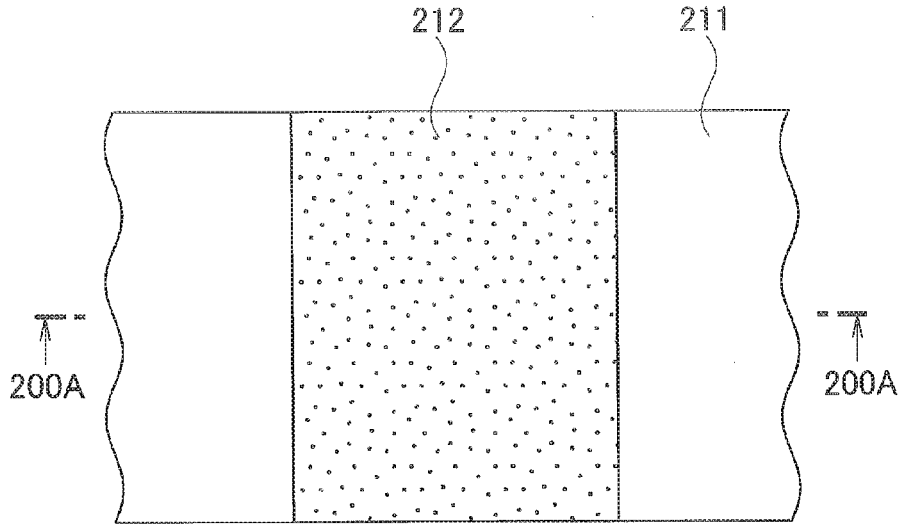
FIG. 43A is a plan view of a main portion of a contact portion of the male terminal according to the second embodiment.
Figure 43B:
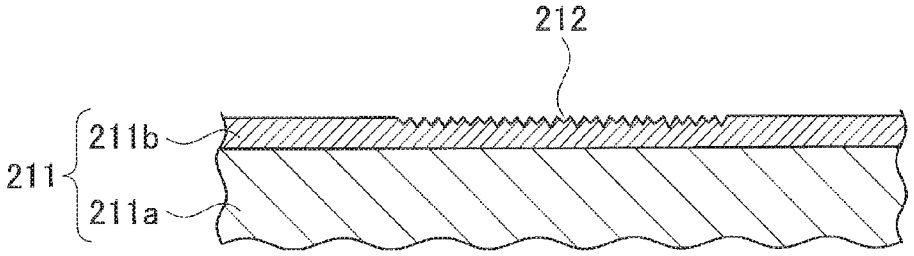
FIG. 43B is a sectional view taken from the line 200A-200A of FIG. 43A.

In the above configuration, when the female-side connector housing (not illustrated) and the male-side connector housing (not illustrated) engage with each other, the tab portion 211 of the male terminal 210 is inserted into the box portion 202 of the female terminal 201 during the engaging process. Then, a leading end of the tab portion 211 first abuts on the elastic bend portion 203. When the insertion further progresses through the abutting portion, the elastic bend portion 203 bens and deforms so that the insertion of the tab portion 211 is allowed. During the inserting process of the tab portion 211, the tab portion 211 slides on the indent portion 204 of the elastic bend portion 203. As illustrated in FIG. 42B, the indent portion 204 of the elastic bend portion 203 is positioned on the surface 212 having rough surface roughness of the tab portion 211 at the terminal insertion completed position (a connector engagement completed position). The apex portion of the indent portion 204 and the surface 212 having rough surface roughness on the tab portion 211 come in contact with each other.

In the contact connection structure, the contact surface of the tab portion 211 of the male terminal 210 is formed so as to have the surface 212 having rough surface roughness. The surface 212 having rough surface roughness includes a large number of protruding shapes formed on the surface thereof. The contact is securely made at portions of the protruding shapes in large quantities. Thus, a large number of actual contact surfaces are acquired. Therefore, even when the contact surface between the indent portion 204 and the tab portion 211 has an apparent contact surface diameter 200D1 the same as that in a previous case in comparison to the case where both of the portions have a flat and smooth surface, the number of actual contact surfaces 200A within the range increases. As described above, contact resistance can be reduced without the female terminal 201 and the male terminal 210 increased in size and complicated as much as possible.

Next, the reduction of the contact resistance will be described with a Holm's contact theoretical formula. According to the Holm's contact theoretical formula, contact resistance R is calculated by the following expression: $R=(\rho/D)+(\rho/2\ na)$, where D is an apparent contact surface diameter (a diameter), ρ is resistivity of a contact material, a is a radius of an actual contact surface, and n is the number of actual contact surfaces. According to the present embodiment, the contact resistance decreases because the number of actual contact surfaces 200A increases in comparison to the conventional case.

Third Embodiment

Figure 44A:
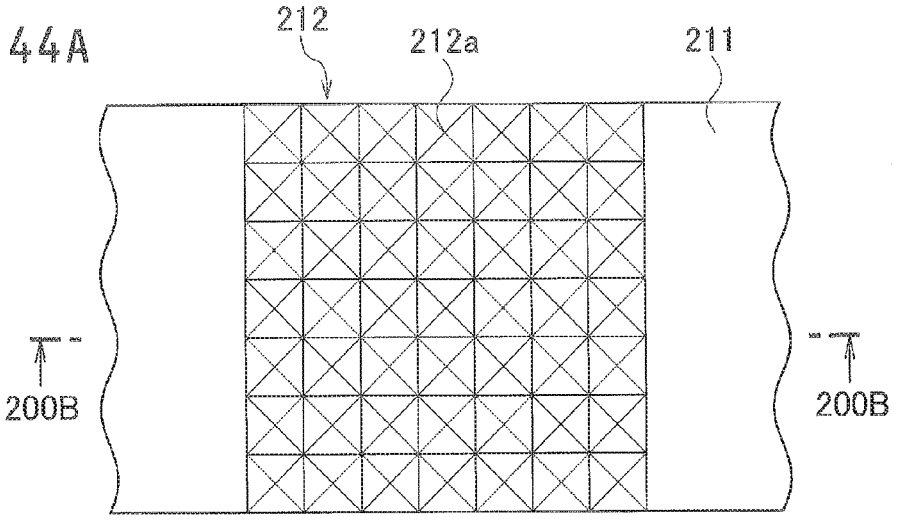
FIG. 44A is a plan view of a main portion of a contact portion of a male terminal according to a third embodiment of the present invention.
Figure 44B:
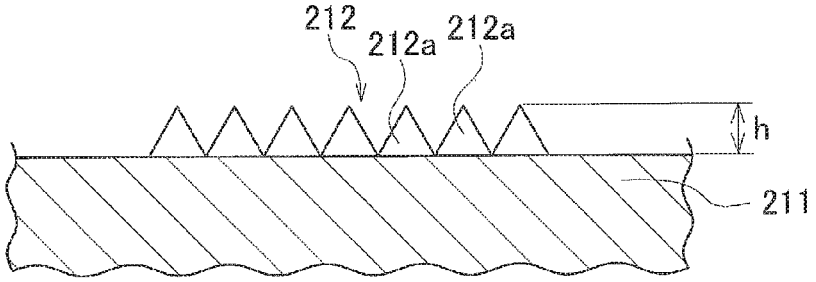
FIG. 44B is a sectional view taken along the line 200B-200B of FIG. 44A.
Figure 44C:
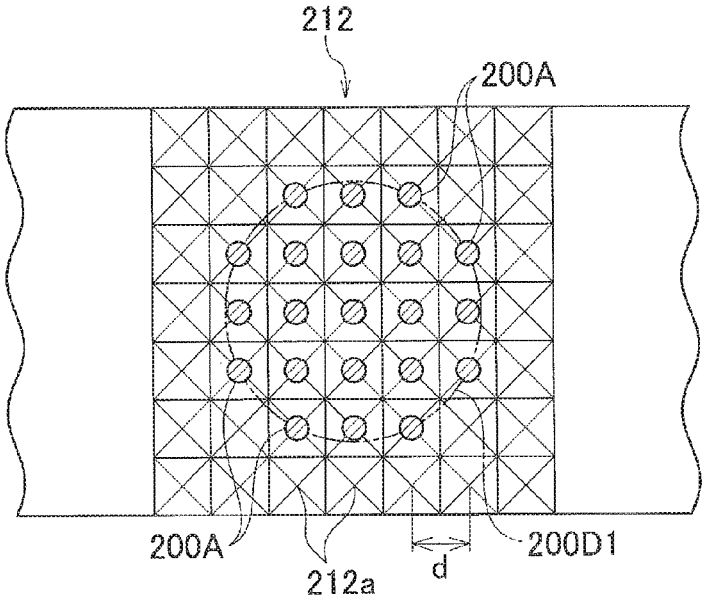
FIG. 44C is a view of an apparent contact surface and actual contact surfaces according to the third embodiment.

FIGS. 44A to 44C illustrate the third embodiment. The third embodiment is different from the second embodiment only in terms of a configuration of a surface 212 having rough surface roughness. That is, according to the third embodiment, the surface 212 having rough surface roughness is formed by providing a large number of minute projections 212*a* protruding on a contact surface of a tab portion 211. The height h of the minute projections 212*a* is in the following range: 2.5 μm<h<5 μm. The pitch interval d between the minute projections 212*a* is in the following range: 5 μm<d<20 μm.

Other configurations are the same as those according to the second embodiment, and the duplicate descriptions thereof will be omitted.

Similarly to the second embodiment, in the third embodiment, the number of actual contact surfaces 200A within an apparent contact surface diameter 200D1 also increases. Thus, contact resistance can be reduced without a female terminal 201 and a male terminal 210 increased in size and complicated as much as possible.

The indent portion 204 according to the second embodiment includes the outer circumferential surface thereof spherical and an indent portion 204 according to the third embodiment includes an outer circumferential surface thereof spherical. The shapes of the outer circumferential surfaces of the respective indent portions 204 are not limited. For example, the outer circumferential surfaces of the respective indent portions 204 include an apex positioned at the uppermost position, and may has a curved surface shape with which the apex gradually lowers due to the smooth curved surface as going toward the outer circumference, an elliptical and spherical surface, a circular cone shape, or a pyramid shape.

As described above, the contact connection structure has a first contact portion including the indent portion protruding, and a second contact portion. During a terminal inserting process, the indent portion of the first contact portion slides on the contact surface of the second contact portion. At a terminal insertion completed position, the outer circumferential surface of the indent portion comes in contact with the second contact portion. The contact surface of the second contact portion is formed so as to have the surface having rough surface roughness.

The surface having rough surface roughness may be formed so as to have unevenness with an electric discharge texture pattern.

Alternatively, the surface having rough surface roughness may be formed by providing a large number of minute projections protruding on the contact surface of the second contact portion.

According to the above configuration, the protruding shapes in large quantities are formed due to the surface roughness of the second contact portion. The contact is securely made at portions of the protruding shapes in large quantities. Accordingly, the indent portion and the contact surface of the second contact portion have the number of actual contact surfaces between the indent portion and the second contact portion increased in comparison to a case where both of the portions have a flat and smooth surface. As described above, the contact resistance can be reduced without the terminals increased in size and complicated as much as possible.

Fourth to sixth embodiments of the present invention will be described in detail below with reference to FIGS. 45 to 52B.

Fourth Embodiment

The fourth embodiment will be described using FIGS. 45 to 48.

Figure 45:
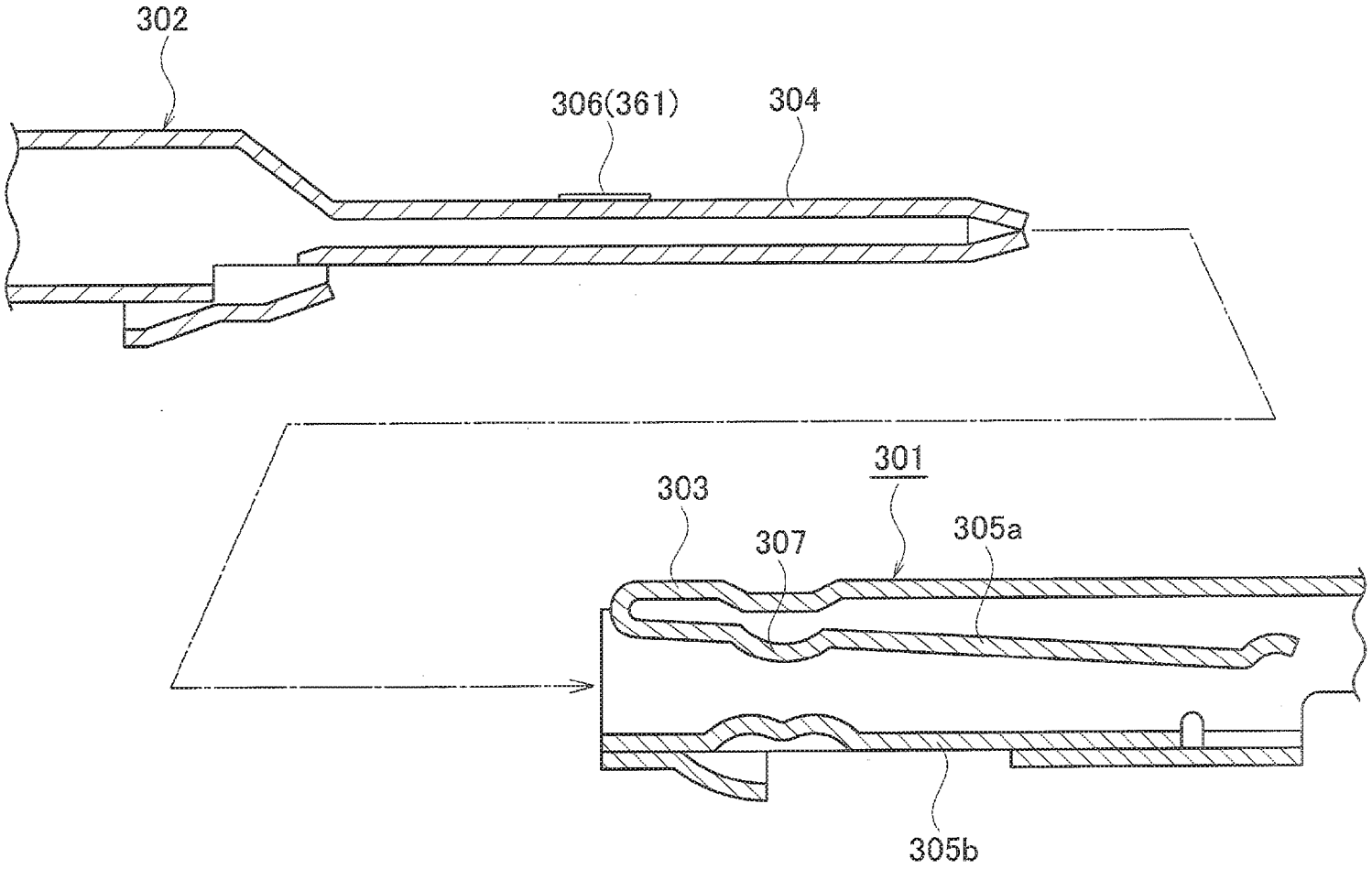
FIG. 45 is a sectional view of a female terminal and a male terminal before terminal insertion according to a fourth embodiment of the present invention.
Figure 46:
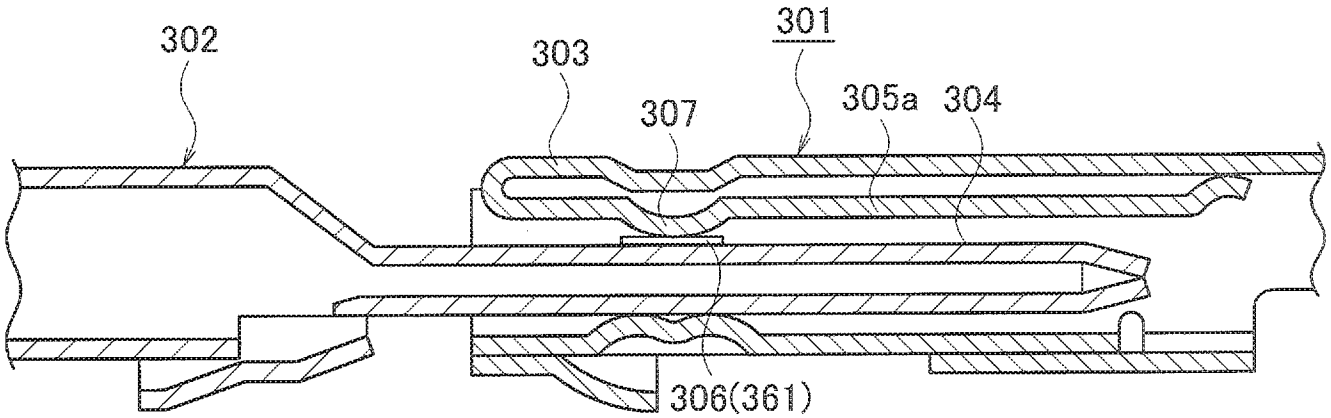
FIG. 46 is a sectional view of the female terminal and the male terminal positioned at a terminal insertion completed position according to the fourth embodiment.
Figure 47:
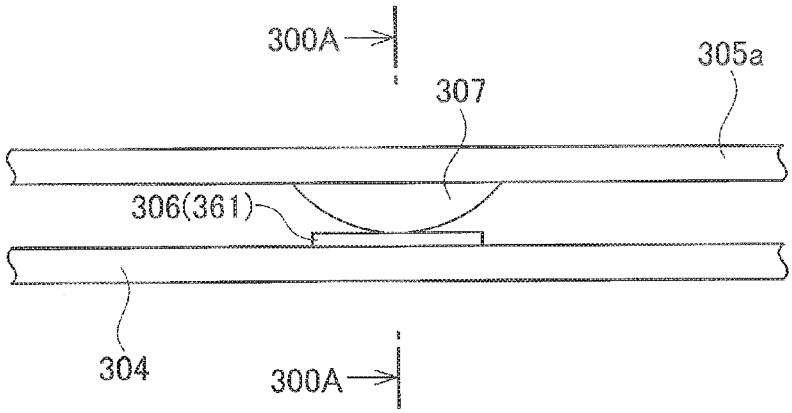
FIG. 47 is an enlarged view of a contact connection main portion of the female terminal and the male terminal according to the fourth embodiment.
Figure 48:
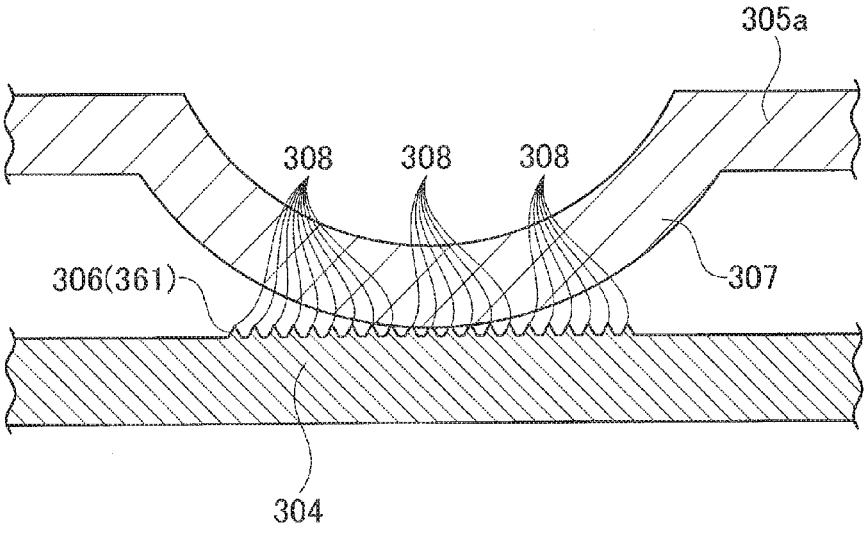
FIG. 48 is a sectional view taken along the line 300A-300A illustrated in FIG. 47.

As illustrated in FIG. 45, terminals using a terminal contact structure according to the fourth embodiment include a female terminal 301 and a male terminal 302. The female terminal 301 is arranged in a terminal housing space in a female-side connector housing not illustrated.

The female terminal 301 includes a surface thereof plated with tin, and a box portion 303 as a first contact portion.

The box portion 303 includes an opening on the front side thereof, and is formed so as to be quadrangular. The box portion 303 includes an elastic bend portion 305*a* and a base portion 305*b*. The elastic bend portion 305*a* is formed by bending an upper surface of the box portion 303 inward. The base portion 305*b* is provided so as to protrude from a lower surface to the upper surface.

The elastic bend portion 305*a* has elasticity and is formed so as to incline from the upper surface to the lower surface of the box portion 303. An indent portion 307 protruding toward the side of a base is formed on a surface of the elastic bend portion 305*a*.

The indent portion 307 spherically protrudes from the elastic bend portion 305*a*, and includes a center position positioned at the spherical lowest place. The indent portion 307 is formed on the elastic bend portion 305*a* so as to be displaceable in an upper and lower direction.

The base portion 305*b* is formed at a position at which substantially facing the indent portion 307 with a predetermined interval. The male terminal 302 is inserted between the base portion 305*b* and the indent portion 307.

The male terminal 302 includes a surface thereof plated with tin, and a tab portion 304 as a second contact portion.

A leading end of the tab portion 304 is inserted between the base portion 305*b* and the indent portion 307 of the female terminal 301. An oxide-film shaving portion 306 is formed on a surface of the tab portion 304. The oxide-film shaving portion 306 is provided to a portion on which the tab portion 304 inserted into the female terminal 301 and the indent portion 307 abut.

The oxide-film shaving portion 306 is provided so as to extend in an inserting direction of the male terminal 302, and includes a shape having a plurality of protruding portions 361 (protruding shapes) ranging along. Leading end portions 308 of the protruding portions 361 are formed so as to have an acute angle. The plurality of protruding portions 361 is provided so that each of the protruding portions 361 is apart from the adjacent protruding portions 361 with intervals.

Next, the insertion between the female terminal 301 and the male terminal 302 will be described.

As illustrated in FIG. 45, the tab portion 304 of the male terminal 302 is inserted from the side of the opening of the box portion 303 of the female terminal 301 The tab portion 304 inserted from the opening of the box portion 303 is inserted between the indent portion 307 and the base portion 305*b*. The tab portion 304 slides on the indent portion 307 and the base portion 305*b*. Then, the elastic bend portion 305*a* is thrust upward so as to elastically deform in a direction in which the indent portion 307 and the base portion 305*b* are alienated from each other The tab portion 304 is further inserted into the female terminal 301 so as to reach a terminal insertion completed position illustrated in FIG. 46. Before the terminal insertion completed position is reached, the leading end portions 308 of the protruding portions 361 of the oxide-file shaving portion 306 formed on the tab portion 304 come in line contact with a surface of the indent portion 307.

The leading end portions 308 of the protruding portions 361 slide on the same portion of the indent portion 307. Thus, an oxide film generated on the surface of the indent portion 307 is destroyed. An oxide film generated on the tab portion 304 slides in contact with the indent portion 307 so as to be destroyed. Then, plating layers exude from portions at which the oxide films have been destroyed. Thus, the pieces of tin plating performed on the surfaces of the female terminal 301 and the male terminal 302, come in contact with each other.

According to the fourth embodiment, when the male terminal 302 is inserted into the female terminal 301, the oxide-film shaving portion 306 provided on the male terminal 302 comes in line contact with the indent portion 307 of the female terminal 301. Thus, the oxide films generated on the indent portion 307 and a contact surface of the male terminal 302 are destroyed.

Then, the tin plating layers exude from the portions at which the oxide films have been destroyed. Thus, the contact between the pieces of plating metal of the female terminal 301 and the male terminal 302 can be acquired. Therefore, contact resistance can be reduced without the terminals increased in size and complicated as much as possible.

The leading end portions 308 of the protruding portions 361 of the oxide-film shaving portion 306 have the acute angle. Thus, the leading end portions 308 can destroy the oxide film of the indent portion 307. As a result, the contact between the pieces of plating metal can be securely acquired.

Fifth Embodiment

A fifth embodiment will be described with reference to FIG. 49. Note that configurations the same as those according to the fourth embodiment are denoted with the same reference signs and the descriptions thereof will be omitted.

An oxide-film shaving portion 306 of a contact connection structure according to the fifth embodiment is formed of a plurality of groove portions 311 provided at intervals on a contact surface of a tab portion 304 as a second contact portion, the plurality of groove portions 311 extending in an inserting direction of an indent portion 307.

Figure 49:
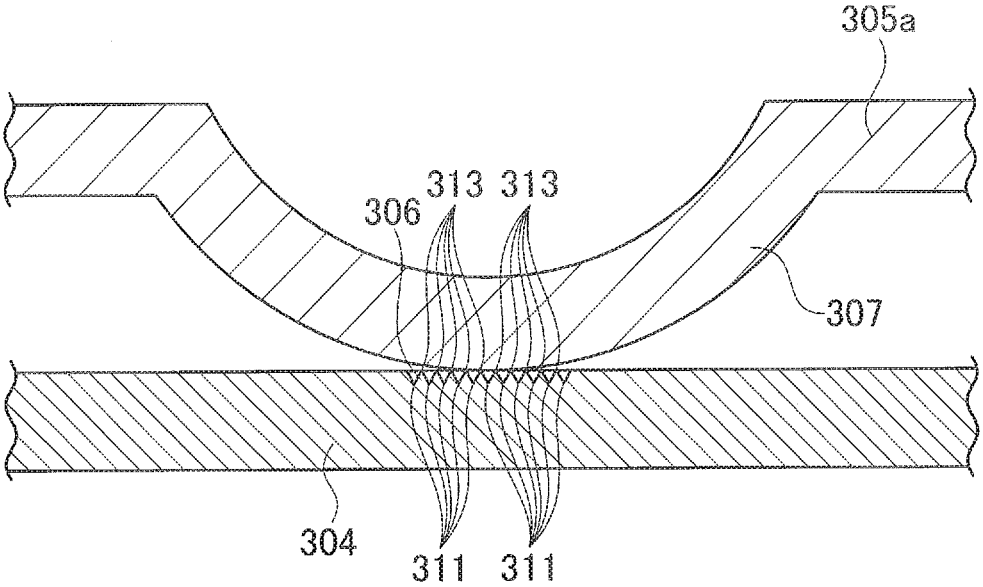
FIG. 49 is an enlarged sectional view of a contact connection main portion of a female terminal and a male terminal according to a fifth embodiment of the present invention.

As illustrated in FIG. 49, each of the groove portions 311 has a V shape. An edge portion 313 (here, an apex portion) positioned between the adjacent groove portions 311 and 311 is provided. A leading end of the edge portion 313 is formed so as to have an acute angle.

The edge portions 313 of the oxide-film shaving portion 306 slide in line contact with a surface of the indent portion 307 when the tab portion 304 is inserted into a box portion 303 and then reaches the indent portion 307.

Due to the slide between the edge portions 313 and the indent portion 307, an oxide film generated on the surface of the indent portion 307 is shaved and destroyed by the edge portions 313. An oxide film generated on the tab portion 304 slides in contact with the indent portion 307 so as to be destroyed. Then, plating layers exude from portions at which the oxide films have been destroyed. Thus, pieces of tin plating that have been performed to surfaces of a female terminal 301 and a male terminal 302, come in contact with each other.

Similarly to the fourth embodiment, according to the fifth embodiment, when the male terminal 302 is inserted into the female terminal 301, the oxide-film shaving portion 306 provided on the male terminal 302 comes in line contact with the indent portion 307 of the female terminal 301. Thus, the oxide films generated on the indent portion 307 and a contact surface of the male terminal 302 are destroyed.

Then, the tin plating layers exude from the portions at which the oxide films have been destroyed. Thus, the contact between the pieces of plating metal of the female terminal 301 and the male terminal 302 can be acquired. Therefore, contact resistance can be reduced without the terminals increased in size and complicated as much as possible.

The oxide-film shaving portion 306 includes the edge portion 313 positioned between the adjacent groove portions 311 and 311. Thus, the oxide-film shaving portion 306 does not protrude from the contact surface of the tab portion 304. Thus, the terminals can be inhibited from being increased in size.

Sixth Embodiment

A sixth embodiment will be described using FIGS. 50 to 52B. Note that, configurations the same as those according to the fourth and fifth embodiments are denoted with the same reference signs and the descriptions thereof will be omitted.

Figure 50:
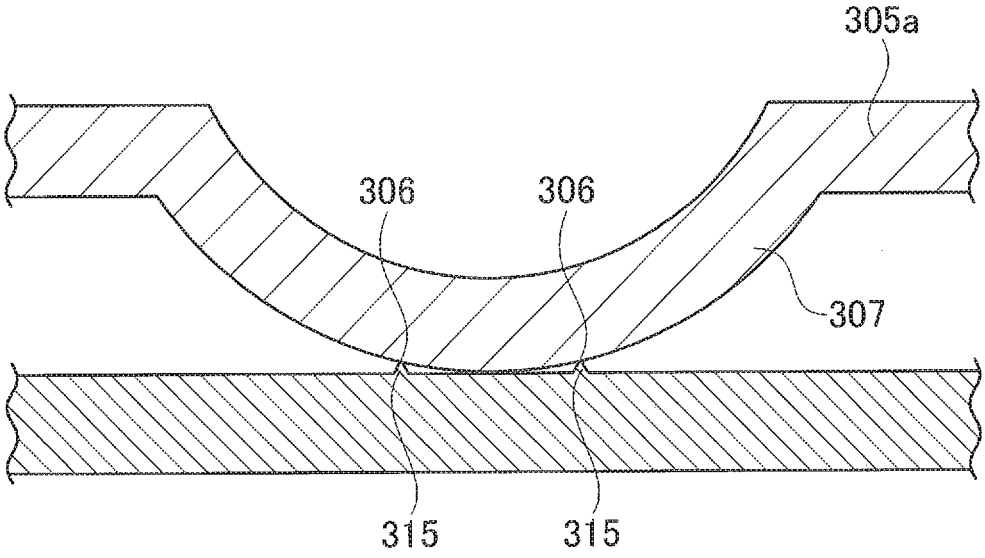
FIG. 50 is an enlarged sectional view of a contact connection main portion of a female terminal and a male terminal according to a sixth embodiment of the present invention.
Figure 51A:
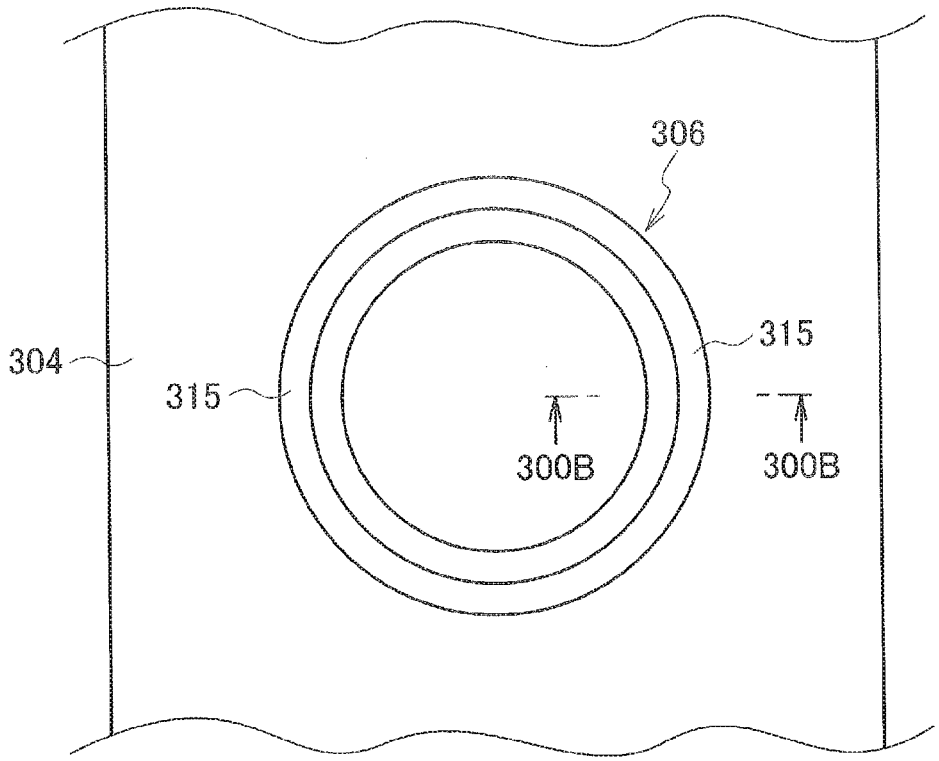
FIG. 51A is an enlarged view of a main portion of the male terminal according to the sixth embodiment.
Figure 51B:
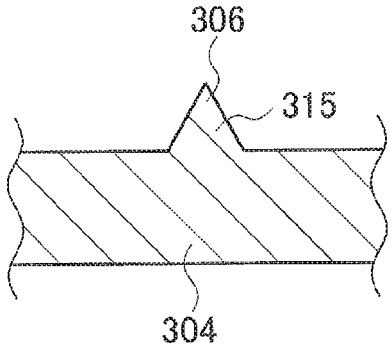
FIG. 51B is a sectional view taken along the line 300B-300B illustrated in FIG. 51A.

As illustrated in FIGS. 50 and 51, an oxide-film shaving portion 306 of a contact connection structure according to the sixth embodiment is formed of an annular arc portion 315 having a shape the same as that of a circumference portion of an indent portion 307 spherically protruding from a contact surface of an elastic bend portion 305*a*, on a contact surface of a tab portion 304 on which the indent portion 307 is positioned. The annular arc portion 315 protrudes from a surface of the tab portion 304. A leading end of the annular arc portion 315 is formed so as to have an acute angle.

The oxide-film shaving portion 306 including such the annular arc portion 315 slides in line contact with a surface of the circumference portion of the indent portion 307 when the tab portion 304 is inserted into a box portion 303 and then reaches the indent portion 307.

Here, it is known that an oxide film to be generated in proximity to the circumference portion cracks easier than an oxide film to be generated in proximity to a center portion on the surface of the indent portion 307.

Accordingly, sliding the oxide-film shaving portion 306 including the annular arc portion 315 curved along the circumference portion of the indent portion 307, on the circumference portion of the indent portion 307, shaves the oxide film generated on the surface of the indent portion 307. Thus, destruction of the oxide film can be accelerated.

Note that, an oxide film generated on the tab portion 304 slides in contact with the indent portion 307 so as to be destroyed. Then, plating layers exude from portions at which the oxide films have been destroyed. Thus, the pieces of tin plating performed on the surfaces of the female terminal 301 and the male terminal 302, come in contact with each other.

Figure 52A:
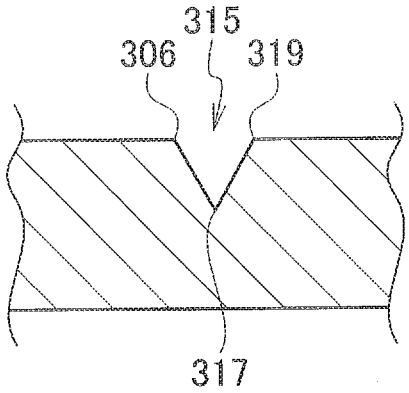
FIG. 52A is a sectional view of a modification of the oxide-film shaving portion illustrated in FIG. 51B.
Figure 52B:
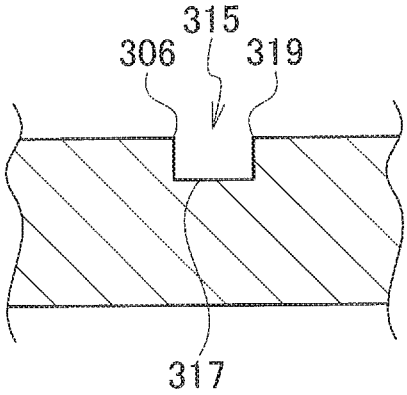
FIG. 52B is a sectional view of another modification of the oxide-film shaving portion illustrated in FIG. 51B.

Here, as illustrated in FIGS. 52A and 52B, as the annular arc portion 315, the oxide-film shaving portion 306 may include an annular groove portion 317 provided on the contact surface of the tab portion 304 on which the indent portion 307 is positioned, and an edge portion 319 of the groove portion 317 as the annular arc portion 315.

Note that, as illustrated in FIGS. 52A and 52B, the shape of the groove portion 317 may have any of shapes having the edge portion 319, such as a V shape or a recess shape.

Similarly to the fourth and fifth embodiments, according to the sixth embodiment, when the male terminal 302 is inserted into the female terminal 301, the oxide-film shaving portion 306 provided on the male terminal 302 comes in line contact with the indent portion 307 of the female terminal 301. Thus, the oxide films generated on the indent portion 307 and a contact surface of the male terminal 302 are destroyed.

Then, the tin plating layers exude from the portions at which the oxide films have been destroyed. Thus, the contact between the pieces of plating metal of the female terminal 301 and the male terminal 302 can be acquired. Therefore, contact resistance can be reduced without the terminals increased in size and complicated as much as possible.

The oxide-film shaving portion 306 has the annular arc portion 315 curved along the circumference portion of the indent portion 307. Thus, the annular arc portion 315 can accelerate the destruction of the oxide film generated on the circumference portion of the indent portion 307, the oxide film being apt to crack, and the contact between the pieces of plating metal can be further securely acquired.

Note that, according to the sixth embodiment, the tin plating layers are formed on surfaces of the elastic bend portion 305*a* and the tab portion 304. The same effect is acquired with plating layers on which an oxide film is formed, except tin.

According to the sixth embodiment, the oxide-film shaving portion 306 is formed of only the annular arc portion. For example, a protruding portion extending in an inserting direction of the terminal, the protruding portion being provided at a center portion surrounded by the annular arc portion, may be used for the oxide-film shaving portion. Alternatively, the oxide-film shaving portion 306 may include a plurality of combinations.

Note that, the shape of the oxide-film shaving portion 306 to be formed on the tab portion 304 is not limited to the above forms. For example, a lattice shape may be provided. Alternatively, a shape including a plurality of protruding portions, such as a file, provided thereto, may be provided.

As described above, the contact connection structure has a first contact portion including the indent portion protruding and the plating layer formed on the surface, and a second contact portion including the plating layer formed on the surface. The indent portion of the first contact portion slides on the contact surface of the second contact portion. At a terminal insertion completed position, the indent portion comes in contact with the second contact portion. The oxide-film shaving portion is provided on the contact surface of the second contact portion.

According to the above configuration, when the second contact portion is inserted to the first contact portion, the oxide-film shaving portion formed on the second contact portion comes in contact with the indent portion of the first contact portion. Thus, the oxide films generated on the indent portion and the contact surface of the second contact portion are destroyed. Then, the contact between the pieces of plating metal of the first contact portion and the second contact portion can be acquired at the portions at which the oxide films have been destroyed. Therefore, contact resistance can be reduced without the terminals increased in size and complicated as much as possible.

The oxide-film shaving portion may include the protruding shape, and the leading end portion may be formed so as to have an acute angle.

According to the above configuration, the leading end portion of the oxide-film shaving portion is formed so as to have an acute angle. Thus, the leading end portion can shave and destroy the oxide film of the indent portion, and the contact between the pieces of plating metal can be further securely acquired.

The oxide-film shaving portion may have the plurality of protruding portions provided to extend in the inserting direction of the indent portion with intervals.

According to the above configuration, the oxide-film shaving portion 306 has the plurality of protruding portions provided to extend in the inserting direction of the indent portion with the intervals. Thus, the protruding portions come in line contact with the indent portion of the first contact portion so that the oxide films generated on the indent portion and the contact surface of the second contact portion can be destroyed. As a result, the contact between the pieces of plating metal can be acquired.

The oxide-film shaving portion may have the edge portion positioned between the adjacent groove portions in the plurality of groove portions provided to extend in the inserting direction of the indent portion with intervals, on the contact surface of the second contact portion.

According to the above configuration, the oxide-film shaving portion has the edge portion positioned between the adjacent groove portions. Thus, the protruding portion does not protrude from the contact surface of the second contact portion, and the terminals can be inhibited from being increased in size.

The oxide-film shaving portion may have the annular arc portion curved along the circumference portion of the indent portion.

According to the above configuration, the oxide-film shaving portion has the annular arc portion curved along the circumference portion of the indent portion. Thus, the annular arc portion can accelerate the destruction of the oxide film generated on the circumference portion of the indent portion, the oxide film being apt to crack, and the contact between the pieces of plating metal can be further securely acquired.

Seventh Embodiment

A seventh embodiment of the present invention will be described in detail below with reference to FIGS. 53 to 63.

Figure 59:
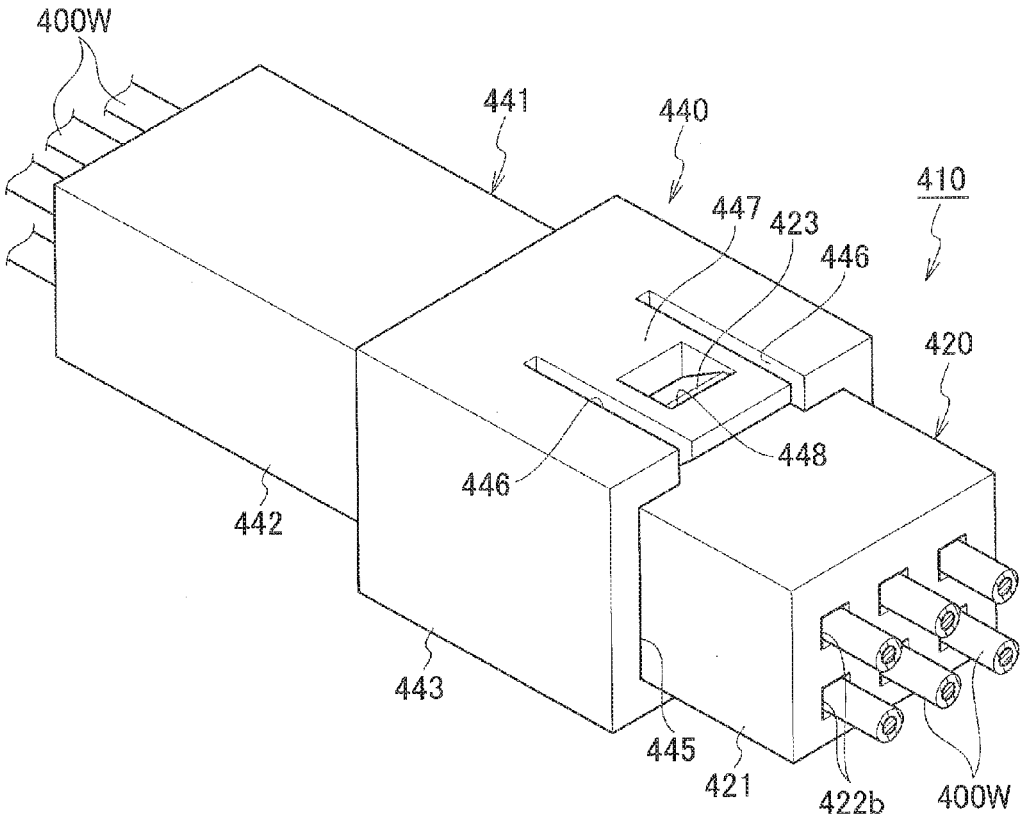
FIG. 59 is a perspective view of an engaged connector according to the seventh embodiment.
Figure 60A:
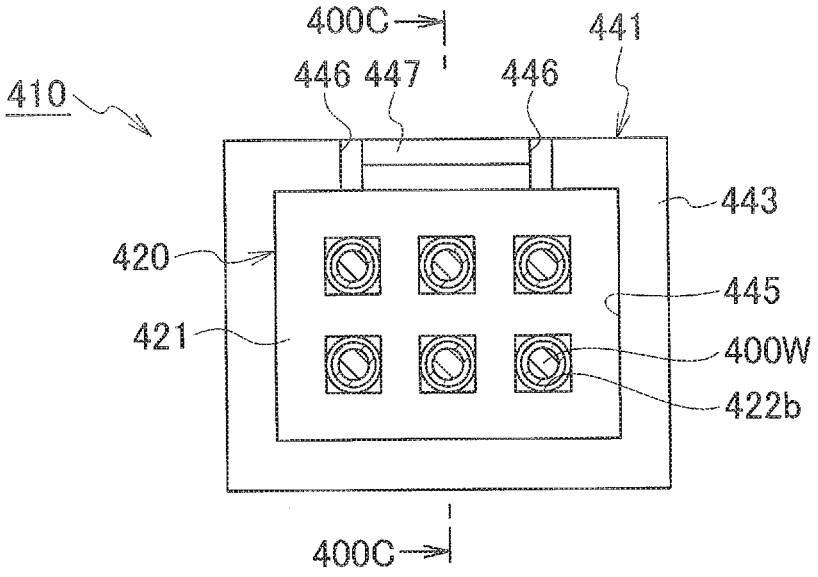
FIG. 60A is a front view of the engaged connector according to the seventh embodiment.
Figure 60B:
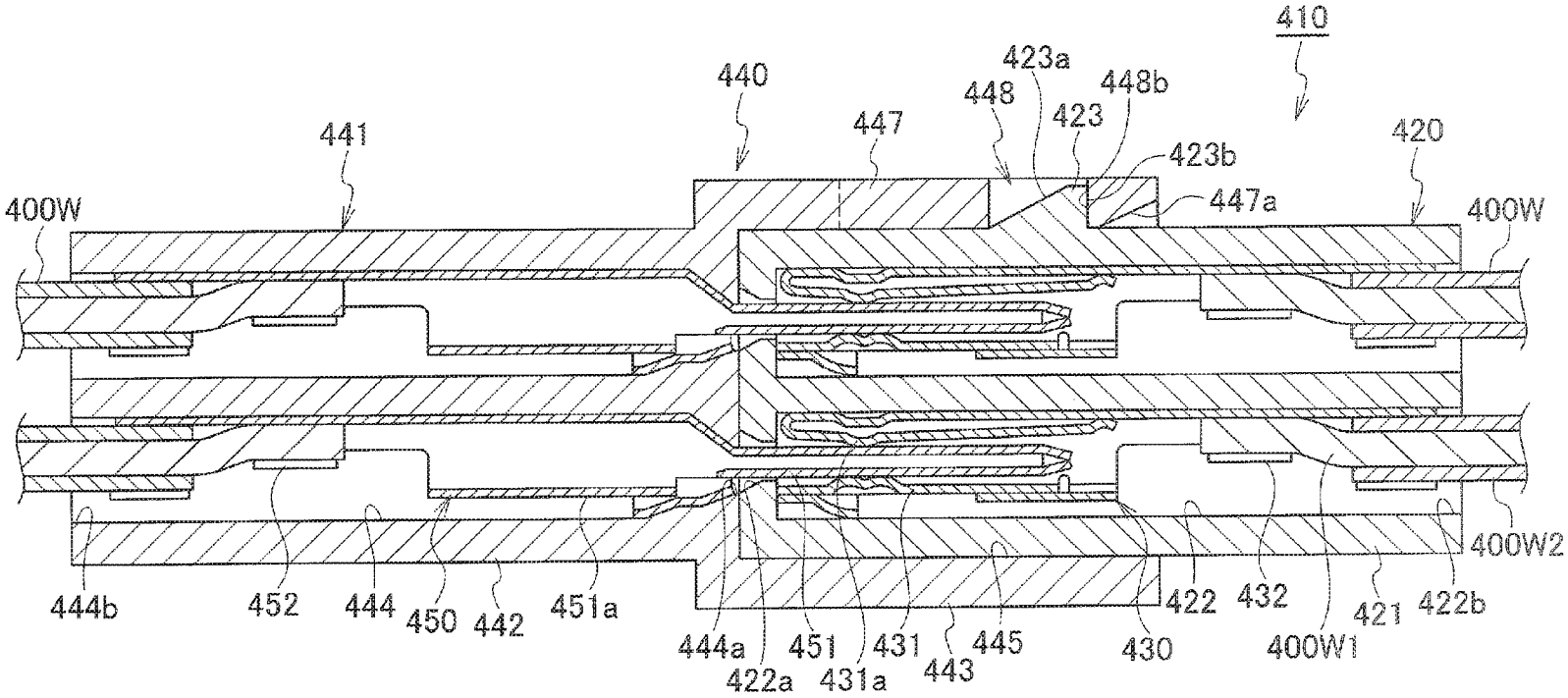
FIG. 60B is a sectional view taken along the line 400C-400C of FIG. 60A.

A connector 410 according to the seventh embodiment includes a male connector portion 420 and a female connector portion 440 as illustrated in FIGS. 59, 60A, and 60B.

Figure 53:
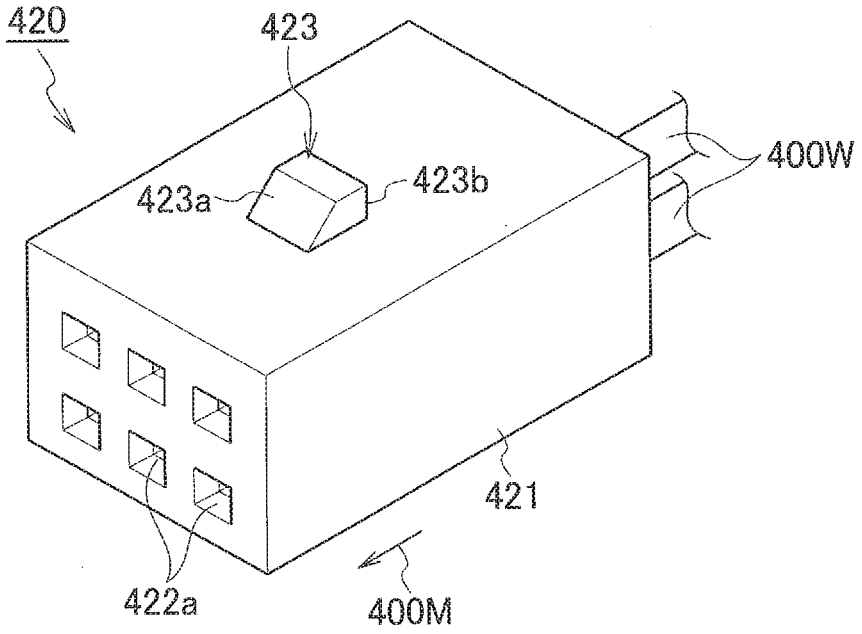
FIG. 53 is a perspective view of a male connector portion according to a seventh embodiment.
Figure 54A:
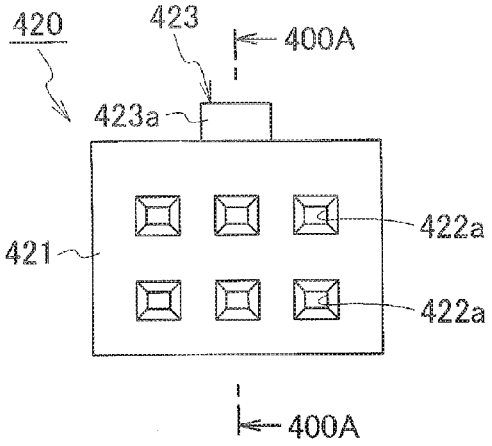
FIG. 54A is a front view of the male connector portion according to the seventh embodiment.
Figure 54B:
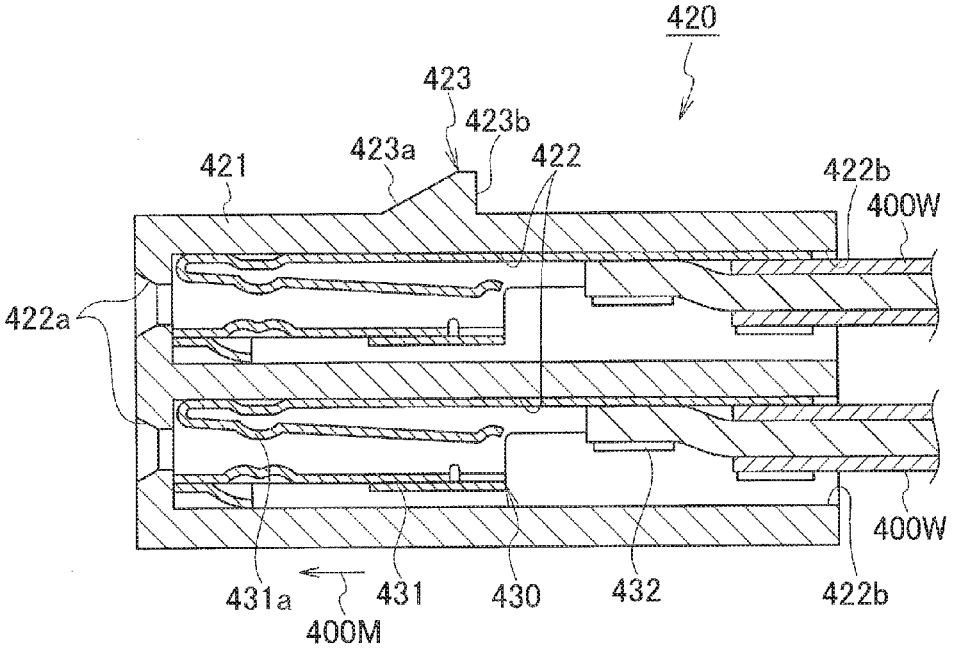
FIG. 54B is a sectional view taken along the line 400A-400A of FIG. 54A.
Figure 55:
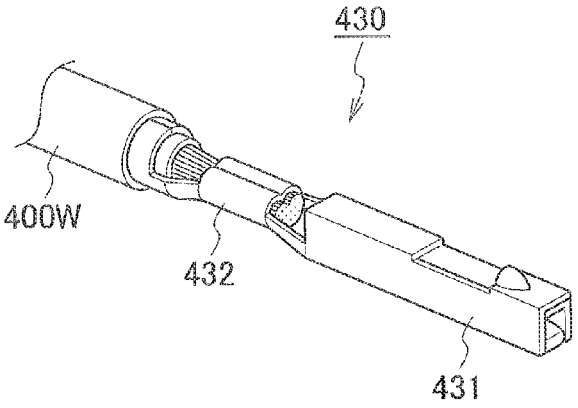
FIG. 55 is a perspective view of a female terminal according to the seventh embodiment.

The male connector portion 420 includes a male connector housing 421 being a first connector housing as illustrated in FIGS. 53 to 55. A plurality of terminal housing spaces 422 is provided in the male connector housing 421. An opposing terminal inlet 422*a* is provided on the front side of each of the terminal housing spaces 422. Meanwhile, an electric wire outlet 422*b* is provided on the rear side of each of the terminal housing spaces 422.

Each of the terminal housing spaces 422 houses a female terminal 430 being a first terminal. The female terminal 430 is inserted from the electric wire outlet 422*b* into the terminal housing space 422. The female terminal 430 is fixed at a predetermined position of the terminal housing space 422.

The female terminal 430 includes a surface to which tin plating has been performed, and includes a box portion (a first contact portion) 431 and an electric wire crimp portion 432.

The box portion 431 includes an opening on the front side thereof, and is formed so as to be quadrangular. The box portion 431 includes an elastic bend portion 431*a* and a base portion 431*c*. The elastic bend portion 431*a* is formed by bending an upper surface of the box portion 431 inward. The base portion 431*c* is provided so as to protrude from a lower surface to the upper surface.

The elastic bend portion 431*a* has elasticity and is formed so as to incline from the upper surface to the lower surface of the box portion 431. An indent portion 431*b* protruding toward the side of a base is formed on a surface of the elastic bend portion 431*a*.

The indent portion 431*b* spherically protrudes from the elastic bend portion 431*a*, and includes a center position positioned at the spherical lowest place. The indent portion 431*b* is formed on the elastic bend portion 431*a* so as to be displaceable in an upper and lower direction.

The base portion 431*c* is formed at a position at which substantially facing the indent portion 431*b* with a predetermined interval. The male terminal 450 is inserted between the base portion 431*c* and the indent portion 431*b*.

An end portion of an electric wire 400W is coupled to the electric wire crimp portion 432 by crimping. Specifically, the electric wire 400W includes a core material portion 400W1 and a covering portion 400W2. The electric wire crimp portion 432 is crimped in a state where the core material 400W1 of the end portion of the electric wire 400W has been exposed. Thus, the box portion 431 is electrically coupled to the electric wire 400W.

A lock protruding portion 423 being a locking portion protrudes on an upper surface of the male connector housing 421. The lock protruding portion 423 includes a tapered plane 423*a* formed on the side of a leading end in a male connector engaging direction 400M, and a vertical plane 423*b* formed on the side of a rear end in the male connector engaging direction 400M, individually. The tapered plane 423*a* functions as a guiding plane for performing smooth movement of the lock protruding portion 423 during an engaging process between a start for engaging the connector 410 and a connector engaging position. Meanwhile, the vertical plane 423*b* functions as a locking plane at the connector engaging position.

Figure 56:
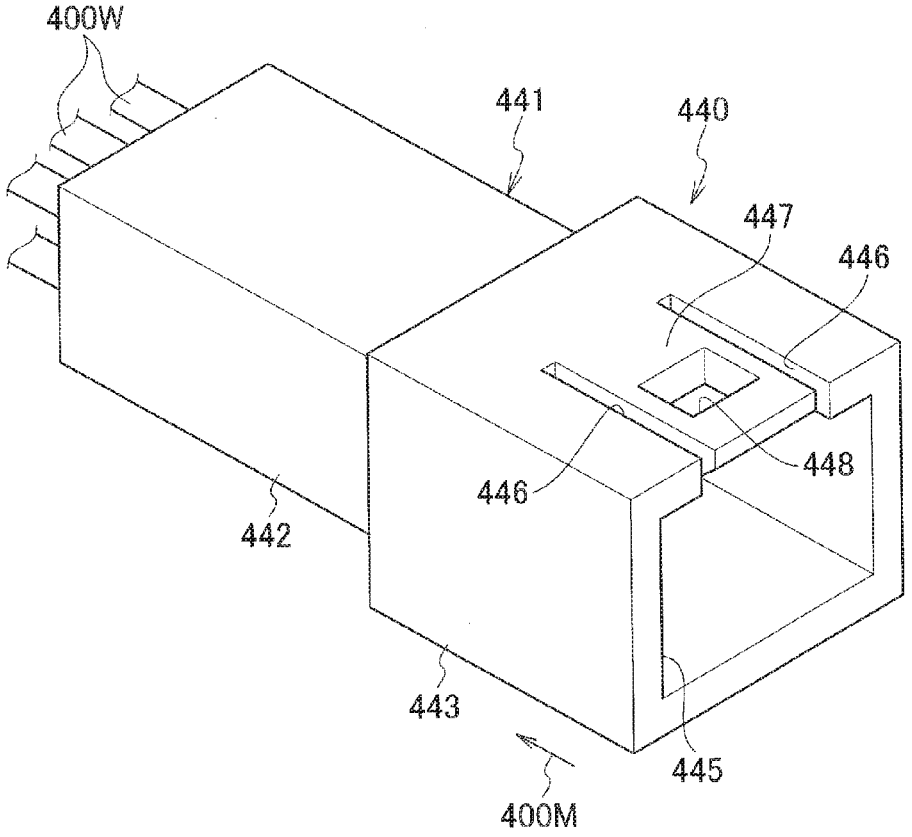
FIG. 56 is a perspective view of a female connector portion according to the seventh embodiment.
Figure 57A:
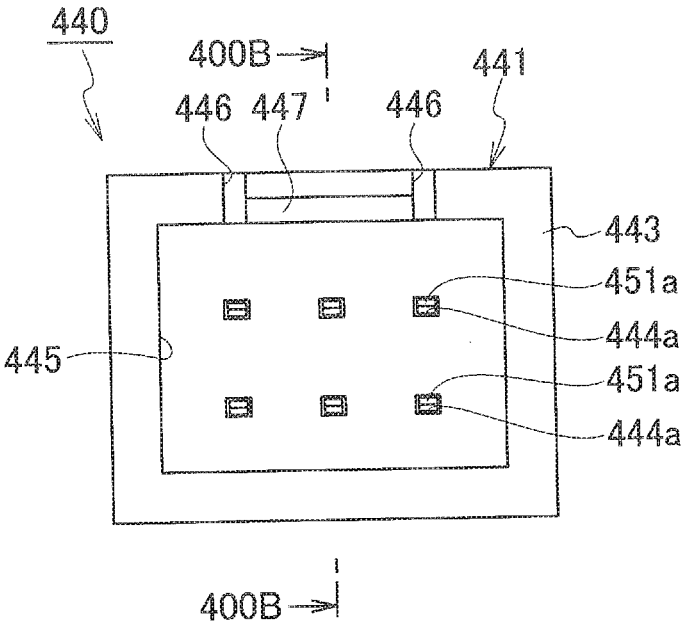
FIG. 57A is a front view of the female connector portion according to the seventh embodiment.
Figure 57B:
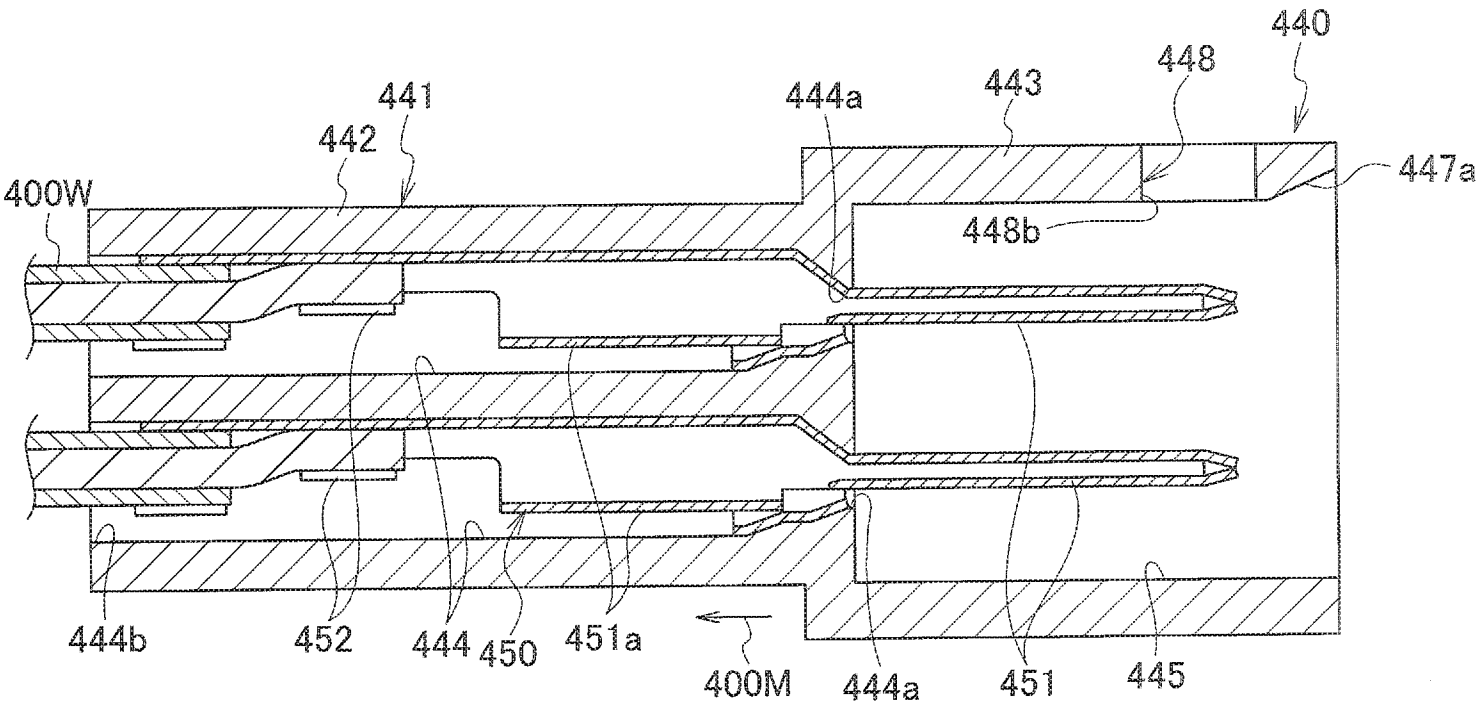
FIG. 57B is a sectional view taken along the line 400B-400B of FIG. 57A.
Figure 58:
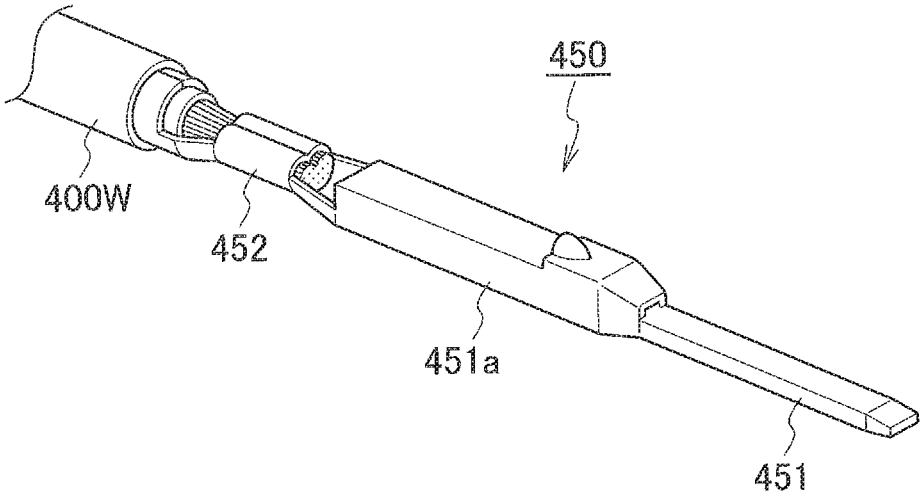
FIG. 58 is a perspective view of a male terminal according to the seventh embodiment.

The female connector portion 440 includes a female connector housing 441 being a second connector housing as illustrated in FIGS. 56 to 58. The female connector housing 441 includes a housing body portion 442 and a hood portion 443 integrally provided to the front side of the housing body portion 442.

A plurality of terminal housing spaces 444 is provided in the housing body portion 442. A terminal protruding opening 444*a* is provided on the front side of each of the terminal housing spaces 444. Meanwhile, an electric wire outlet 444*b* is provided on the rear side of each of the terminal housing spaces 444.

Each of the terminal housing spaces 444 houses a male terminal 450 being a second terminal. The male terminal 450 is inserted from the electric wire outlet 444*b* into the terminal housing space 444. The male terminal 450 is fixed at a predetermined position of the terminal housing space 444.

The male terminal 450 includes a surface to which tin plating has been performed, and includes a tab (a second contact portion) 451 and an electric wire crimp portion 452.

The tab portion 451 protrudes forward from a box body 451*a*, and protrudes to the hood portion 443 through the terminal protruding opening 444*a*. A leading end of the tab portion 451 is inserted between the base portion 431*c* and the indent portion 431*b* of the female terminal 430.

An end portion of an electric wire 400W is coupled to the electric wire crimp portion 452 by crimping. Specifically, the electric wire 400W includes a core material portion 400W1 and a covering portion 400W2. The electric wire crimp portion 452 is crimped in a state where the core material 400W1 of the end portion of the electric wire 400W has been exposed. Thus, the tab portion 451 is electrically coupled to the electric wire 400W.

A connector engaging space 445 including an opening on the side of a front surface thereof, is formed inside the hood portion 443. The connector engaging space 445 is made so that the male connector housing 421 engages through the front opening.

A bend arm portion 447 is integrally provided to an upper surface portion of the hood portion 443 by a pair of slits 446 reaching an opening end of the hood portion 443. The bend arm portion 447 is formed by the pair of slits 446 so as to be bendable and deformable with respect to the hood portion 443. A locking hole 448 being a portion to be locked is formed at the bend arm portion 447. At the engaging position of the connector 410, the locking hole 448 locks the lock protruding portion 423 so that locking is performed between both of the connector housings 421 and 441. That is, a connector locking means is configured with the locking hole 448 and the lock protruding portion 423.

A tapered plane 447*a* is formed on the bend arm portion 447. A jig for release, not illustrated, is inserted into a gap formed by providing the tapered plane 447*a* so that releasing operation for the engaged connector 410 is performed.

The locking hole 448 includes a vertical plane 448*b* formed on the side of a rear end thereof in the male connector engaging direction 400M. The vertical plane 448*b* functions as a locking plane at the connector engaging position.

Next, engaging operation of the connector 410 will be described.

First, the male connector housing 421 is inserted into the connector engaging space 445 of the female connector housing 441. Then, the lock protruding portion 423 of the male connector housing 421 abuts on a front end surface of the bend arm portion 447 of the female connector housing 441.

When the male connector housing 421 is further inserted from this state, the tapered plane 423*a* of the lock protruding portion 423 gradually bends and deforms the side of a front end of the bend arm portion 447 upward. Then, the lock protruding portion 423 moves below the bend arm portion 447 that has been bent and deformed upward so that the male connector housing 421 is gradually inserted into the connector engaging space 445.

When the male connector housing 421 is inserted to the connector engaging position of the connector engaging space 445, each female terminal 430 and each male terminal 450 come in an appropriate contact state. In addition, positions of the lock protruding portion 423 and the locking hole 448 agree with each other. Accordingly, the bend arm portion 447 is bent and deformed so as to be restored so that the locking hole 448 locks the lock protruding portion 423.

In this manner, as illustrated in FIGS. 59, 60A, and 60B, the connector 410 comes in an engaging state and is completed. In this type of engaging state of the connector 410, the vertical plane 423*b* of the lock protruding portion 423 toward the male connector housing 421 and the vertical plane 448*b* of the locking hole 448 toward the female connector housing 441 are arranged so as to face each other. This locking force acts as engaging force of the connector 410 so that the locking is performed between both of the male connector portion 420 and the female connector portion 440 of the connector 410.

Figure 61:
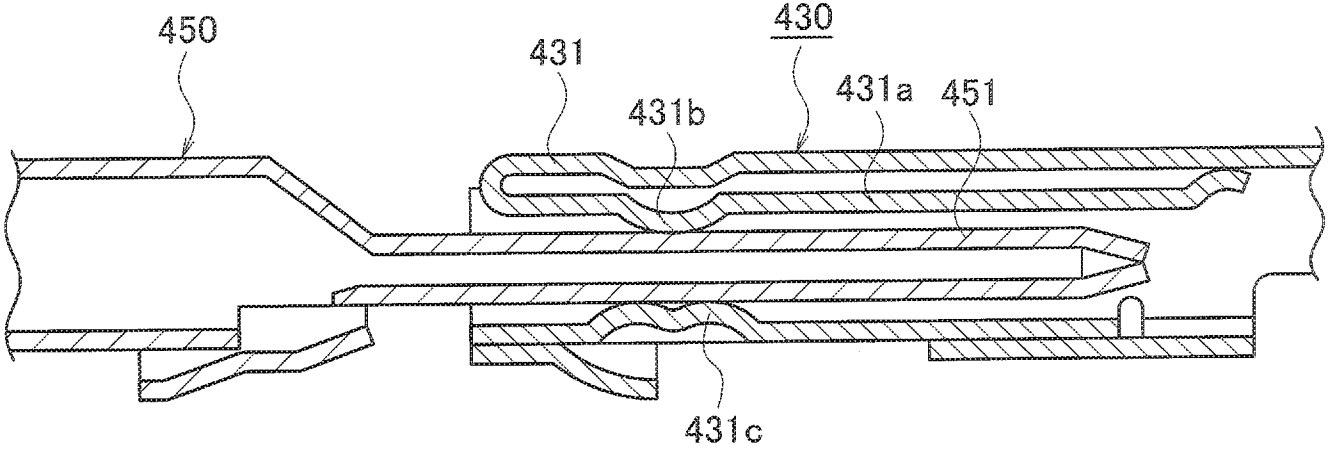
FIG. 61 is a sectional view of the female terminal and the male terminal positioned at a terminal insertion completed position according to the seventh embodiment.

In this case, as illustrated in FIG. 61, the tab portion 451 of the male terminal 450 is inserted into the box portion 431 of the female terminal 430 in a state where the elastic bend portion 431*a* has bent and deformed.

During the inserting process of the tab portion 451, the tab portion 451 slides on the indent portion 431*b* of the elastic bend portion 431*a*. At a terminal insertion completed position, as illustrated in FIG. 61, the indent portion 431*b* of the elastic bend portion 431*a* and a surface of the tab portion 451 come in contact with each other.

In this state, the indent portion 431*b* of the female terminal 430 and the contact surface of the tab portion 451 of the male terminal 450 electrically come in contact with each other with bend restoring force of the elastic bend portion 431*a* as a contact load. When an electric current flows through the contact surface, energization is provided between the female terminal 430 and the male terminal 450.

In this manner, in a contact connection structure according to the seventh embodiment, the elastic bend portion 431*a* of the box portion (the first contact portion) 431 slides on the contact surface of the tab portion (the second contact portion) 451. At the terminal insertion completed position, the indent portion (a contact portion) 431*b* that is at least a part of the elastic bend portion 431*a* thrusts the second contact portion 451 so as to come in contact.

Figure 1:
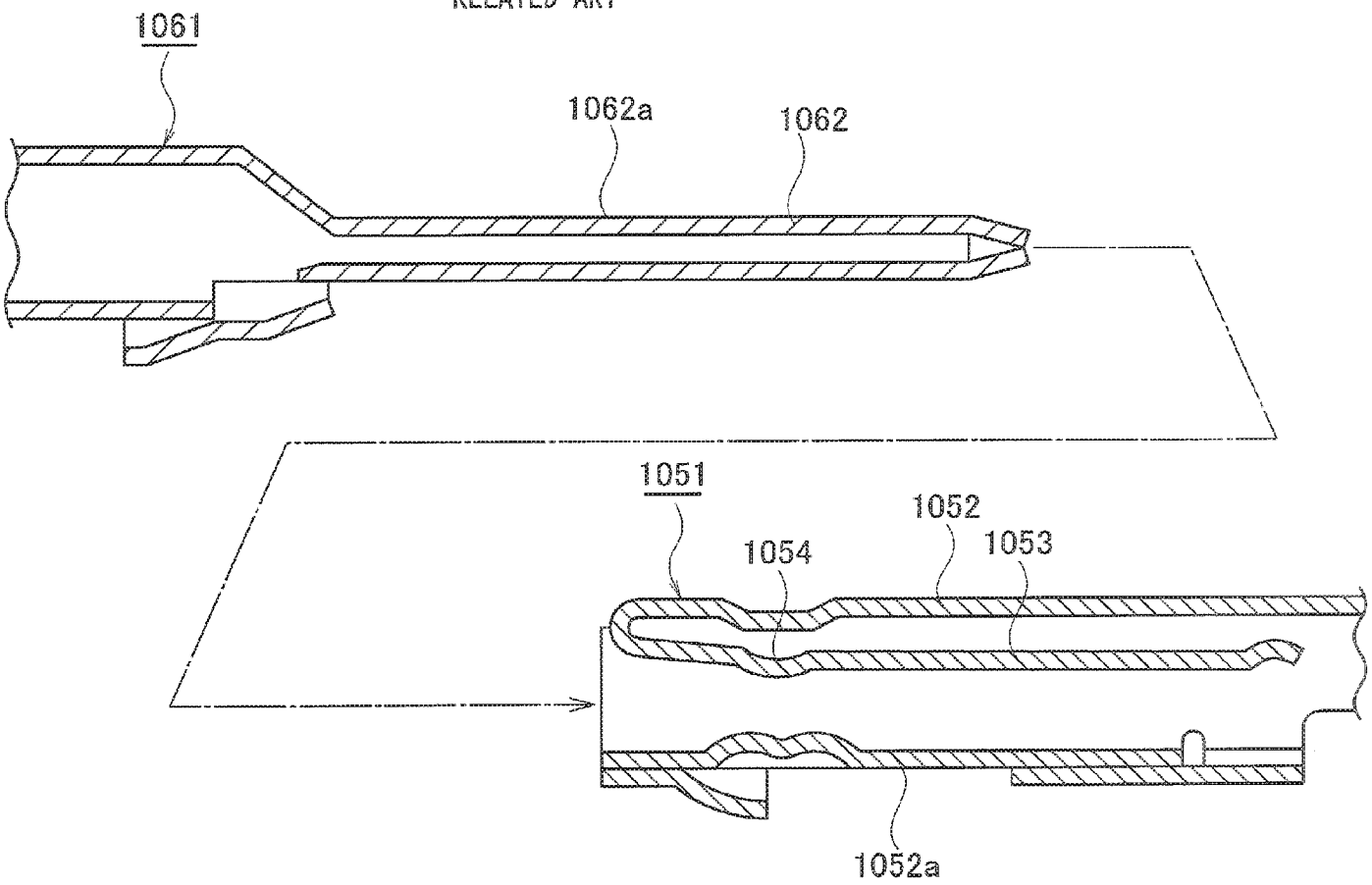
FIG. 1 RELATED ART
FIG. 1 is a sectional view of a female terminal and a male terminal before connection according to the related art.
Figure 2A:
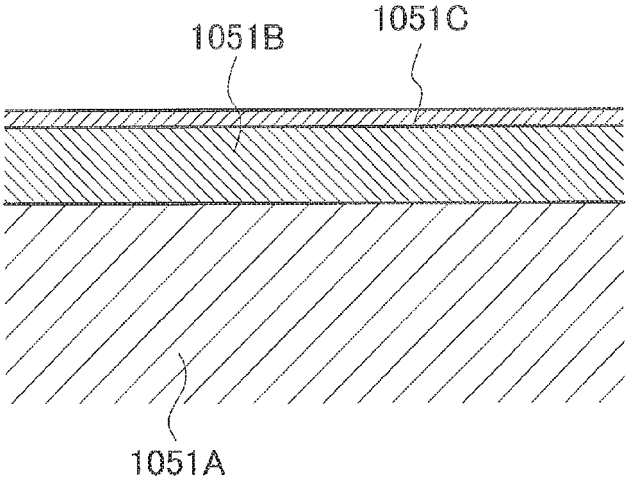
FIG. 2A RELATED ART
FIG. 2A is a schematic sectional view of a structure of a forming material for forming the female terminal according to the related art.
Figure 2B:
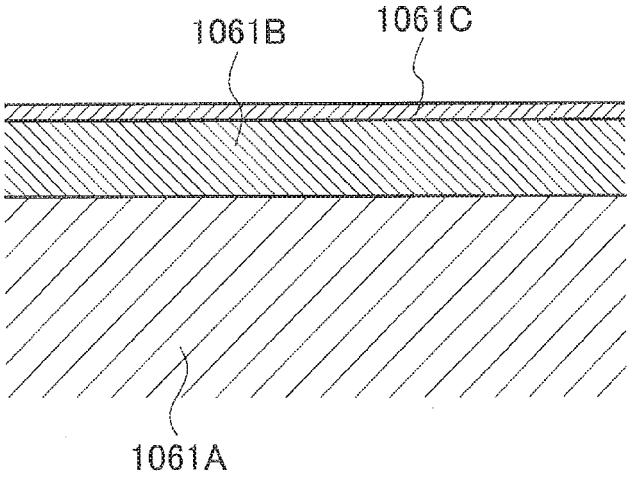
FIG. 2B RELATED ART
FIG. 2B is a schematic sectional view of a structure of a forming material for forming the male terminal according to the related art.
Figure 3:
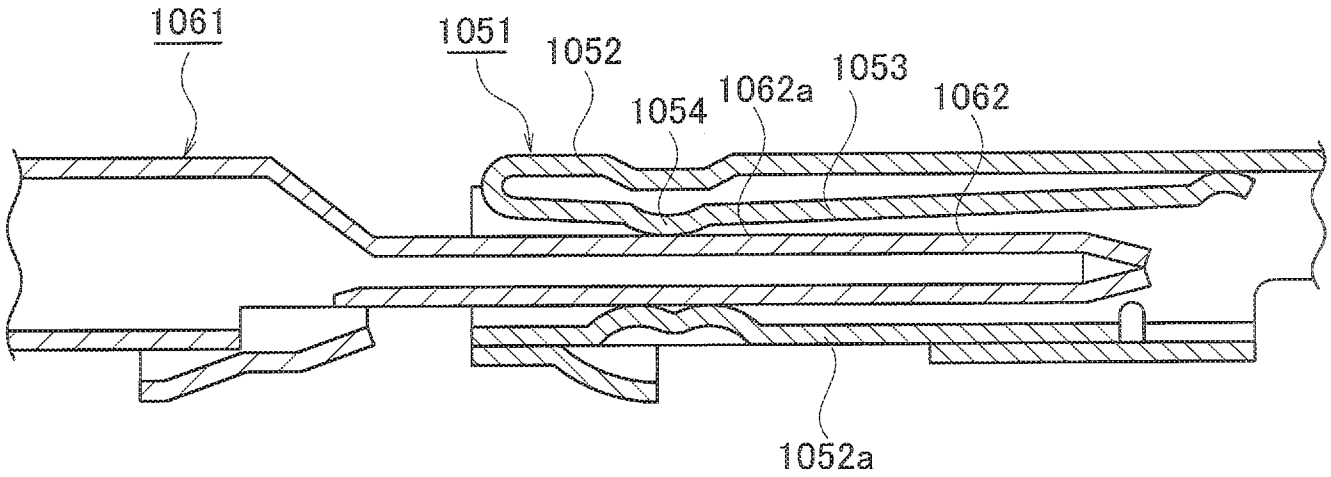
FIG. 3 RELATED ART
FIG. 3 is a sectional view of the female terminal and the male terminal after the connection according to the related art.
Figure 4:
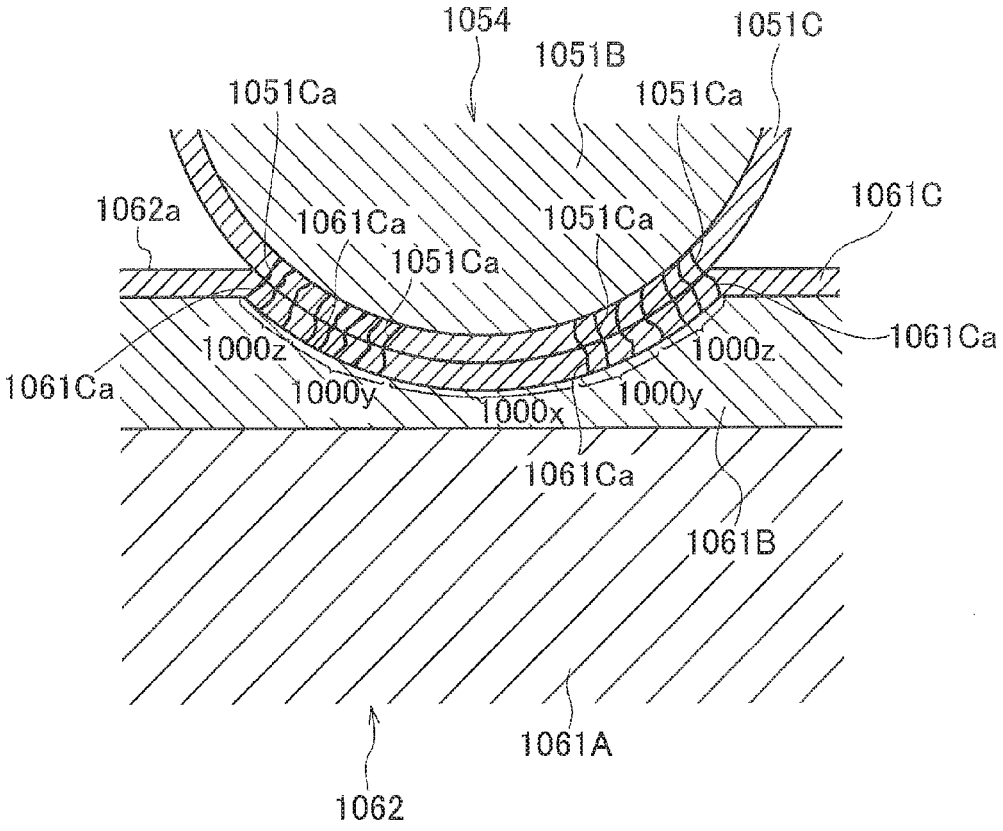
FIG. 4 RELATED ART
FIG. 4 is a schematic sectional view of an indent portion in contact with a tab portion according to the related art.
Figure 5A:
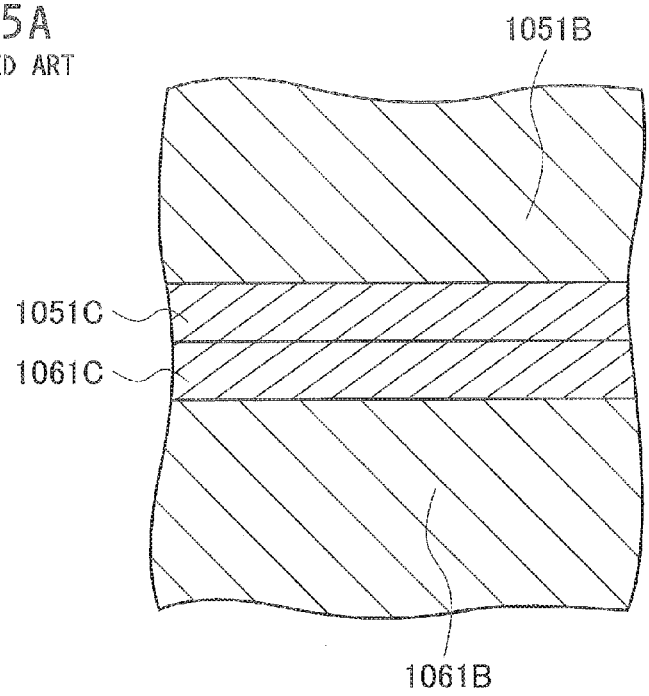
FIG. 5A RELATED ART
FIG. 5A is an enlarged sectional view of a portion 1000*x* of FIG. 4
Figure 5B:
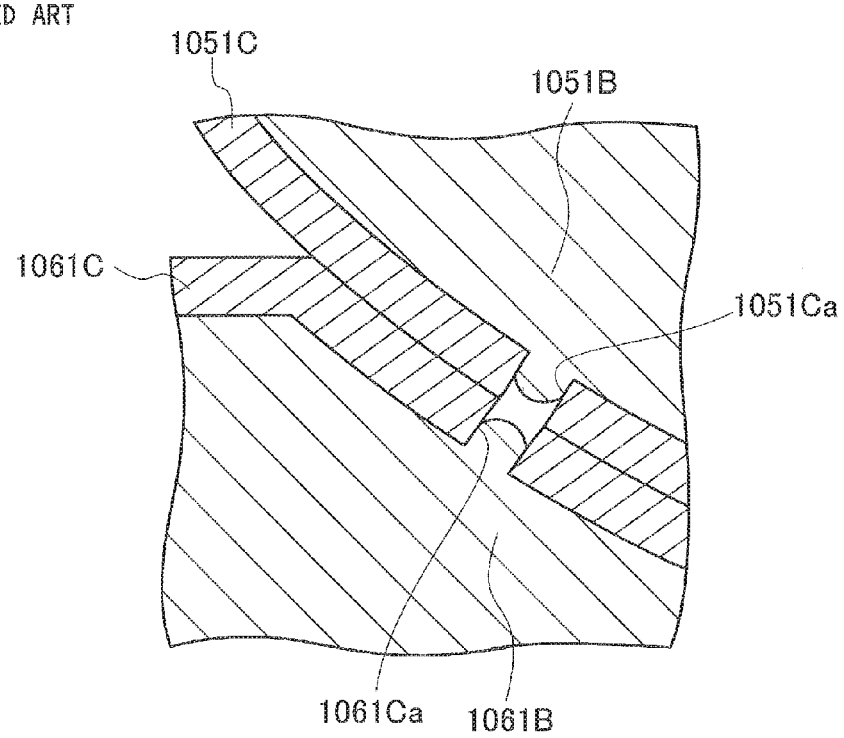
FIG. 5B RELATED ART
FIG. 5B is an enlarged sectional view of a portion 1000*z* of FIG. 4.
Figure 6:
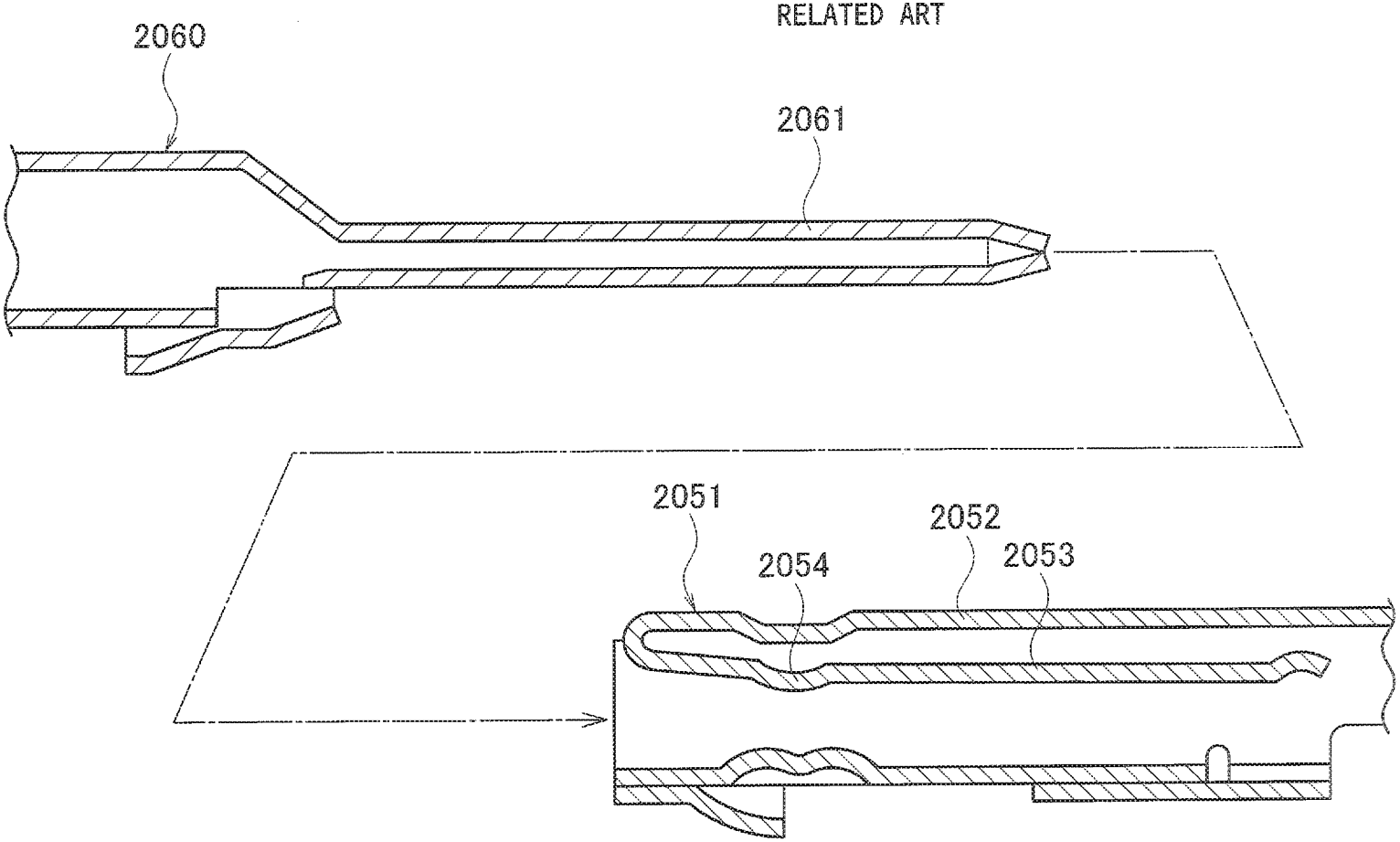
FIG. 6 RELATED ART
FIG. 6 is a sectional view of another female terminal and another male terminal before terminal connection according to the related art.
Figure 7:
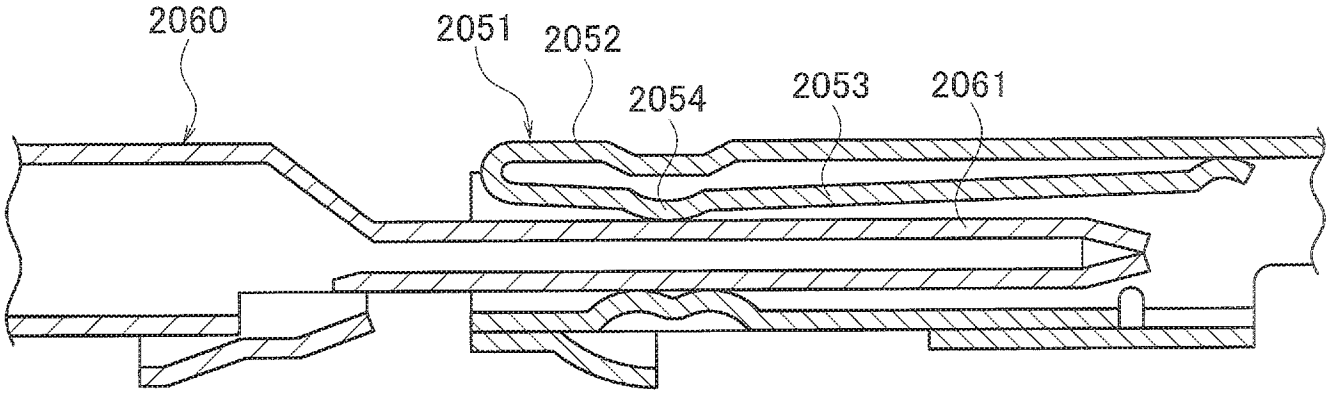
FIG. 7 RELATED ART
FIG. 7 is a sectional view of the female terminal and the male terminal in the terminal connection.
Figure 8A:
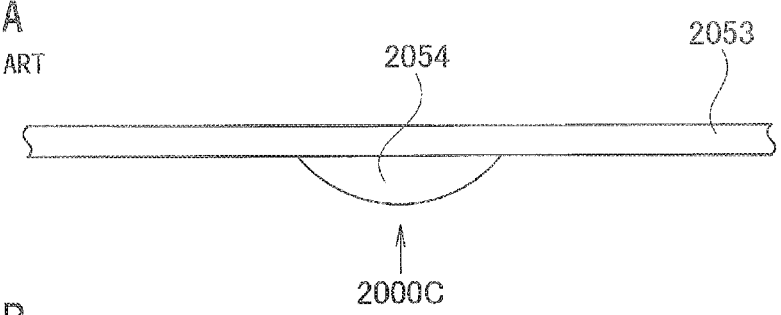
FIG. 8A RELATED ART
FIG. 8A is a side view of a main portion of a contact portion of the female terminal according to the related art.
Figure 8B:
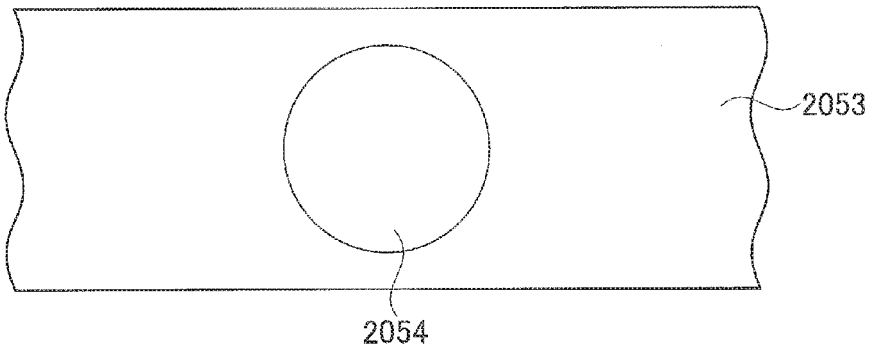
FIG. 8B RELATED ART
FIG. 8B is a view viewed along the arrow 2000C in FIG. 8A.
Figure 9A:
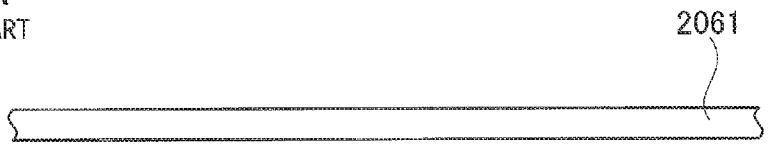
FIG. 9A RELATED ART
FIG. 9A is a side view of a main portion of a contact portion of the male terminal according to the related art.
Figure 9B:
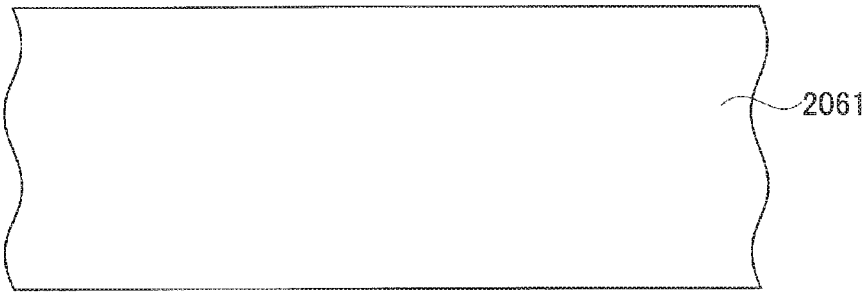
FIG. 9B RELATED ART
FIG. 9B is a plan view of the main portion of the contact portion of the male terminal according to the related art.
Figure 10:
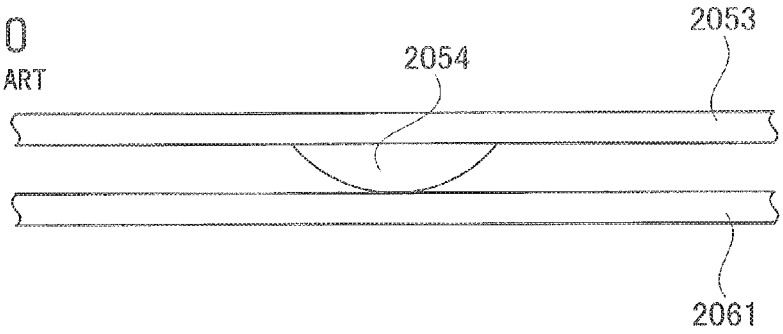
FIG. 10 RELATED ART
FIG. 10 is a side view of a main portion of a contact connection portion according to the related art.
Figure 11A:
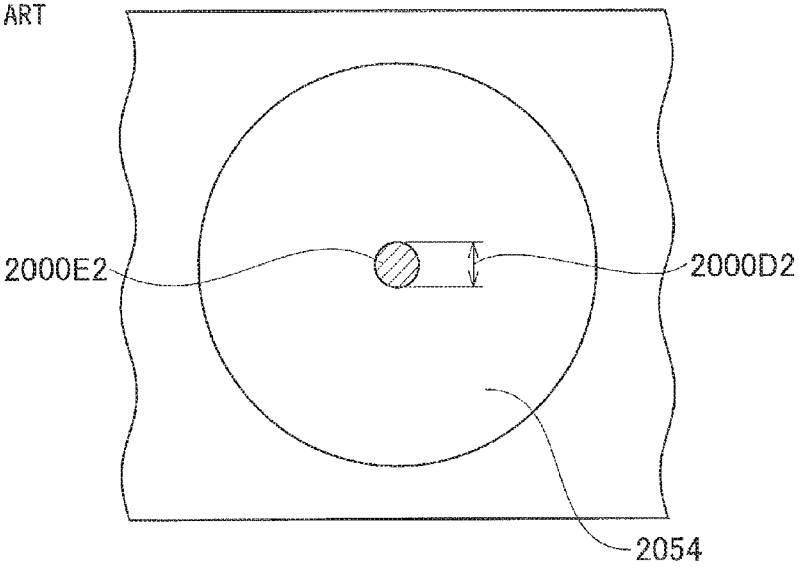
FIG. 11A RELATED ART
FIG. 11A is a view of an apparent contact surface according to the related art.
Figure 11B:
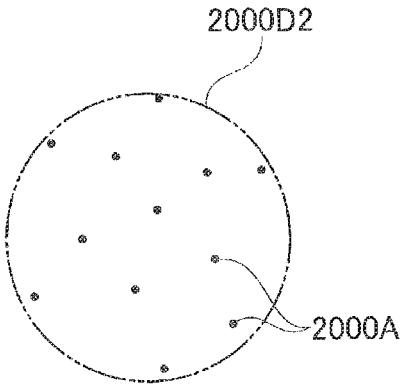
FIG. 11B RELATED ART
FIG. 11B is a view of actual contact surfaces according to the related art.
Figure 12:
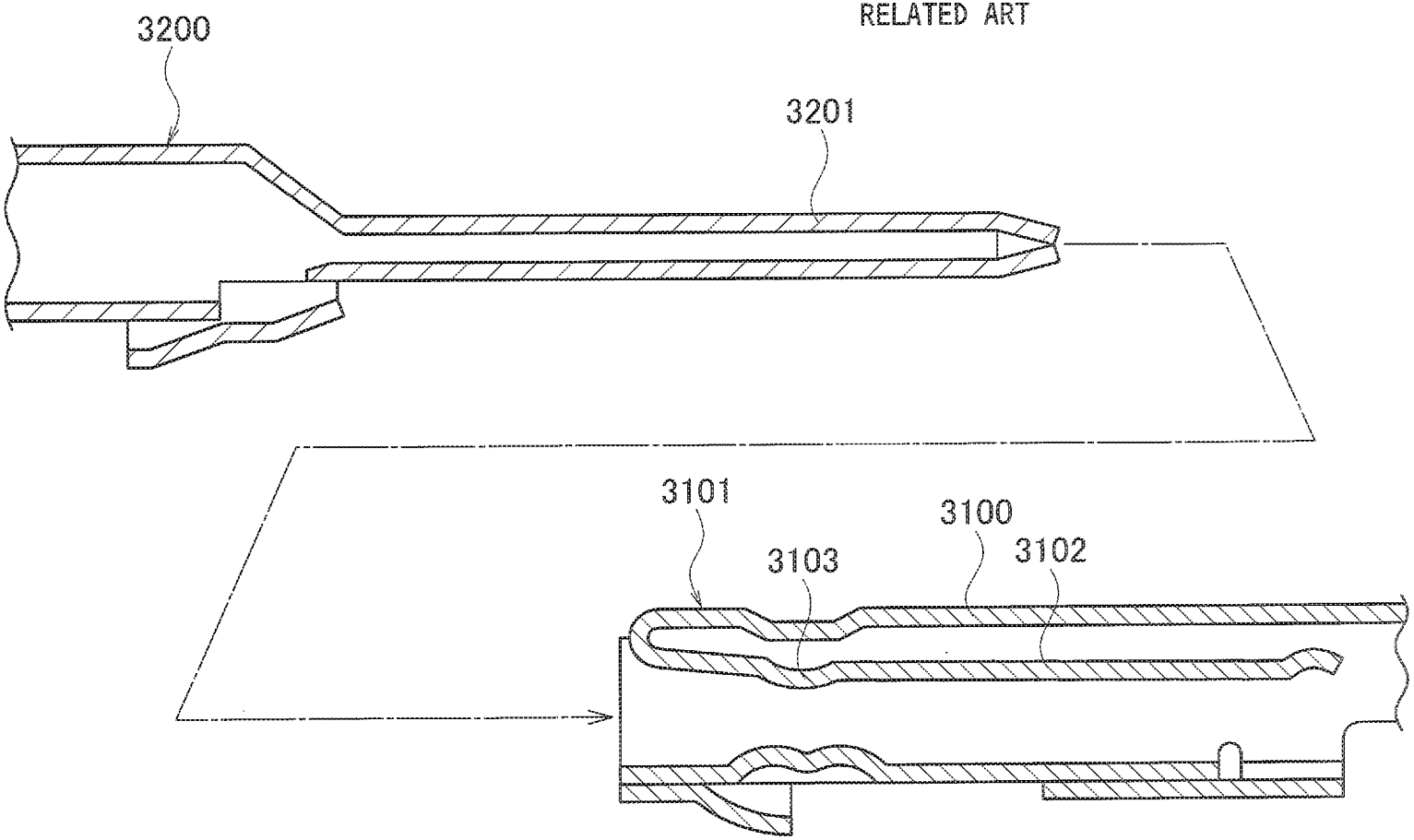
FIG. 12 RELATED ART
FIG. 12 is a sectional view of another female terminal and another male terminal before terminal connection according to the related art.
Figure 13:
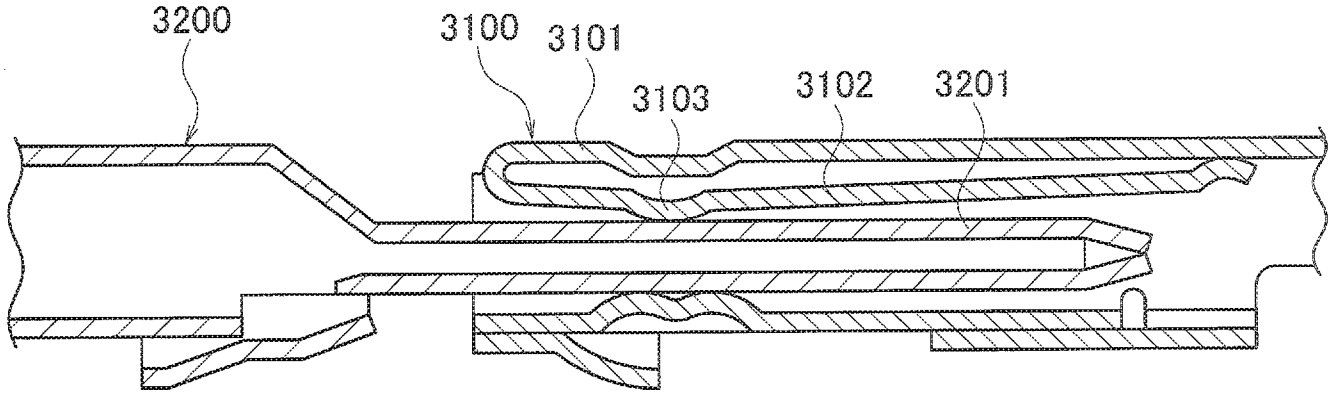
FIG. 13 RELATED ART
FIG. 13 is a sectional view of the female terminal and the male terminal positioned at a terminal insertion completed position according to the related art.
Figure 14:
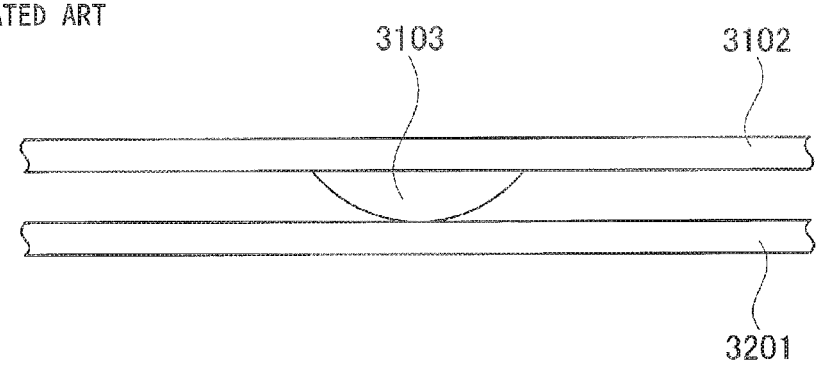
FIG. 14 RELATED ART
FIG. 14 is an enlarged view of a contact connection main portion of the female terminal and the male terminal according to the related art.
Figure 15:
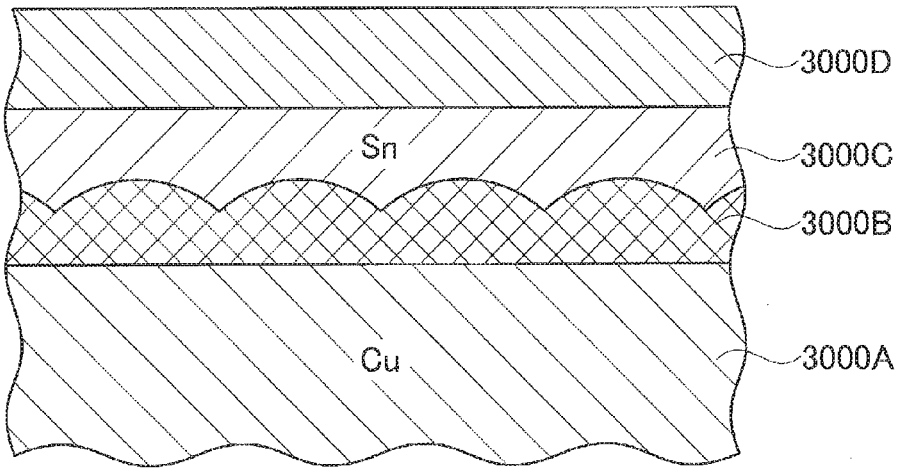
FIG. 15 RELATED ART
FIG. 15 is a schematic view of a plating layer of the terminals.
Figure 16:
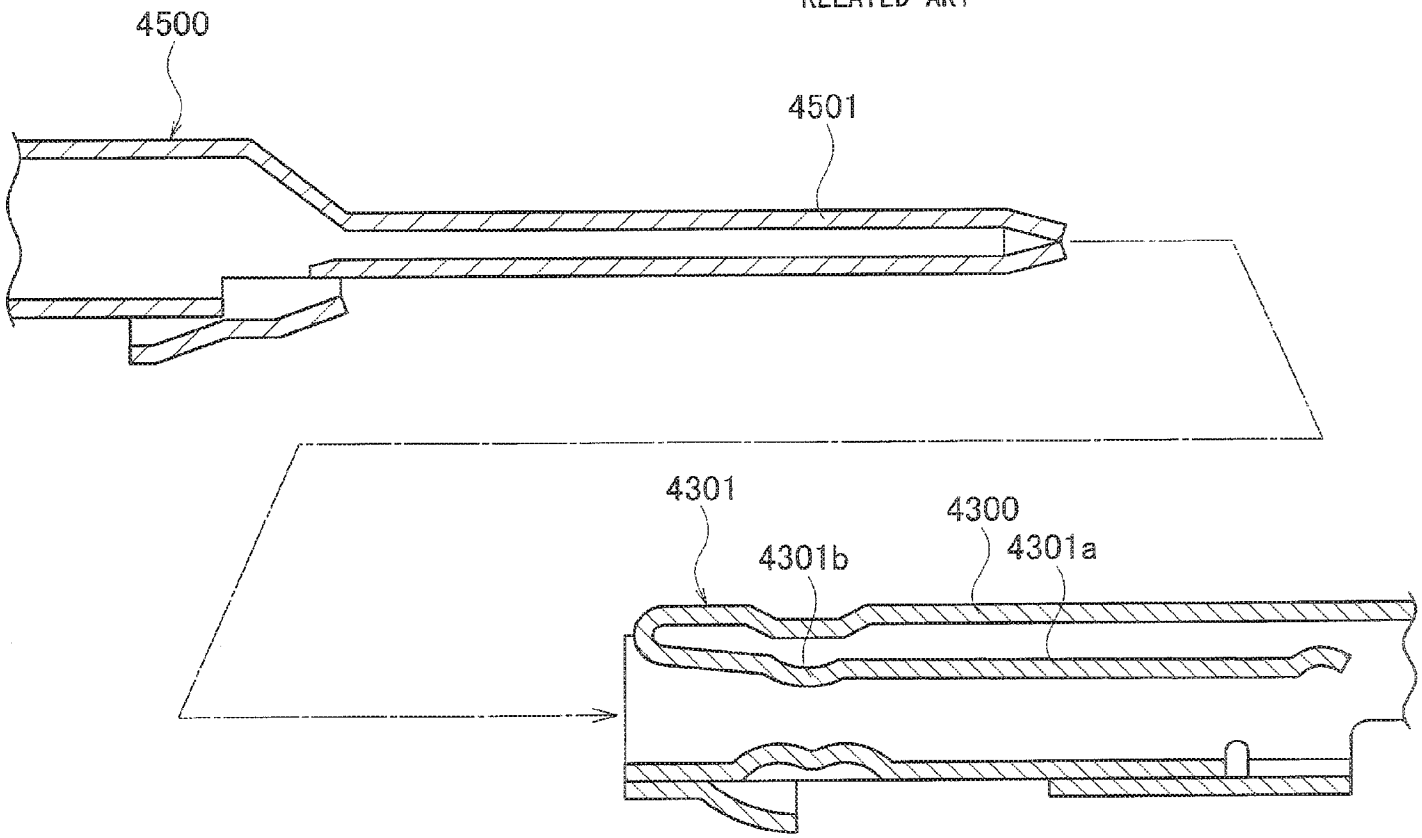
FIG. 16 RELATED ART
FIG. 16 is a sectional view of another female terminal and another male terminal before terminal insertion according to the related art.
Figure 17:
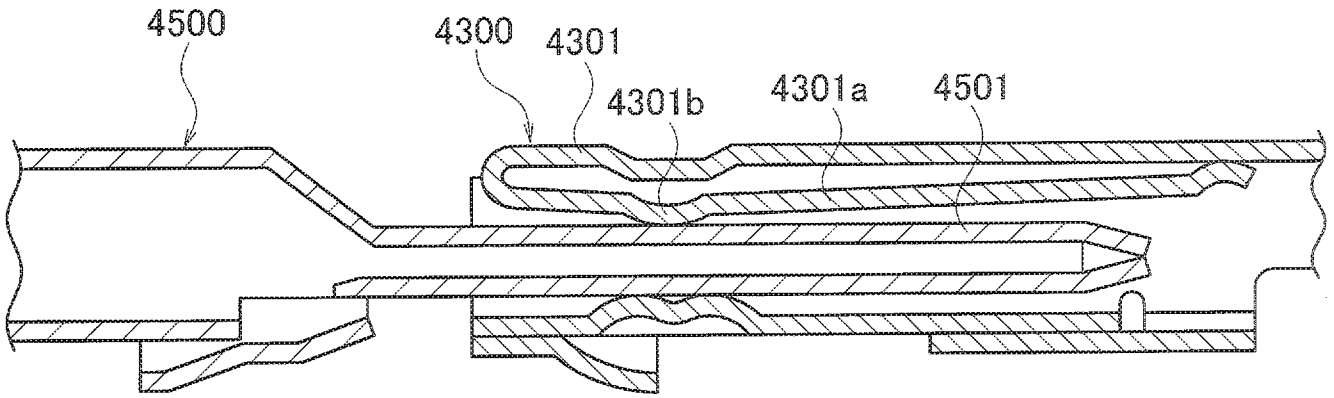
FIG. 17 RELATED ART
FIG. 17 is a sectional view of the female terminal and the male terminal positioned at a terminal insertion completed position according to the related art.
Figure 18:
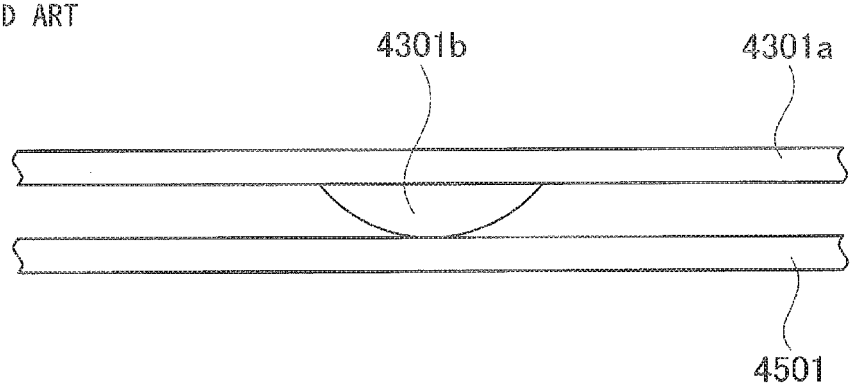
FIG. 18 RELATED ART
FIG. 18 is an enlarged view of a contact connection main portion of the female terminal and the male terminal according to the related art.
Figure 19:
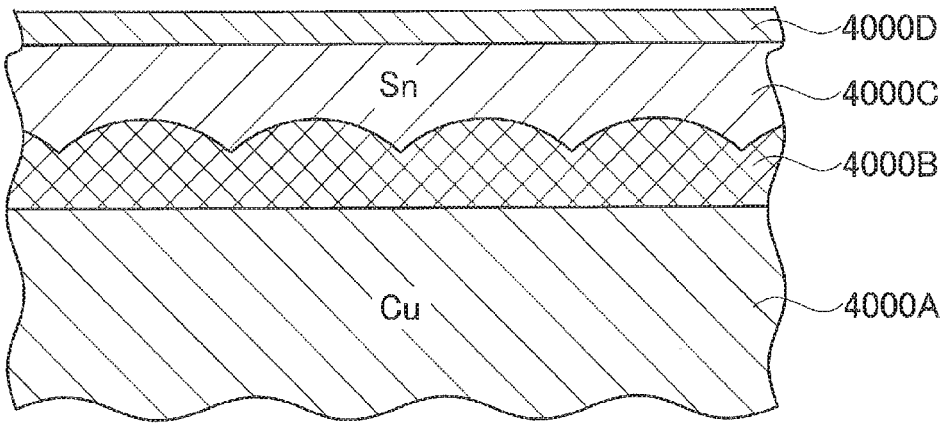
FIG. 19 RELATED ART
FIG. 19 is a schematic view of a plating layer of the terminals
Figure 20:
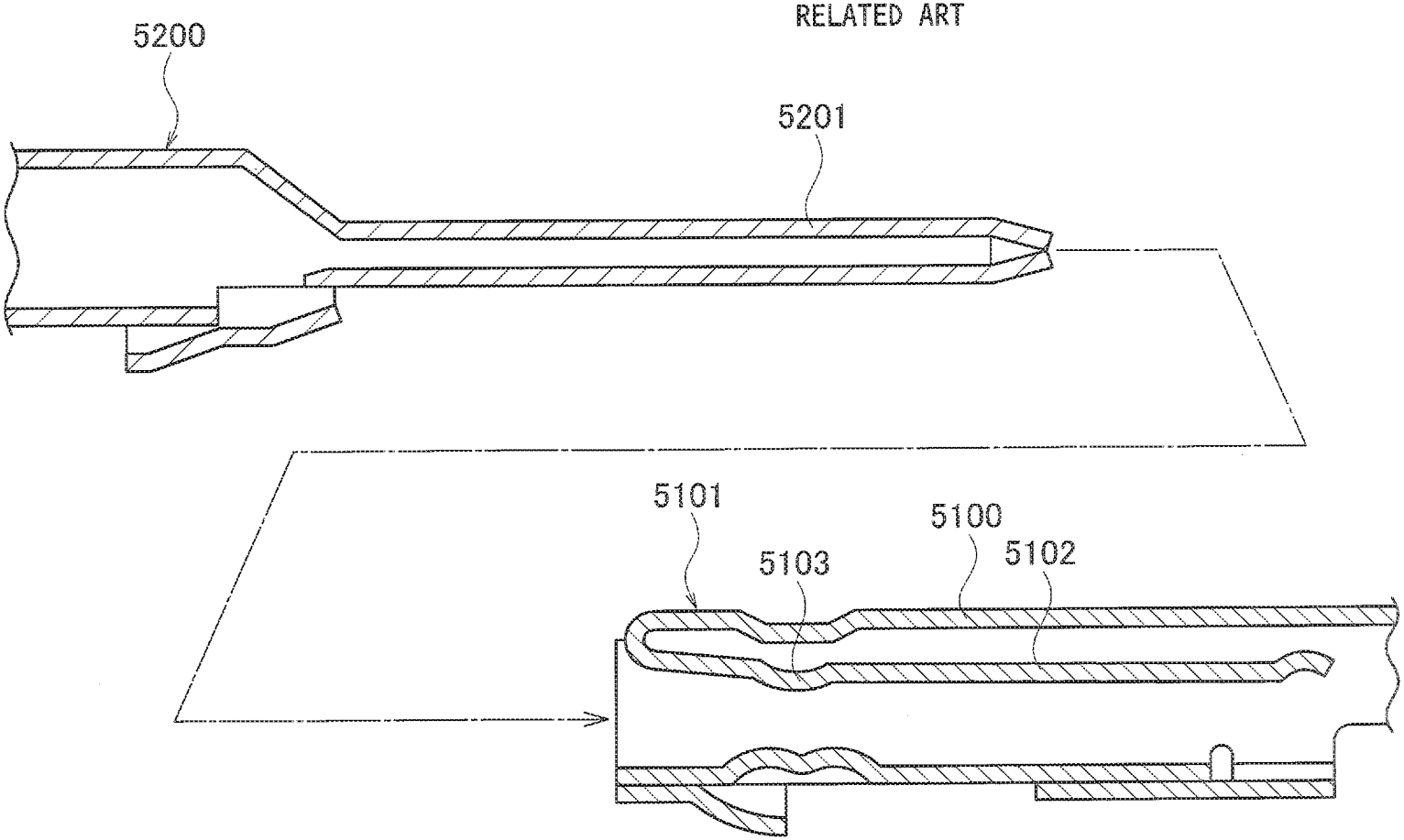
FIG. 20 RELATED ART
FIG. 20 is a sectional view of another female terminal and another male terminal before terminal insertion according to the related art.
Figure 21:
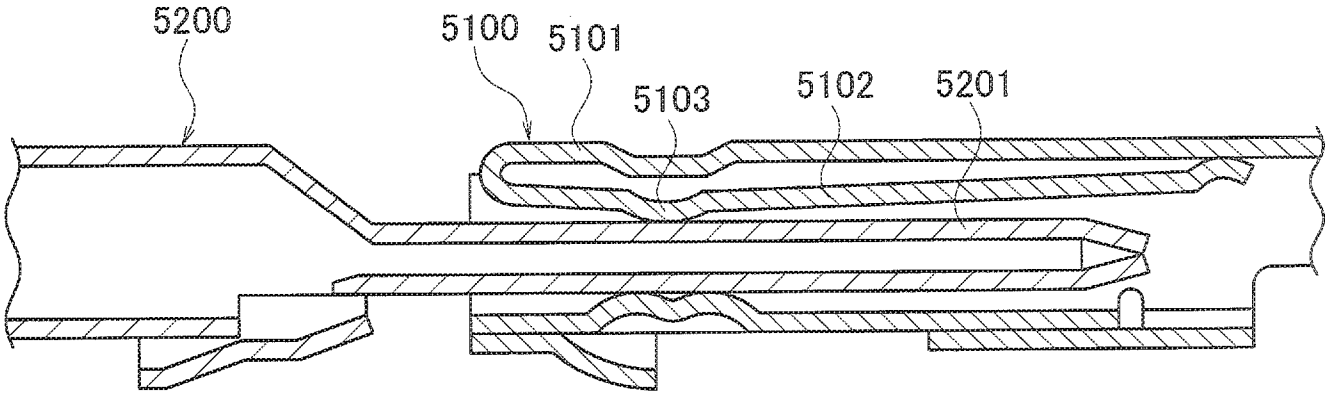
FIG. 21 RELATED ART
FIG. 21 is a sectional view of the female terminal and the male terminal positioned at a terminal insertion completed position according to the related art.
Figure 22:
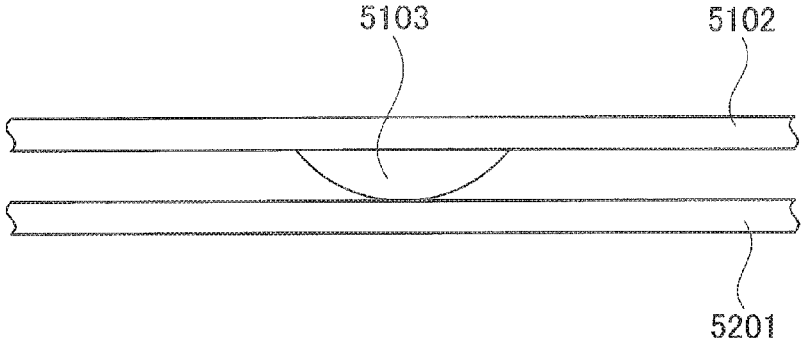
FIG. 22 RELATED ART
FIG. 22 is an enlarged view of a contact connection main portion of the female terminal and the male terminal according to the related art.

Note that, tin plating treatment is performed over entire regions of outer surfaces of the elastic bend portion 431*a* and the tab portion 451. A copper/tin alloy layer 400B (equivalent to 4000B in FIG. 19) and a tin plating layer 400C (equivalent to 4000C in FIG. 19) are formed on the side of an outer surface of each copper-alloy-made base material layer 400A (equivalent to 4000A in FIG. 19). In addition, an oxide layer 400D (equivalent to 4000D in FIG. 19) is generated on an outer surface of the tin plating layer 400C.

The oxide layers 400D have electric resistivity considerably higher than that of tin or copper. Thus, even when the oxide films 400D come in contact with each other, favorable electric connection cannot be acquired.

Therefore, typically, the contact load between the indent portion 431*b* and the contact surface of the tab portion 451 destroys the oxide films 400D. At portions at which the oxide films 400D have been destroyed, pieces of plating metal of the indent portion 431*b* and the tab portion 451 come in contact with each other so that more favorable electric connection is acquired.

In this case, the destruction of the oxide films 400D is preferably made so as to be able to be further accelerated.

Thus, according to the seventh embodiment, the destruction of the oxide films 400D is made so as to be able to be accelerated.

Specifically, before the terminal insertion, shot peening processing is performed to one oxide film 400D formed on at least one region of the oxide film 400D formed on a surface of the indent portion (the contact portion) 431*b* of the first contact portion 431 and the oxide film 400D formed on a surface of a region of the second contact portion 451 with which the indent portion (the contact portion) 431*b* comes in contact at the terminal insertion completed position.

Figure 62:
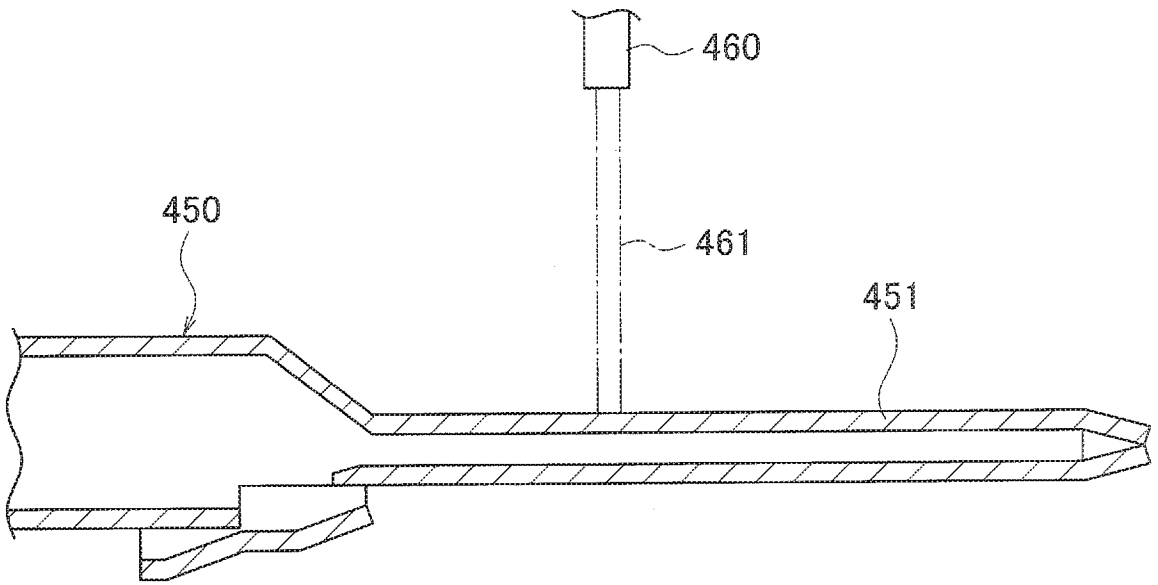
FIG. 62 is an explanatory view for describing a state where shot peening processing is performed before the female terminal and the male terminal engage with each other according to the seventh embodiment.

A known method can be used for the shot peening processing. For example, as illustrated in FIG. 62, a projecting nozzle 460 can jet shot grains (steel balls having a predetermined grain diameter) 461 to the above portion of the first contact portion 431 and the second contact portion 451. Note that, in FIG. 62, the oxide film 400D to which the shot preening processing has been performed, is exemplified, the oxide film 400D being formed on the surface of the region of the second contact portion 451 with which the indent portion (the contact portion) 431*b* comes in contact at the terminal insertion completed position.

Accordingly, mechanical damage is given to the one oxide film 400D formed on the at least one region of the oxide film 400D formed on the surface of the indent portion (the contact portion) 431*b* of the first contact portion 431 and the oxide film 400D formed on the surface of the region of the second contact portion 451 with which the indent portion (the contact portion) 431*b* comes in contact at the terminal insertion completed position.

Note that, before the terminal insertion, the shot peening processing may be performed to both of the oxide film 400D formed on the surface of the indent portion (the contact portion) 431*b* of the first contact portion 431 and the oxide film 400D formed on the surface of the region of the second contact portion 451 with which the indent portion (the contact portion) 431*b* comes in contact at the terminal insertion completed position. Accordingly, the destruction of the oxide films 400D can be further accelerated.

In a case where the shot peening processing is performed to the oxide film 400D formed on the surface of the indent portion (the contact portion) 431*b* of the first contact portion 431, the shot peening processing is performed to at least the surface of the indent portion (the contact portion) 431*b* of the first contact portion 431, and this range is not limited. That is, in a case where the shot peening processing is performed to the oxide film 400D formed on the surface of the indent portion (the contact portion) 431*b* of the first contact portion 431, the shot peening processing can be performed over a wide range including the indent portion (the contact portion) 431*b*.

Similarly, in a case where the shot peening processing is performed to the oxide film 400D formed on the surface of the region of the second contact portion 451 with which the indent portion (the contact portion) 431*b* comes in contact at the terminal insertion completed position, the shot peening processing is performed to at least the surface of the region of the second contact portion 451 with which the indent portion (the contact portion) 431*b* comes in contact at the terminal insertion completed position, and this range is not limited. That is, in a case where the shot peening processing is performed to the oxide film 400D formed on the surface of the region of the second contact portion 451 with which the indent portion (the contact portion) 431*b* comes in contact at the terminal insertion completed position, the shot peening processing can be performed over a wide range including the surface of the region of the second contact portion 451 with which the indent portion (the contact portion) 431*b* comes in contact at the terminal insertion completed position.

Next, an exemplary state where the female terminal 430 and the male terminal 450 are electrically coupled to each other, will be described.

First, the tab portion 451 of the male terminal 450 is inserted into the side of the opening of the box portion 431 of the female terminal 430. In this case, the tab portion 451 inserted into the opening of the box portion 431 is to be inserted between the indent portion 431*b* and the base portion 431*c*. The tab portion 451 slides on the indent portion 431*b* and the base portion 431*c*. Then, the elastic bend portion 431*a* is thrust upward so as to bend and deform in a direction in which the indent portion 431*b* and the base portion 431*c* are alienated from each other.

When the tab portion 451 is further inserted into the female terminal 430, the tab portion 451 reaches the terminal insertion completed position illustrated in FIG. 61.

In this manner, in a state where the tab portion 451 has been inserted to the terminal insertion completed position, the bend restoring force occurs at the elastic bend portion 431*a*. The contact load acts between the indent portion 431*b* and the contact surface of the tab portion 451 due to the bend restoring force.

The oxide films 400D are destroyed by the contact load between the indent portion 431*b* and the contact surface of the tab portion 451. At the portions at which the oxide films 400D have been destroyed, the contact between the pieces of plating metal of the indent portion 431*b* and the tab portion 451 is acquired. Thus, the female terminal 430 and the male terminal 450 are electrically coupled to each other.

In this case, according to the seventh embodiment, before the terminal insertion, the mechanical damage has been given to the oxide film 400D formed on the surface of the indent portion (the contact portion) 431*b* of the first contact portion 431 and the oxide film 400D formed on the surface of the region of the second contact portion 451 with which the indent portion (the contact portion) 431*b* comes in contact at the terminal insertion completed position. Therefore, cracks easily occur in the oxide films 400D, and then the plating layers 400C easily enter from gaps of the oxide films 400D to the surfaces (refer to FIG. 63).

Figure 63:
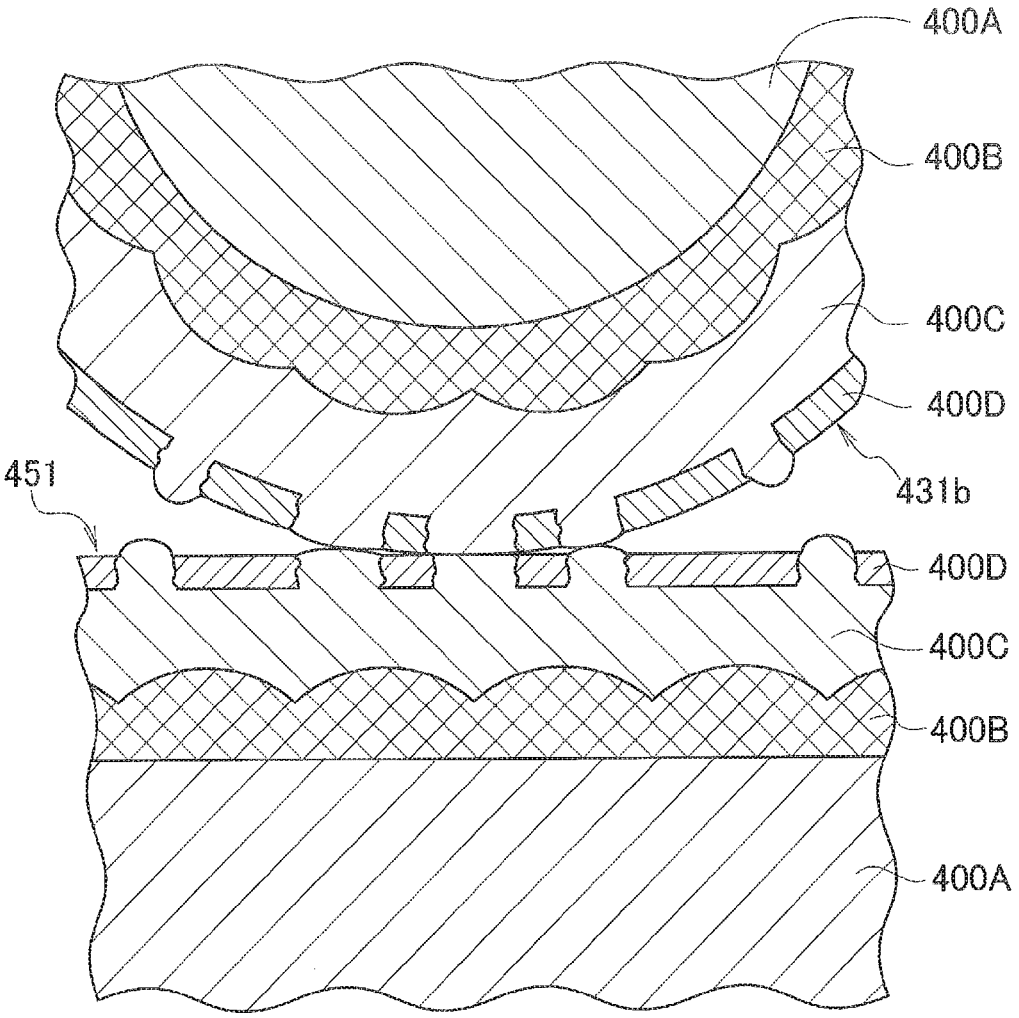
FIG. 63 is an explanatory view for describing a state where oxide films of the female terminal and the male terminal are destroyed and pieces of plating metal come in contact with each other according to the seventh embodiment.

In this manner, since the plating layers 400C easily enter from the gaps of the oxide films 400D to the surfaces, as illustrated in FIG. 63, a contact area between the plating layers 400C (between the pieces of plating metal of the indent portion 431*b* and the tab portion 451) can further increase, and then further favorable electric connection can be acquired.

As described above, a contact connection method according to the seventh embodiment includes a step of performing the shot peening processing to the one oxide film 400D formed on the at least one region of the oxide film 400D formed on the surface of the indent portion (the contact portion) 431*b* of the first contact portion 431 and the oxide film 400D formed on the surface of the region of the second contact portion 451 with which the indent portion (the contact portion) 431*b* comes in contact at the terminal insertion completed position, before the terminal insertion.

Accordingly, mechanical damage is given to the one oxide film 400D formed on the at least one region of the oxide film 400D formed on the surface of the indent portion (the contact portion) 431*b* of the first contact portion 431 and the oxide film 400D formed on the surface of the region of the second contact portion 451 with which the indent portion (the contact portion) 431*b* comes in contact at the terminal insertion completed position.

In this state, the tab portion 451 is made to be inserted into the female terminal 430 (the male terminal 450 and the female terminal 430 are made so as to engage with each other). Thus, the cracks easily occur in the oxide films 400D and then the plating layers 400C easily enter from the gaps of the oxide films 400D to the surfaces.

As a result, the contact area between the plating layers 400C (between the pieces of plating metal of the indent portion 431*b* and the tab portion 451) can further increase, and then the further favorable electric connection can be acquired.

The contact connection structure capable of reducing contact resistance without the terminals increased in size and complicated, can be acquired by using this type of contact connection method. In particular, according to the seventh embodiment, even when the contact pressure between the contact portions decreases, the oxide films 400D can be destroyed so that miniaturization of the terminals can be easily performed.

The embodiments of the present invention have been described above. The present invention is not limited to the above embodiments, and various modifications can be applied.

For example, according to the seventh embodiment, the tin plating layers that are formed on the surfaces of the elastic bend portion 431*a* and the tab portion 451, have been exemplified. Plating layers on which an oxide film is formed, may be formed, except tin. In this case, a function and an effect the same as those according to the seventh embodiment can be acquired.

The shot peening processing may be performed to the oxide films 400D formed on regions other than the above regions.

The first contact portion 431 including no indent portion 431*b* provided thereto, can be made.

As described above, in the contact connection method, the first contact portion having the elastic bend portion and the plating layer formed on the surface thereof, and the second contact portion including the plating layer formed on the surface thereof, are provided. The elastic bend portion of the first contact portion slides on the contact surface of the second contact portion. At the terminal insertion completed position, the contact portion being at least the part of the elastic bend portion thrusts the second contact portion and comes in contact. The contact connection method includes the step of performing the shot peening processing to the one oxide film formed on the at least one region of the oxide film formed on the surface of the contact surface of the first contact portion and the oxide film formed on the surface of the region of the second contact portion with which the contact portion comes in contact at the terminal insertion completed position, before the terminal insertion.

The contact connection structure is coupled by using the above contact connection method.

According to the above configuration, the contact connection method and the contact connection structure that can reduce the contact resistance without the terminals increased in size and the structure complicated as much as possible, can be acquired.

Eighth Embodiment

An eighth embodiment of the present invention will be described in detail below with reference to FIGS. 64 to 70.

Figure 64:
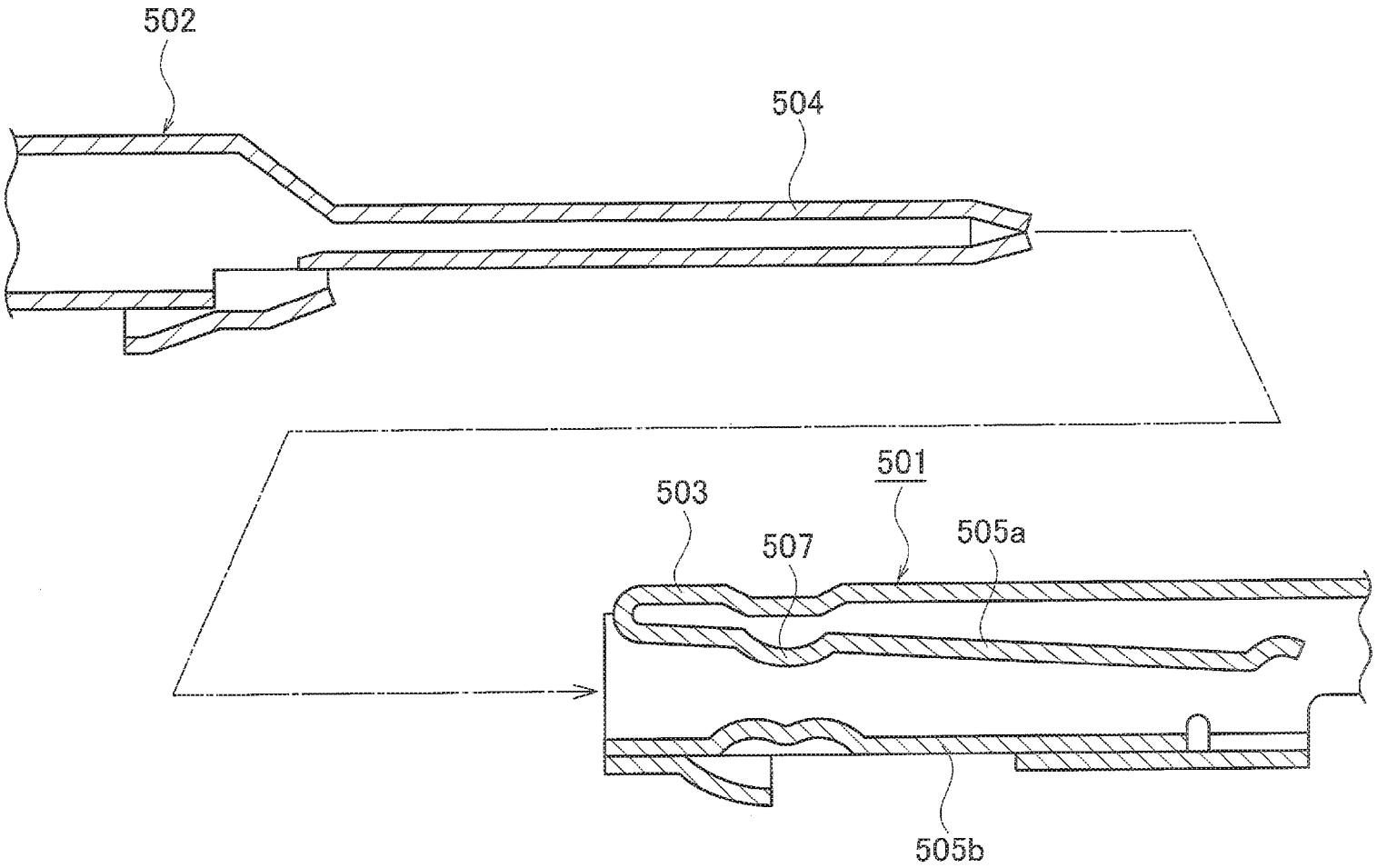
FIG. 64 is a sectional view of a female terminal and a male terminal before terminal insertion according to an eighth embodiment.

As illustrated in FIG. 64, terminals using a terminal connection structure according to the eighth embodiment include a female terminal 501 and a male terminal 502. The female terminal 501 is arranged in a terminal housing space in a female-side connector housing not illustrated.

The female terminal 501 includes a surface thereof plated with tin, and a box portion 503 as a first contact portion.

The box portion 503 includes an opening on the front side thereof, and is formed so as to be quadrangular. The box portion 503 includes an elastic bend portion 505*a* and a base portion 505*b*. The elastic bend portion 505*a* is formed by bending an upper surface of the box portion 503 inward. The base portion 505*b* is provided so as to protrude from a lower surface to the upper surface.

The elastic bend portion 505*a* has elasticity and is formed so as to incline from the upper surface to the lower surface of the box portion 503. An indent portion 507 protruding toward the side of a base is formed on a surface of the elastic bend portion 505*a*.

The indent portion 507 spherically protrudes from the elastic bend portion 505*a*, and includes a center position positioned at the spherical lowest place. The indent portion 507 is formed on the elastic bend portion 505*a* so as to be displaceable in an upper and lower direction.

The base portion 505*b* is formed at a position at which substantially facing the indent portion 507 with a predetermined interval. The male terminal 502 is inserted between the base portion 505*b* and the indent portion 507.

The male terminal 502 includes a surface thereof plated with tin, and a tab portion 504 as a second contact portion.

A leading end of the tab portion 504 is inserted between the base portion 505*b* and the indent portion 507 of the female terminal 501.

Figure 23:
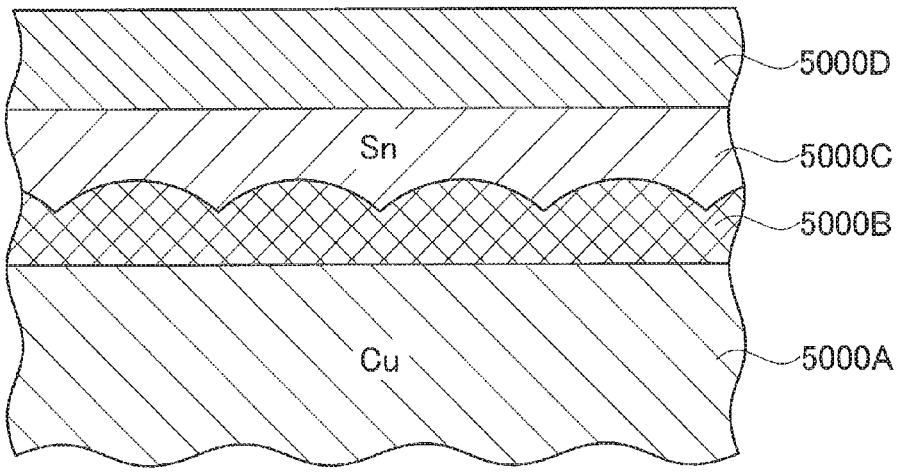
FIG. 23 RELATED ART
FIG. 23 is a schematic view of a plating layer of the terminals.
Figure 24:
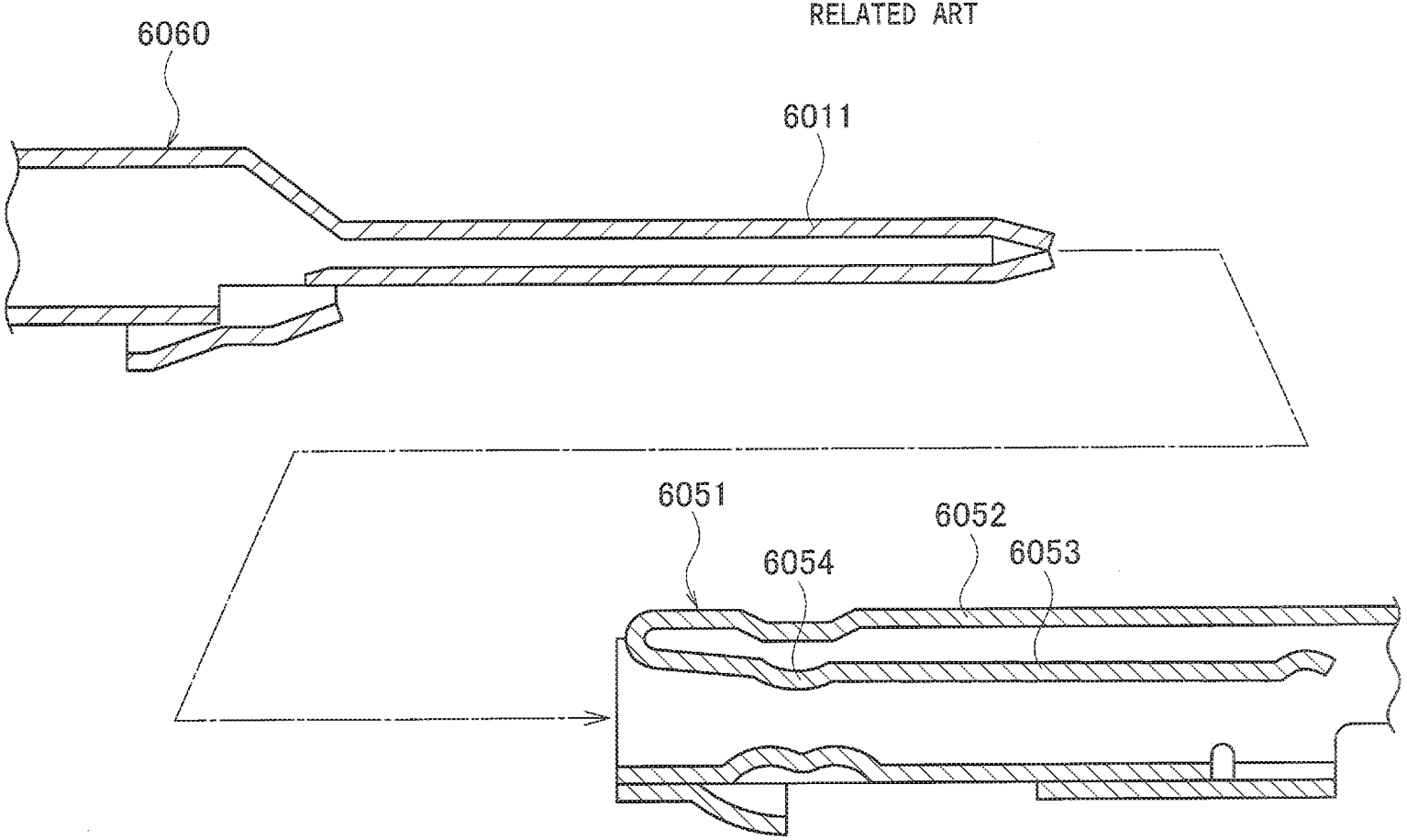
FIG. 24 RELATED ART
FIG. 24 is a sectional view of another female terminal and another male terminal before terminal connection according to the related art.
Figure 25:
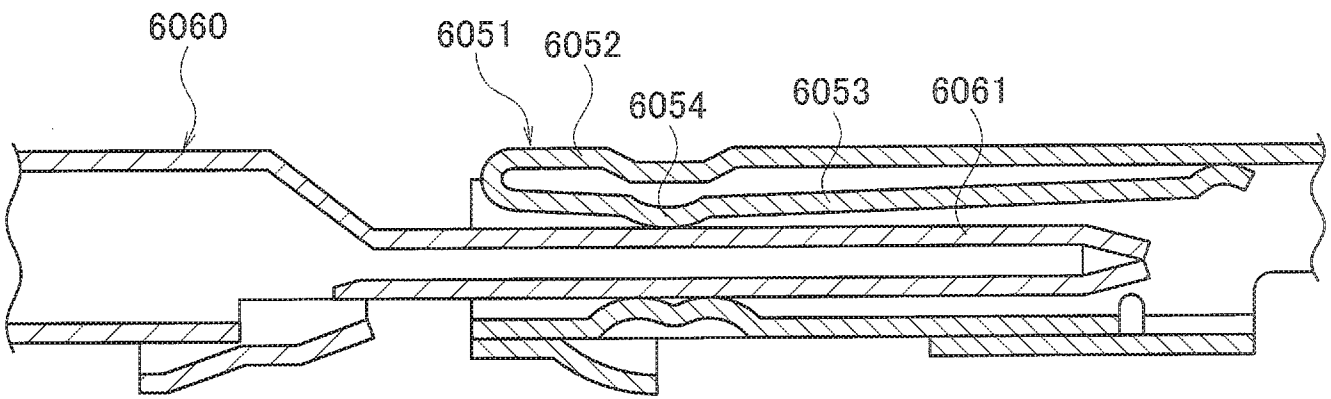
FIG. 25 RELATED ART
FIG. 25 is a sectional view of the female terminal and the male terminal in the terminal connection according to the related art.
Figure 26A:
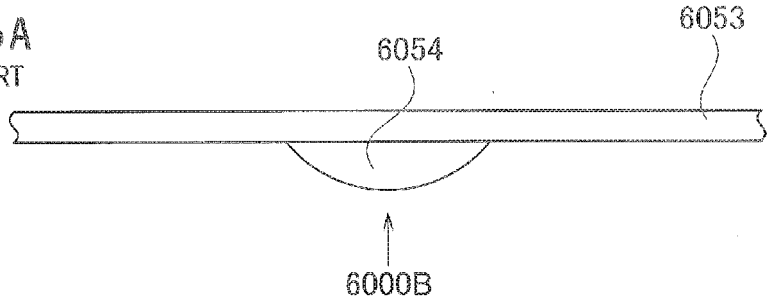
FIG. 26A RELATED ART
FIG. 26A is a sectional view of a main portion of an elastic bend portion of the female terminal according to the related art.
Figure 26B:
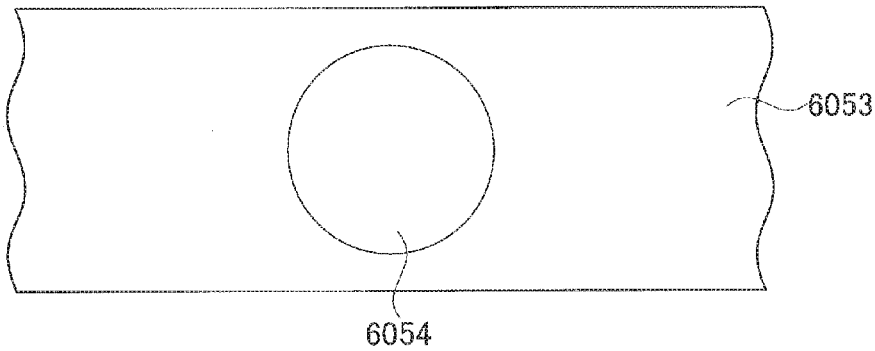
FIG. 26B RELATED ART
FIG. 26B is a view viewed along the arrow 6000B in FIG. 26A.
Figure 27A:
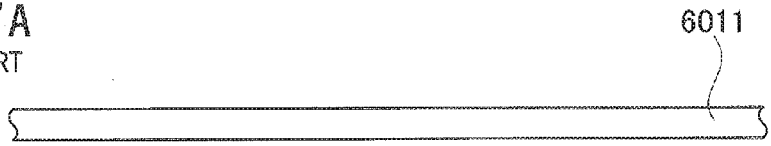
FIG. 27A RELATED ART
FIG. 27A is a side view of a main portion of a tab portion of the male terminal according to the related art.
Figure 27B:
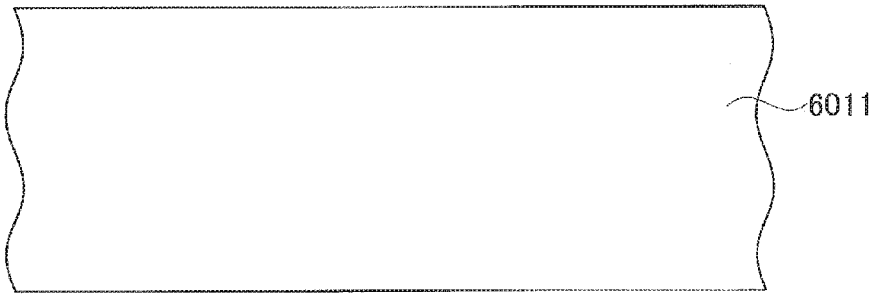
FIG. 27B RELATED ART
FIG. 27B is a plan view of the main portion of the tab portion of the male terminal according to the related art.
Figure 28:
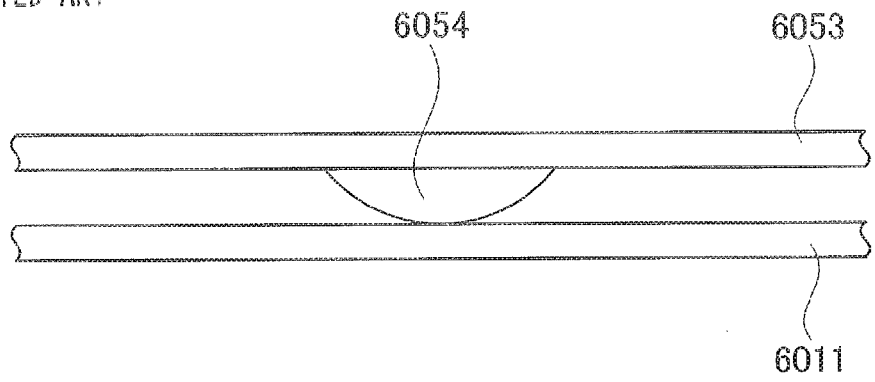
FIG. 28 RELATED ART
FIG. 28 is a side view of a main portion of a contact connection portion according to the related art.
Figure 29:
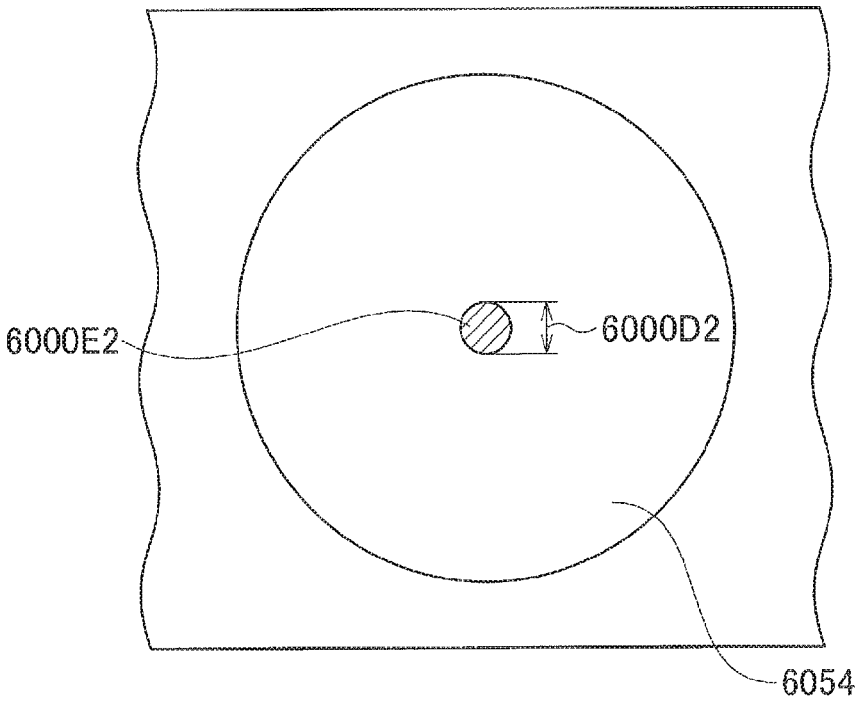
FIG. 29 RELATED ART
FIG. 29 is a view of an apparent contact surface diameter according to the related art.
Figure 30:
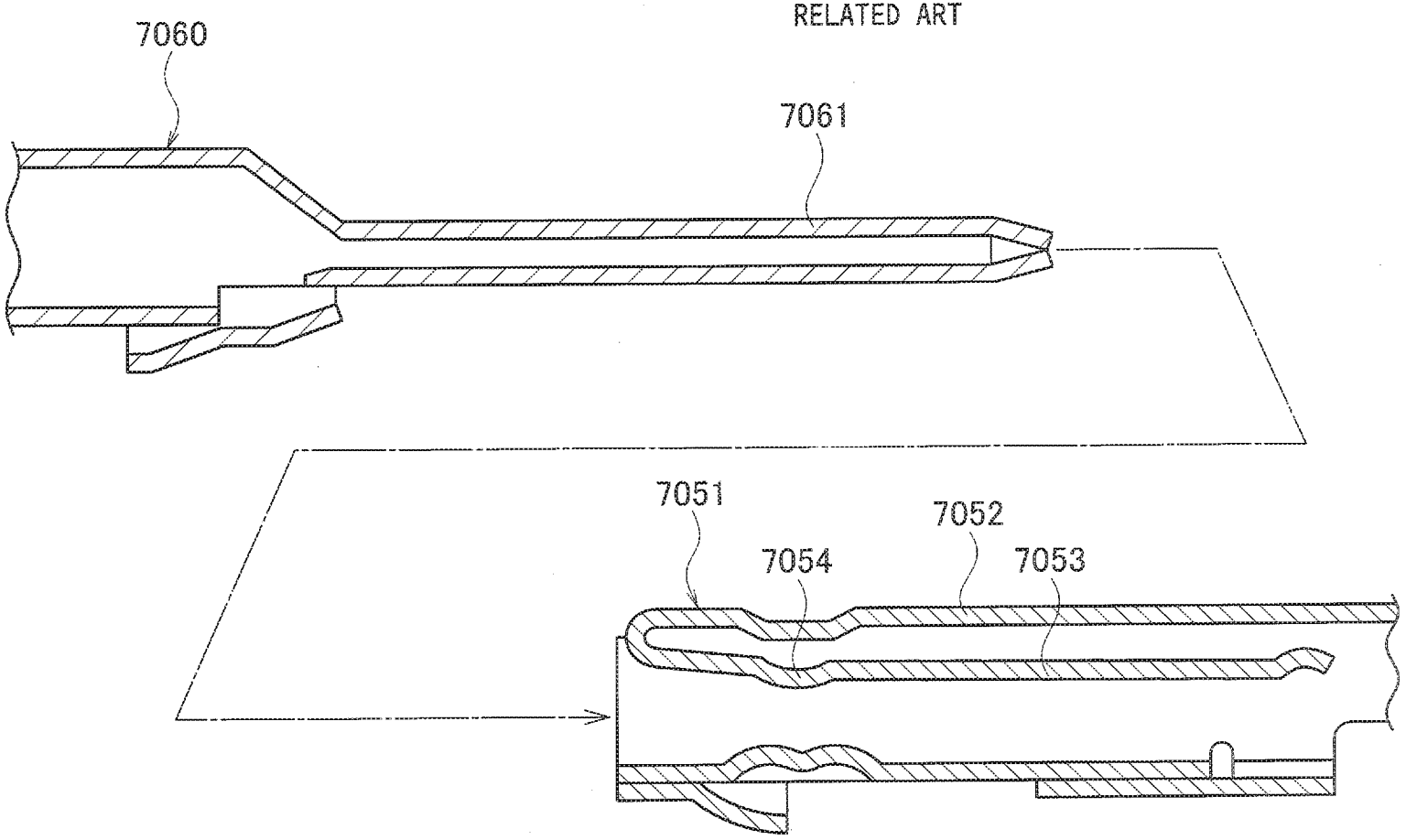
FIG. 30 RELATED ART
FIG. 30 is a sectional view of another female terminal and another male terminal before terminal connection according to the related art.
Figure 31:
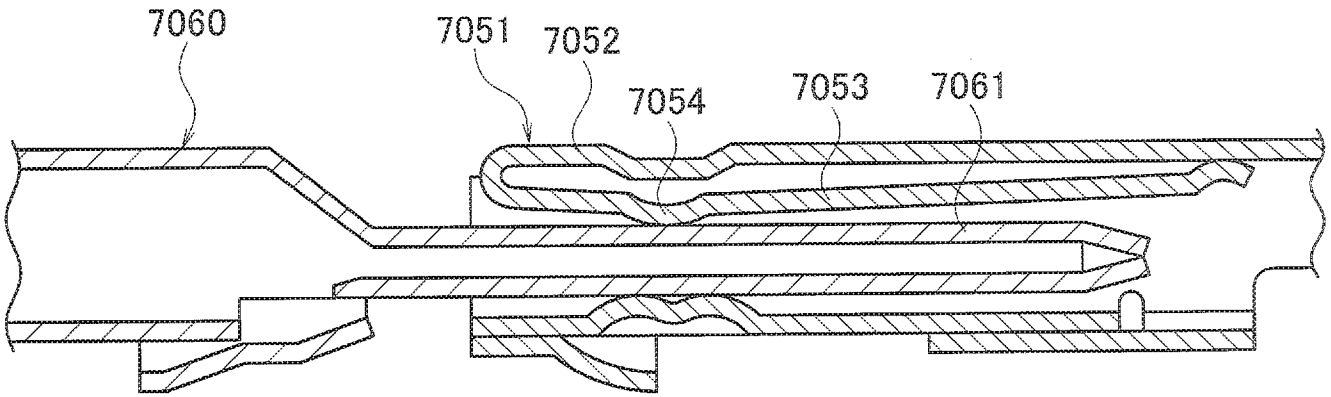
FIG. 31 RELATED ART
FIG. 31 is a sectional view of the female terminal and the male terminal in the terminal connection according to the related art.
Figure 32A:
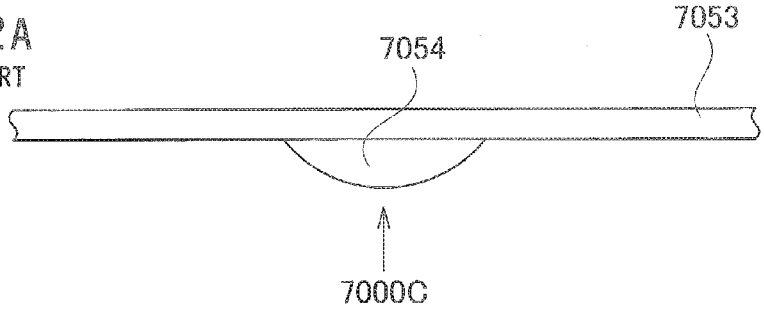
FIG. 32A RELATED ART
FIG. 32A is a side view of a main portion of a contact portion of the female terminal according to the related art.
Figure 32B:
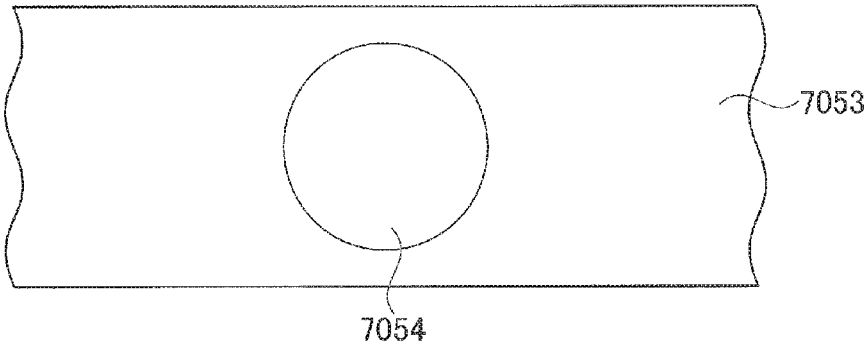
FIG. 32B RELATED ART
FIG. 32B is a view viewed along the arrow 7000C in FIG. 32A.
Figure 33A:
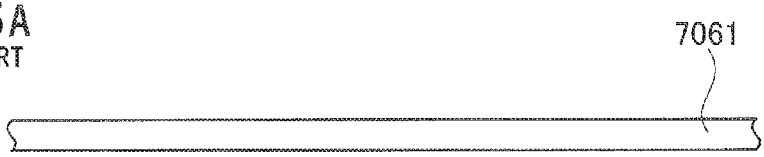
FIG. 33A RELATED ART
FIG. 33A is a sectional view of a main portion of a contact portion of the male terminal according to the related art.
Figure 33B:
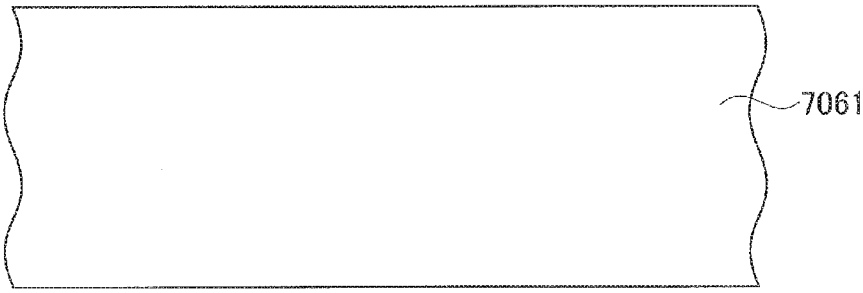
FIG. 33B RELATED ART
FIG. 33B is a plan view of the main portion of the contact portion of the male terminal according to the related art.
Figure 34:
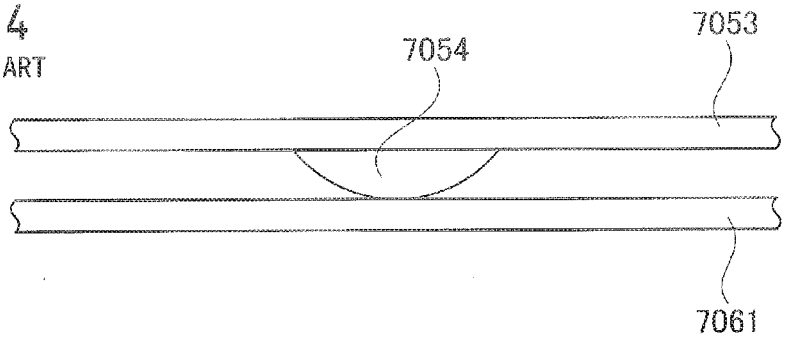
FIG. 34 RELATED ART
FIG. 34 is a side view of a main portion of a contact connection portion according to the related art.
Figure 35A:
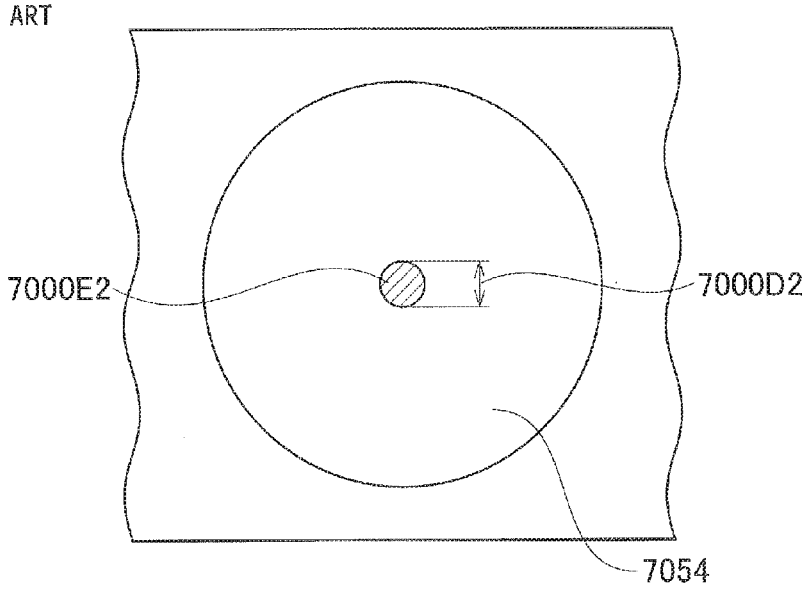
FIG. 35A RELATED ART
FIG. 35A is a view of an apparent contact surface according to the related art.
Figure 35B:
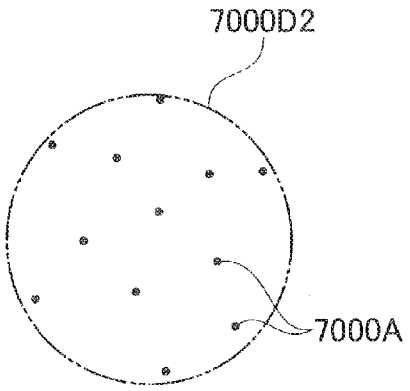
FIG. 35B RELATED ART
FIG. 35B is a view of actual contact surfaces according to the related art.

Note that, tin plating treatment is performed over entire regions of outer surfaces of the elastic bend portion 505*a* and the tab portion 504. A copper/tin alloy layer 500B (equivalent to 5000B in FIG. 23) and a tin plating payer 500C (equivalent to 5000C in FIG. 23) are formed on the side of an outer surface of each copper-alloy-made base material layer 500A (equivalent to 5000A in FIG. 23). In addition, an oxide film 500D (equivalent to 5000D in FIG. 23) is generated on an outer surface of the tin plating layer 500C.

The oxide films 500D have electric resistivity considerably higher than that of tin or copper. Thus, even when the oxide films 500D come in contact with each other, favorable electric connection cannot be acquired.

Therefore, typically, a contact load between the indent portion 507 and a contact surface of the tab portion 504 destroys the oxide films 500D. At portions at which the oxide films 500D have been destroyed, pieces of plating metal of the indent portion 507 and the tab portion 504 come in contact with each other so that more favorable electric connection is acquired.

In this case, the destruction of the oxide films 500D is preferably made so as to be able to be further accelerated.

Thus, according to the eighth embodiment, the destruction of the oxide films 500D is made so as to be able to be accelerated.

Specifically, protruding portions (at least one type of recess portions and the protruding portions) 507*a* are formed on the indent portion 507.

In this manner, forming the protruding portions (at least one type of the recess portions and the protruding portions) 507*a* on the indent portion 507 can apply partial pressure between the indent portion 507 and the contact surface of the tab portion 504 by the recess portions or the protruding portions 507*a* when the contact load acts between the indent portion 507 and the contact surface of the tab portion 504.

The present inventors grasp that the oxide films 500D concentrically or radially crack at a plurality of portions when the load acts between the indent portion 507 and the contact surface of the tab portion 504, by visualization.

Thus, the protruding portions (at least one type of the recess portions and the protruding portions) 507*a* to be formed on the indent portion 507 are arranged in at least one state of a radial state and a concentric state. The oxide films 500D are further accelerated so as to crack concentrically or radially.

Figure 68:
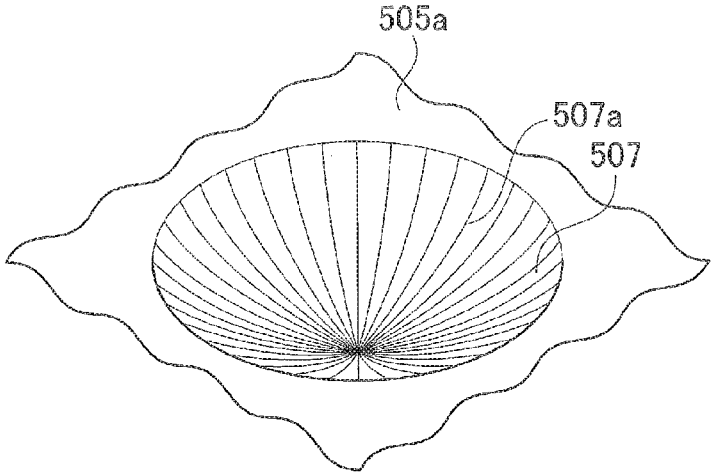
FIG. 68 is a schematic and perspective view of a protruding portion formed on the indent portion according to the eighth embodiment.

According to the eighth embodiment, as illustrated in FIG. 68, the plurality of protruding portions (at least one type of the recess portions and the protruding portions) 507*a* is linearly formed on a slope portion (a surface), and is radially formed as a whole.

Next, an exemplary state where the female terminal 501 and the male terminal 502 are electrically coupled to each other, will be described.

First, as illustrated in FIG. 64, the tab portion 504 of the male terminal 502 is inserted into the side of the opening of the box portion 503 of the female terminal 501. The tab portion 504 that has been inserted into the opening of the box portion 503, is inserted between the indent portion 507 and the base portion 505*b*. In this case, the tab portion 504 slides on the indent portion 507 and the base portion 505*b*. Then, the elastic bend portion 505*a* is thrust upward so as to bend and deform in a direction in which the indent portion 507 and the base portion 505*b* are alienated from each other.

Figure 65:
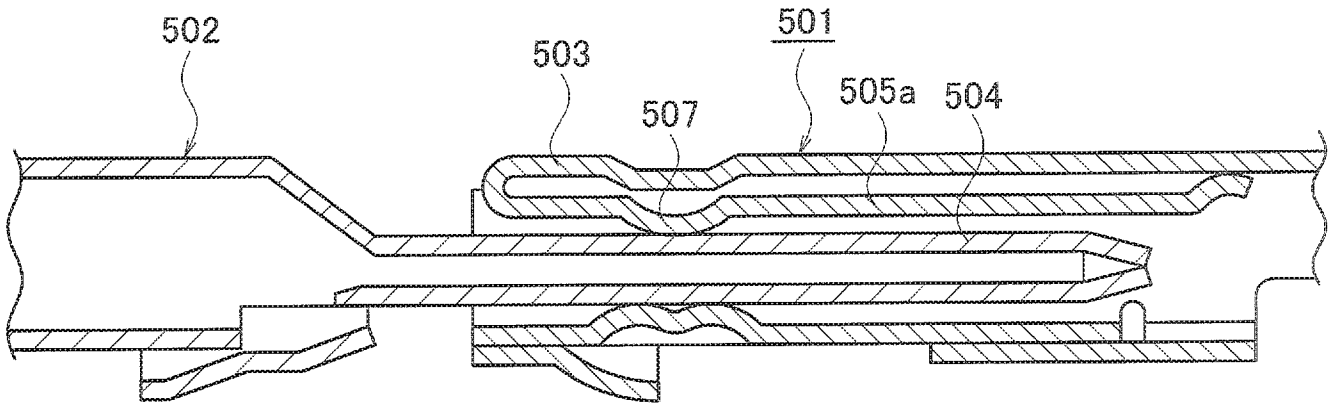
FIG. 65 is a sectional view of the female terminal and the male terminal positioned at a terminal insertion position according to the eighth embodiment.

When further inserted into the female terminal 501, the tab portion 504 reaches a terminal insertion completed position illustrated in FIG. 65.

In this manner, in a state where the tab portion 504 has been inserted to the terminal insertion completed position, bend restoring force occurs at the elastic bend portion 505*a*. A contact load acts between the indent portion 507 and the contact surface of the tab portion 504 due to the bend restoring force.

In this case, the protruding portions (at least one type of the recess portions and the protruding portions) 507*a* formed on the indent portion 507 partially thrust a surface of the tab portion 504. According to the eighth embodiment, the surface of the tab portion 504 is radially thrust.

Figure 66:
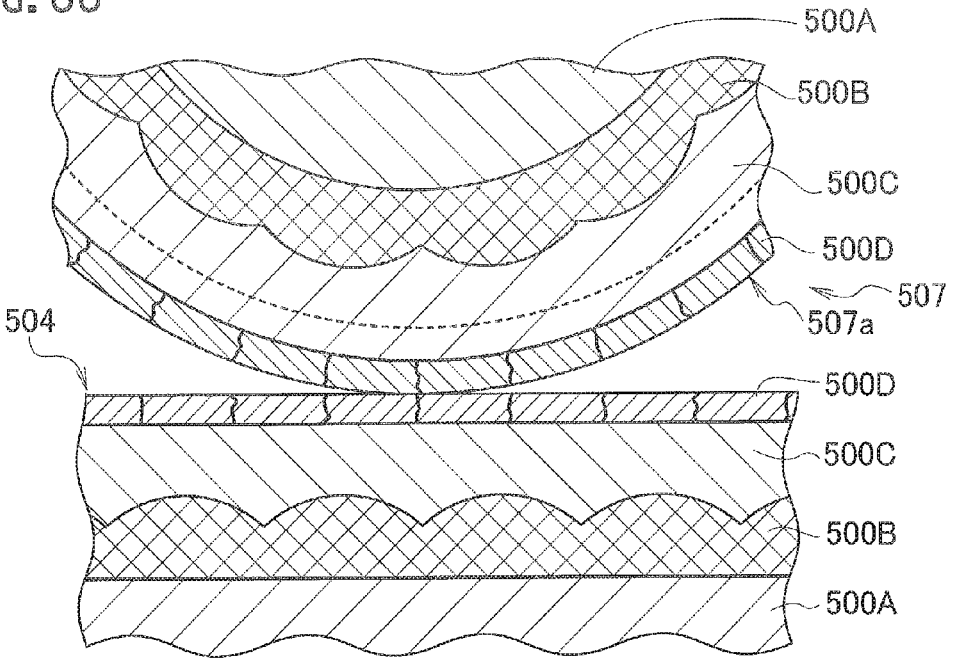
FIG. 66 is an explanatory view for describing a state where oxide films formed on an indent portion and a second contact portion are destroyed according to the eighth embodiment.

As a result, the oxide film 500D on the surface of the tab portion 504 is accelerated so as to crack radially and then cracks occurs in the oxide film 500D (refer to FIG. 66). Meanwhile, the thrust force also intensively acts on the protruding portions (at least one type of the recess portions and the protruding portions) 507*a*. Thus, cracks easily occur in the oxide film 500D on the protruding portions (at least one type of the recess portions and the protruding portions) 507*a* (refer to FIG. 66).

Figure 67:
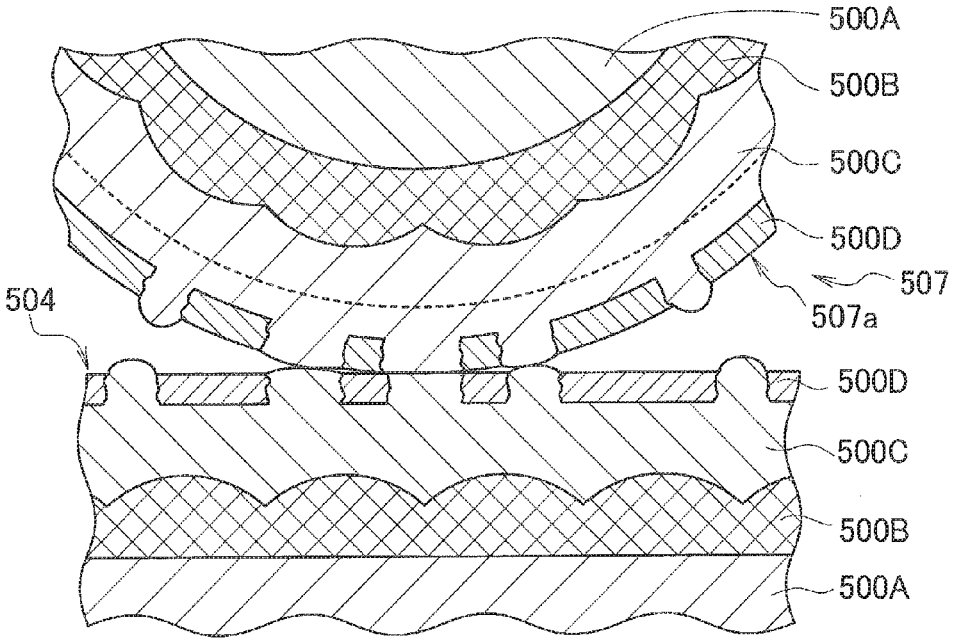
FIG. 67 is an explanatory view for describing a state where the oxide films formed on the indent portion and the second contact portion have been destroyed and pieces of plating metal come in contact with each other according to the eighth embodiment.

When the cracks occur in the oxide films 500D, the plating layers 500C enter from gaps of the oxide films 500D to the surfaces (refer to FIG. 67).

In this manner, when the plating layers 500C enter from the gaps of the oxide films 500D to the surfaces, as illustrated in FIG. 67, the plating layers 500C (the pieces of plating metal of the indent portion 507 and the tab portion 504) come in contact with each other, and then further favorable electric connection can be acquired.

As described above, according to the eighth embodiment, the at least one type of the recess portions and the protruding portions 507*a* is formed on the indent portion 507 so as to be arranged in the at least one state of the radial state and the concentric state.

In this manner, forming the recess portions or the protruding portions 507*a* can partially press between the indent portion 507 and the contact surface of the tab portion 504 with the recess portions or the protruding portions 507*a* when the contact load acts between the indent portion 507 and the contact surface of the tab portion 504.

As a result, the destruction of the oxide films 500D formed on the surface of the indent portion 507 and the surface of the tab portion 504 is accelerated. At the portions at which the oxide films 500D have been destroyed, the contact between the pieces of plating metal of the indent portion 507 and the tab portion 504 can be acquired.

Therefore, contact resistance can be reduced without the terminals increased in size and complicated as much as possible. In particular, according to the eighth embodiment, even when the contact pressure between the contact portions decreases, the oxide films 500D can be destroyed so that miniaturization of the terminals can be easily performed.

Figure 69:
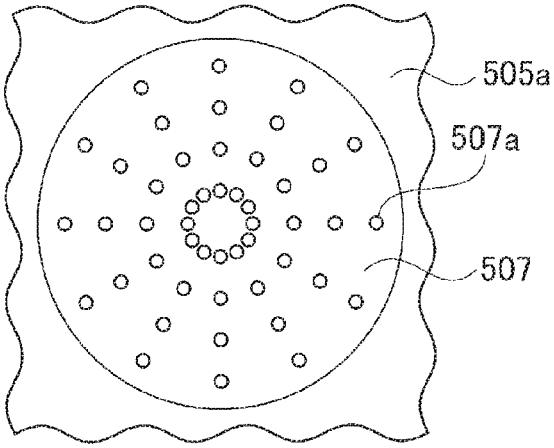
FIG. 69 is a schematic and perspective view of a first modification of the protruding portion formed on the indent portion according to the eighth embodiment.

Note that, the protruding portions 507*a* are not necessarily provided linearly and continuously. As illustrated in FIG. 69, the protruding portions 507*a* can be provided so as to be dotted radially. The shape of each of the protruding portions 507*a* to be formed in this case can be appropriately set so as to be, for example, circular, triangular, or quadrangular. Each of the protruding portions 507*a* can be formed by, for example, embossing.

Figure 70:
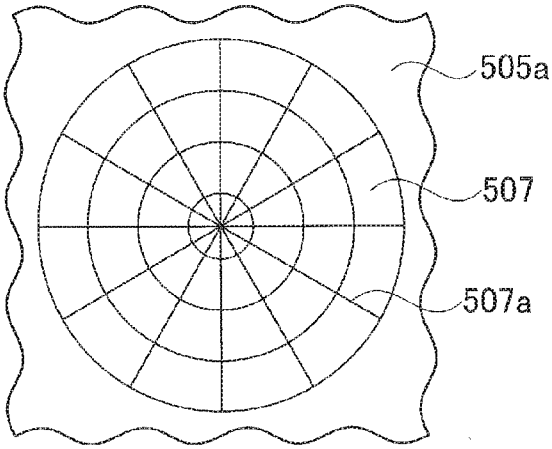
FIG. 70 is a schematic and perspective view of a second modification of the protruding portion formed on the indent portion according to the eighth embodiment.
Figure 71:
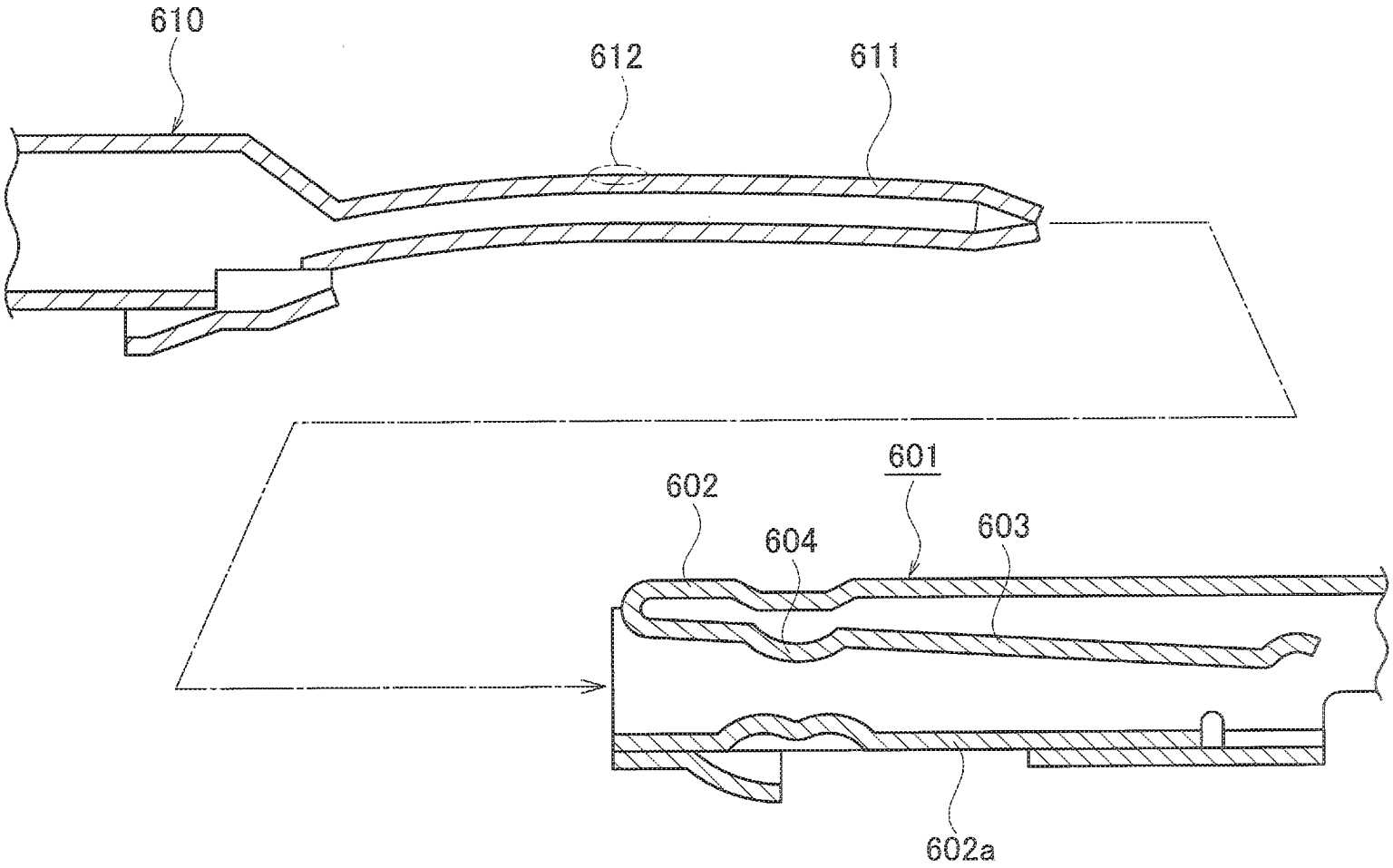
FIG. 71 is a sectional view of a female terminal and a male terminal before terminal connection according to a ninth embodiment of the present invention (plating layers are not illustrated).

The protruding portions 507*a* can be also provided so as to be latticed as illustrated in FIG. 70. That is, the protruding portions 507*a* can be also formed so as to be arranged radially and concentrically.

The protruding portions 507*a* may be formed concentrically.

Note that, the recess portions may be formed on the indent portion 507. In this manner, when the recess portions are formed, edge portions of edges of the recess portions accelerate the destruction of the oxide films 500D.

According to the eighth embodiment, the tin plating layers are formed on the surfaces of the elastic bend portion 505*a* and the tab portion 504. The same effect is acquired with plating layers on which an oxide film is formed, except tin.

As described above, a contact connection structure has the first contact portion including the indent portion protruding and the plating layer formed on the surface, and the second contact portion including the plating layer formed on the surface. The indent portion of the first contact portion slides on the contact surface of the second contact portion. At the terminal insertion completed position, the indent portion comes in contact with the second contact portion. The at least one type of the recess portions and the protruding portions is formed so as to be arranged on the indent portion in the at least one state of the radial state and the concentric state.

According to the above configuration, forming the recess portions or the protruding portions can partially press between the indent portion and the contact surface of the second contact portion with the recess portions or the protruding portions when the contact load acts between the indent portion and the contact surface of the second contact portion.

As a result, the destruction of the oxide films formed on the surface of the indent portion and the surface of the second contact portion is accelerated. At the portions at which the oxide films have been destroyed, the contact between the pieces of plating metal of the indent portion and the second contact portion can be acquired.

Therefore, contact resistance can be reduced without the terminals increased in size and complicated as much as possible.

Ninth Embodiment

A ninth embodiment of the present invention will be described in detail below with reference to FIGS. 71 to 74.

FIGS. 71 to 74 illustrate the ninth embodiment. A contact connection structure according to the ninth embodiment is applied between a female terminal being a first terminal and a male terminal being a second terminal.

The female terminal 601 is arranged in a terminal housing space in a female-side connector housing (not illustrated). The female terminal 601 is formed by performing bending processing to conductive metal punched into a predetermined shape (for example, a copper alloy). The female terminal 601 has a box portion 602 that is a first contact portion. The box portion 602 includes an opening on the front side thereof, and is formed so as to be quadrangular. An elastic bend portion 603 that has been bent at a front upper surface portion of the box portion 602, is arranged in the box portion 602. The elastic bend portion 603 includes an indent portion 604 protruding toward the side of a base, provided thereto. An outer circumferential surface of the indent portion 604 is substantially spherical and an apex of the center of the outer circumferential surface is positioned at the lowest place. The indent portion 604 can be displaced upward due to elastic deformation of the elastic bend portion 603. The elastic bend portion 603 and the base portion 602*a* of the box portion 602 are arranged apart from each other, the base portion 602*a* being a fixed surface portion. The male terminal 610 is inserted between the elastic bend portion 603 and the base portion 602*a* of the box portion 602.

Tin plating is performed to the female terminal 601 in terms of, for example, improvement of connection reliability under a high temperature environment and improvement of corrosion resistance under a corrosive environment. Therefore, the elastic bend portion 603 includes a tin plating layer 603*b* formed on an outer surface of a copper-alloy-made base material layer 603*a* as illustrated in detail in FIGS. 72B and 73A. An oxide film (not illustrated) is generated on a surface of the tin plating layer 603*b*, for example, after reflow treatment.

The male terminal 610 is arranged in a terminal housing space in a male-side connector housing (not illustrated). The male terminal 610 is formed by performing bending processing to conductive metal punched into a predetermined shape (for example, a copper alloy). The male terminal 610 has a tab portion 611 that is a second contact portion. An outer form of the tab portion 611 has a plate shape. Tin plating is performed to the male terminal 610 in terms of, for example, improvement of connection reliability under a high temperature environment and improvement of corrosion resistance under a corrosive environment. Therefore, the tab portion 611 includes a tin plating layer 611*b* formed on an outer surface of a copper-alloy-made base material layer 611*a* as illustrated in detail in FIGS. 72B and 74. An oxide film (not illustrated) is generated on a surface of the tin plating layer 611*b*, for example, after reflow treatment.

Figure 72A:
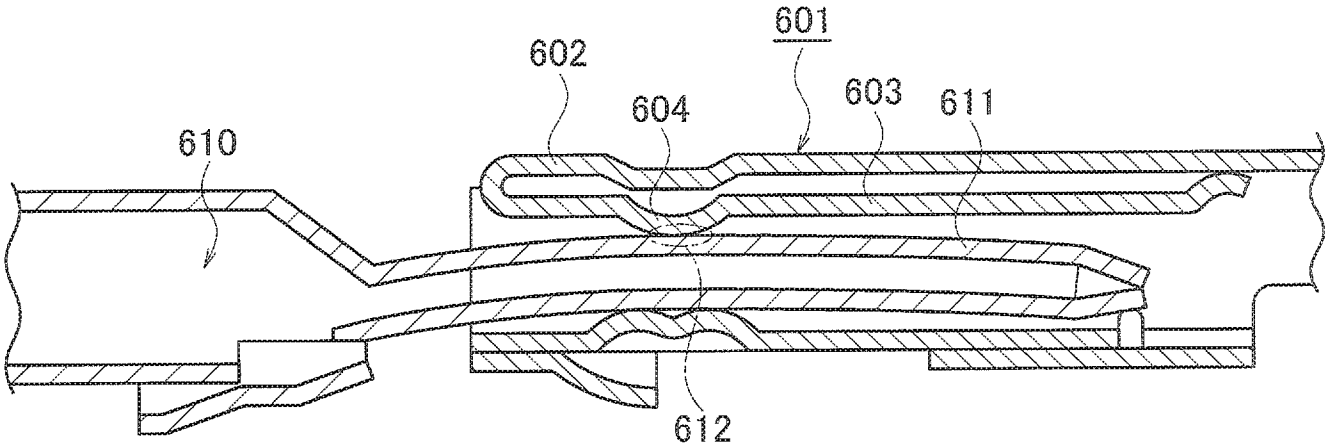
FIG. 72A is a sectional view of the female terminal and the male terminal in the terminal connection according to the ninth embodiment (the plating layers are not illustrated).
Figure 72B:
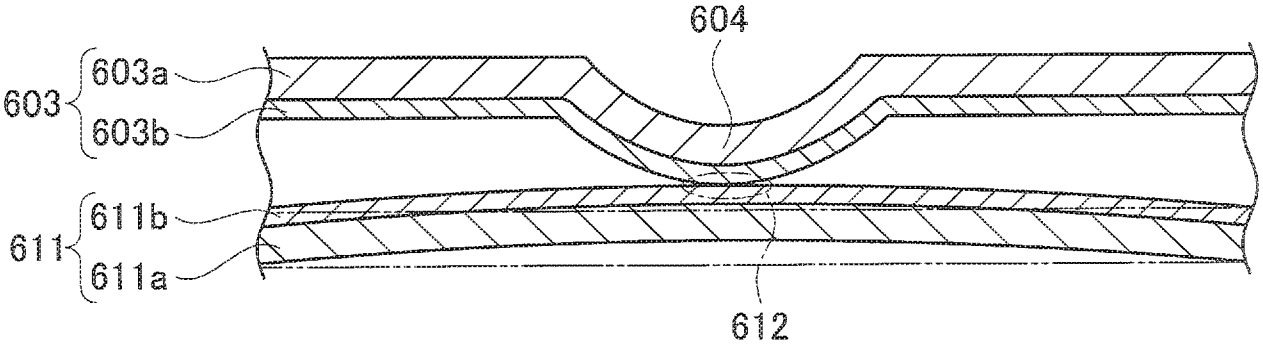
FIG. 72B is a sectional view of a main portion of a contact connection portion according to the ninth embodiment.
Figure 73A:
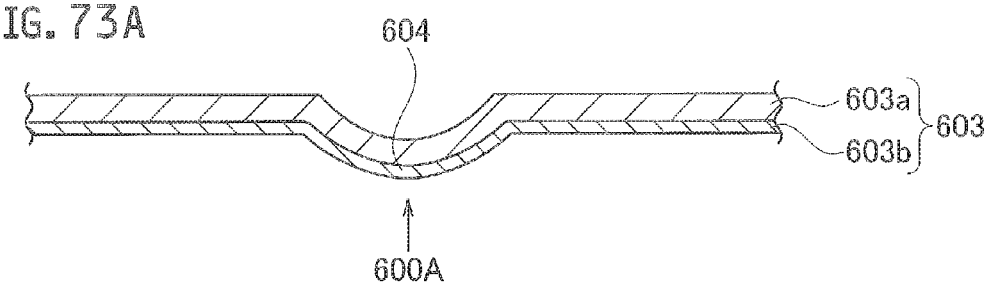
FIG. 73A is a sectional view of a main portion of an elastic bend portion of the female terminal according to the ninth embodiment.
Figure 73B:
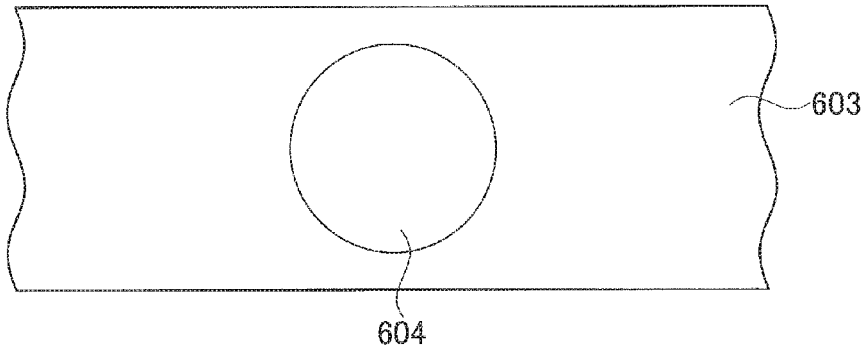
FIG. 73B is a view viewed along the arrow 600A in FIG. 73A.
Figure 74:
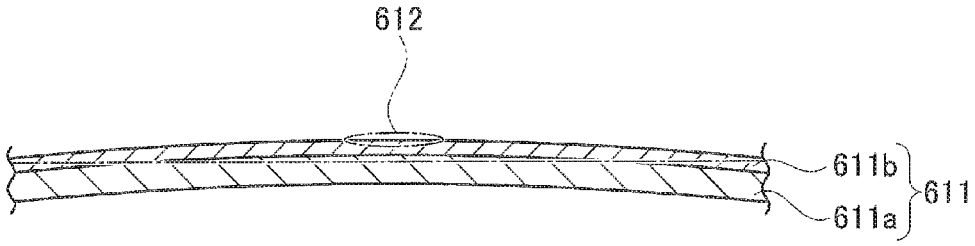
FIG. 74 is a sectional view of a main portion of a tab portion of the male terminal according to the ninth embodiment.
Figure 75:
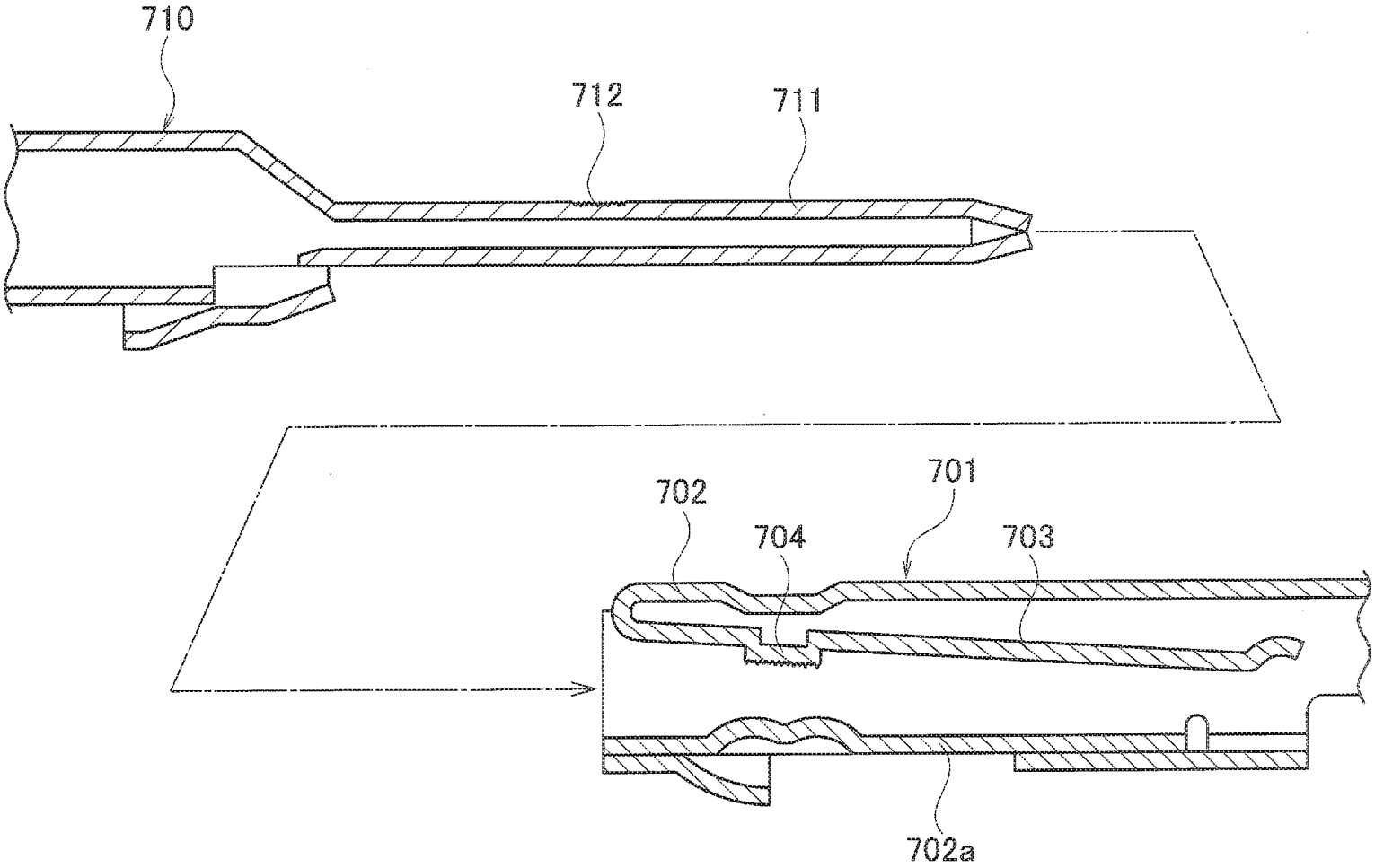
FIG. 75 is a sectional view of a female terminal and a male terminal before terminal connection according to a tenth embodiment of the present invention.

The tab portion 611 has a curved shape in which a portion 612 at which the indent portion 604 is positioned at a terminal insertion completed position, protrudes uppermost. Accordingly, a contact surface being the upper surface is formed on the curved surface on which the portion 612 at which the indent portion 604 is positioned at the terminal insertion completed position, protrudes uppermost. In FIGS. 72B and 74, the contact surface of the tab portion 611 in straight shape is illustrated with a virtual line in order to clarify that the tab portion 611 is curved in circular arc shape.

In the above configuration, when the female-side connector housing (not illustrated) and the male-side connector housing (not illustrated) engage with each other, the tab portion 611 of the male terminal 610 is inserted into the box portion 602 of the female terminal 601 during the engaging process. Then, a leading end of the tab portion 611 first abuts on the elastic bend portion 603. When the insertion further progresses from the abutting portion, the elastic bend portion 603 bends and deforms so that the insertion of the tab portion 611 is allowed. During the inserting process of the tab portion 611 (a terminal inserting process), the indent portion 604 of the elastic bend portion 603 slides on the surface of the tab portion 611. At the terminal insertion completed position (a connector engagement completed position), as illustrated in FIGS. 72A and 72B, the positions of the indent portion 604 of the elastic bend portion 603 and the portion 612 of the tab portion 611 protruding uppermost agree with each other. Then, the indent portion 604 and the uppermost protruding portion 612 of the tab portion 611 come in contact with each other with bend restoring force of the elastic bend portion 603 as a contact load.

In the contact connection structure, the contact surface of the tab portion 611 is formed on the curved surface on which the portion 612 at which the indent portion 604 is positioned at the terminal insertion completed position, protrudes uppermost. Therefore, the tab portion 611 becomes gradually positioned in proximity to the indent portion 604 of the elastic bend portion 603 from a terminal insertion start position to the terminal insertion completed position. At the terminal insertion completed position, the tab portion 611 is positioned so as to displace the indent portion 604 uppermost. Thus, the large contact load due to the deformation of the elastic bend portion 603 acts on the tab portion 611 and the indent portion 604 so that destruction of the oxide films is accelerated. Pieces of tin exude from portions at which the oxide films have been destroyed, and then contact portions (ohmic points) between the pieces of tin plating increase in quantity. As the terminal insertion completed position is reached, terminal inserting force gradually increases. However, the terminal inserting force of the tab portion 611 is low at the terminal insertion start position. As described above, contact resistance can be reduced without the female terminal 601 and the male terminal 610 increased in size and complicated as much as possible, and also without the terminal inserting force increased as much as possible.

The tab portion 611 has a shape in which the portion 612 at which the indent portion 604 is positioned at the terminal insertion completed position, protrudes uppermost. Since this type of shape can be manufactured by forcibly and plastically deforming the tab portion 611, the manufacturing is easy.

According to the ninth embodiment, the outer circumferential surface of the indent portion 604 is substantially spherical. The outer circumferential surface has at least a curved surface in circular arc shape (for example, an elliptical curved surface).

According to the ninth embodiment, the tin plating layers 603*b* and 611*b* are formed on outer surfaces of the elastic bend portion 603 and the tab portion 611. The same effect is acquired with plating layers on which an oxide film is formed, except tin.

As described above, the contact connection structure includes the first contact portion and the second contact portion. The first contact portion has the elastic bend portion including the indent portion protruding, and the fixed surface portion arranged apart from the elastic bend portion. The second contact portion is inserted between the elastic bend portion and the fixed surface portion. When the second contact portion is inserted between the elastic bend portion and the fixed surface portion, the elastic bend portion bends and deforms and then the indent portion of the first contact portion slides on the contact surface of the second contact portion. At the terminal insertion completed position, the indent portion comes in contact with the second contact portion. The contact surface of the second point portion is formed on the curved surface on which the portion at which the indent portion is positioned at the terminal insertion completed position, protrudes uppermost.

The second contact portion is the tab portion. The tab portion may have a curved shape in which the portion at which the indent portion is positioned at the terminal insertion completed position, protrudes uppermost.

According to the above configuration, at the terminal insertion completed position, the second contact position is positioned so as to displace the indent portion uppermost. Thus, the large contact load due to the deformation of the elastic bend portion acts on the second contact portion and the indent portion, and then the destruction of the oxide films is accelerated. As the terminal insertion completed position is reached, the terminal inserting force gradually increases. However, the terminal inserting force of the second contact portion is low at the terminal insertion start position. As described above, the contact resistance can be reduced without the terminals increased in size and complicated as much as possible, and also without the terminal inserting force increased as much as possible.

Tenth Embodiment

A tenth embodiment of the present invention will be described in detail below with reference to FIGS. 75 to 78C.

FIGS. 75 to 77C illustrate the tenth embodiment. A contact connection structure according to the tenth embodiment is applied between a female terminal being a first embodiment and a male terminal being a second terminal.

The female terminal 701 is arranged in a terminal housing space in a female-side connector housing (not illustrated). The female terminal 701 is formed by performing bending processing to conductive metal punched into a predetermined shape (for example, a copper alloy). A tin plating layer (not illustrated) is formed on an outer surface of the female terminal 701 in terms of, for example, improvement of connection reliability under a high temperature environment and improvement of corrosion resistance under a corrosive environment. An oxide film (not illustrated) is generated on a surface of the tin plating layer, for example, after reflow treatment.

Figure 76A:
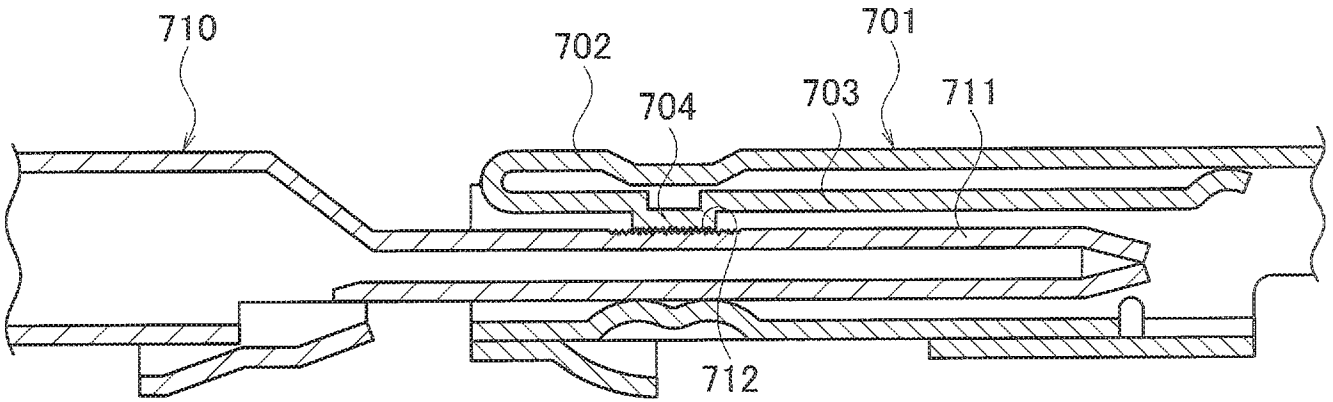
FIG. 76A is a sectional view of the female terminal and the male terminal in the terminal connection according to the tenth embodiment.
Figure 76B:
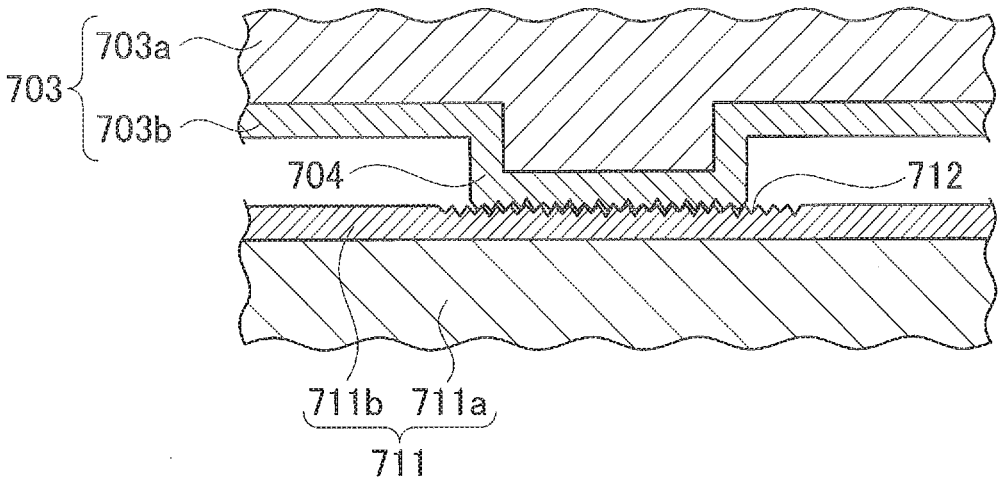
FIG. 76B is a sectional view of a main portion of a contact connection portion according to the tenth embodiment.
Figure 76C:
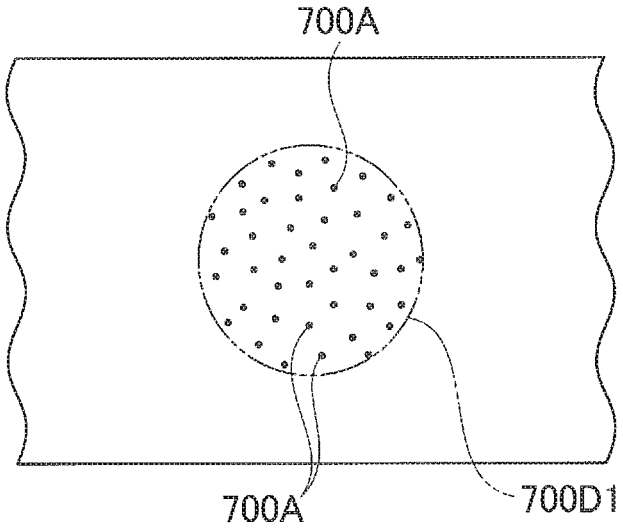
FIG. 76C is a view of an apparent contact surface and actual contact surfaces according to the tenth embodiment.
Figure 77A:
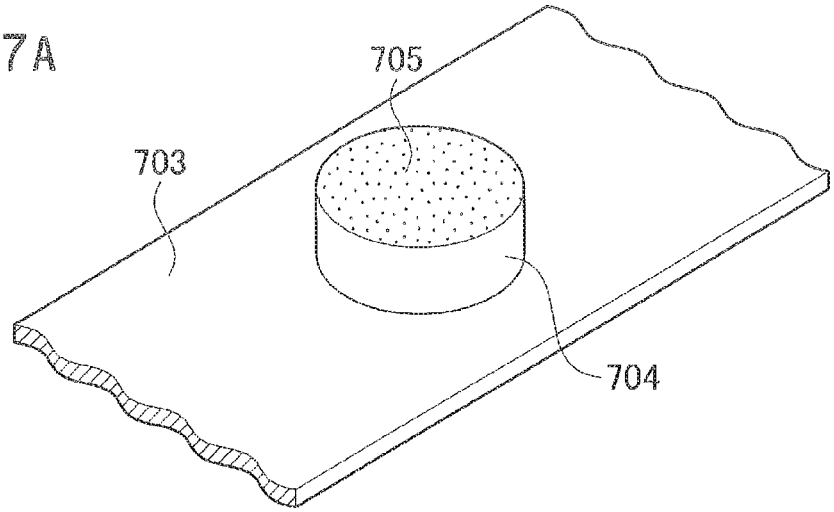
FIG. 77A is a perspective view of an indent portion of the female terminal according to the tenth embodiment.
Figure 77B:
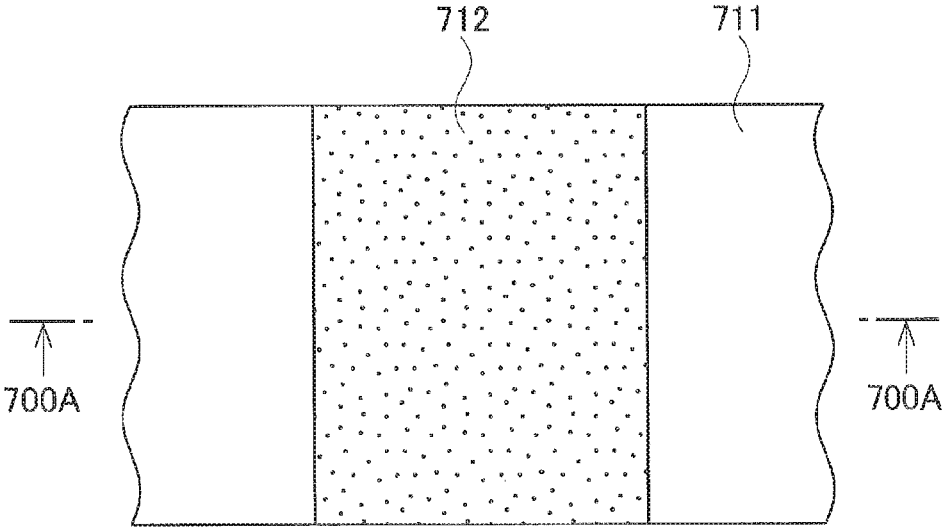
FIG. 77B is a plan view of a main portion of a contact portion of the male terminal according to the tenth embodiment.
Figure 77C:
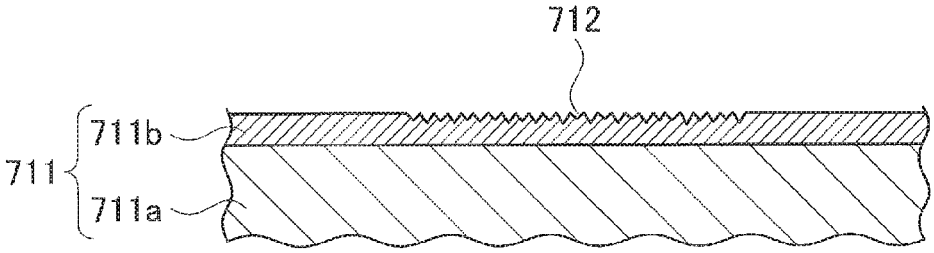
FIG. 77C is a sectional view taken along the line 700A-700A of FIG. 77B.

The female terminal 701 has a quadrangular box portion 702 and an elastic bend portion 703. The box portion 702 includes an opening on the front side thereof. The male terminal 710 is inserted into the opening. The elastic bend portion 703 extends from an upper surface portion of the box portion 702, and is arranged in the box portion 702. An indent portion 704 protruding toward the side of a base is provided on the elastic bend portion 703. As illustrated in FIGS. 76B, 76C, and 77A, the indent portion 704 is columnar and a top surface 705 is positioned at the lowest place. The top surface 705 is a surface with which a tab portion 711 to be described below comes in contact, and is formed to have a surface having rough surface roughness. The degree of surface roughness satisfies the following expression: Ra (arithmetic mean roughness)>0.1 μm.

The indent portion 704 can be displaced upward due to elastic deformation of the elastic bend portion 703. The female terminal 701 has a first contact portion formed of the elastic bend portion 703 and a base portion 702*a* of the box portion 702.

The male terminal 710 is arranged in a terminal housing space in a male-side connector housing (not illustrated). The male terminal 710 is formed by performing bending processing to conductive metal punched into a predetermined shape (for example, a copper alloy). A tin plating layer (not illustrated) is formed on an outer surface of the male terminal 710 in terms of, for example, improvement of connection reliability under a high temperature environment and improvement of corrosion resistance under a corrosive environment. An oxide film (not illustrated) is generated on a surface of the tin plating layer, for example, after reflow treatment.

The male terminal 710 has a plate-like tab portion 711. The male terminal 710 has a second contact portion formed of the tab portion 711. A surface 712 having rough surface roughness, namely, an unevenness surface is formed at a region at which the indent portion 704 is positioned at a terminal insertion completed position, on the side of an upper surface (the side of a contact surface) of the tab portion 711. The degree of surface roughness satisfies the following expression: Ra (arithmetic mean roughness)>0.1 μm.

In the above configuration, when the female-side connector housing (not illustrated) and the male-side connector housing (not illustrated) engage with each other, the tab portion 711 of the male terminal 710 is inserted into the box portion 702 of the female terminal 701 during the engaging process. Then, a leading end of the tab portion 711 first abuts on the elastic bend portion 703. When the insertion further progresses from the abutting portion, the elastic bend portion 703 bends and deforms so that the insertion of the tab portion 711 is allowed. During the inserting process of the tab portion 711 (a terminal inserting process), the indent portion 704 of the elastic bend portion 703 slides on the surface of the tab portion 711. At the terminal insertion completed position (a connector engagement completed position), as illustrated in FIGS. 76A and 76B, the top surface 705 of the indent portion 704 comes in contact with the contact surface of the tab portion 711 with bend restoring force of the elastic bend portion 703 as a contact load.

In the contact connection structure, the indent portion 704 has the top surface 705 to be in contact with the tab portion 711. The top surface 705 is formed so as to have the surface having rough surface roughness. In addition, the region at which the indent portion 704 is positioned at the terminal insertion completed position, on the contact surface of the tab portion 711, is formed so as to have the surface 712 having rough surface roughness. Therefore, as illustrated in FIG. 76C, an outer diameter of the top surface 705 of the indent portion 704 becomes an apparent contact surface diameter 700D1, and the apparent contact surface diameter 700D1 is larger than that in a previous case. Each of the top surface 705 of the indent portion 704 and the contact surface of the tab portion 711 includes a large number of protruding shapes depending on its surface roughness, formed thereon. The protruding shapes in large quantities accelerate destruction of the oxide films. Pieces of tin exude from portions at which the oxide films have been destroyed, and then contact portions (ohmic points) between the pieces of tin plating increase in quantity. Thus, when the indent portion 704 and the contact surface of the tab portion 711 are in comparison to a case where both of the portions have a flat and smooth surface, the number of actual contact surfaces 700A between the indent portion 704 and the tab portion 711 increases. As described above, contact resistance can be reduced without the female terminal 701 and the male terminal 710 increased in size and complicated as much as possible.

According to the tenth embodiment, the surface 712 having rough surface roughness is formed only at the region at which the indent portion 704 is positioned at the terminal insertion completed position, within the contact surface of the tab portion 711. The surface 712 having rough surface roughness may be formed over an entire region on which the indent portion 704 slides within the contact surface of the tab portion 711 or an entire region of the contact surface of the tab portion 711. With the above formation, sliding is performed between the surfaces having rough surface roughness, over an entire region on which the top surface 705 of the indent portion 704 and the contact surface of the tab portion 711 slide. Thus, the destruction of the oxide films due to the sliding is accelerated and it is preferable.

Figure 78A:
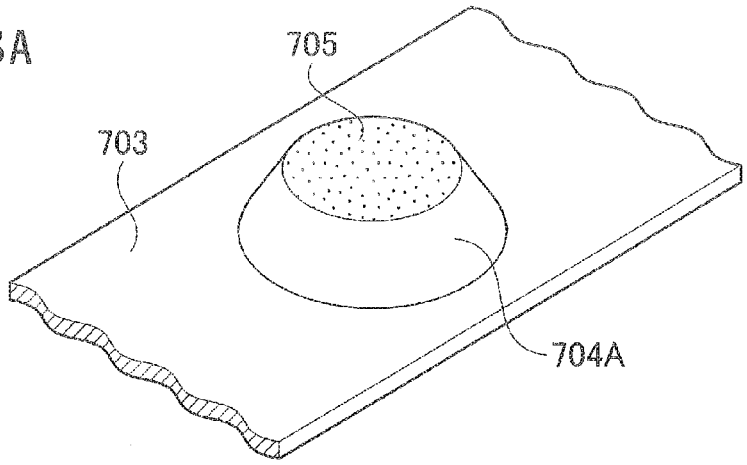
FIG. 78A is a perspective view of an indent portion according to a first modification of the tenth embodiment.
Figure 78B:
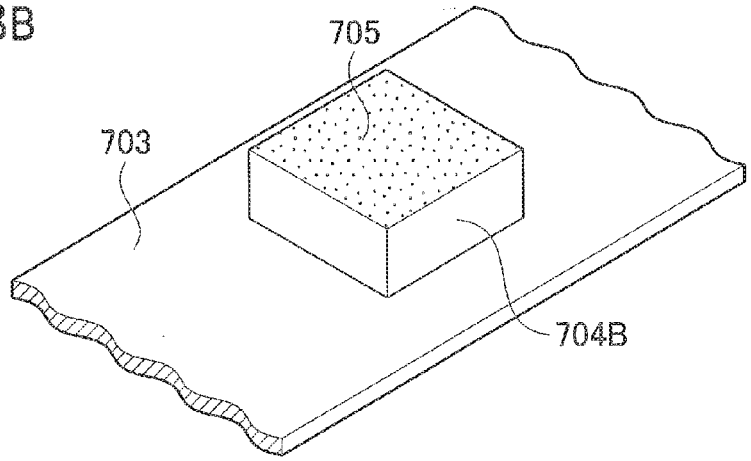
FIG. 78B is a perspective view of an indent portion according to a second modification of the tenth embodiment.
Figure 78C:
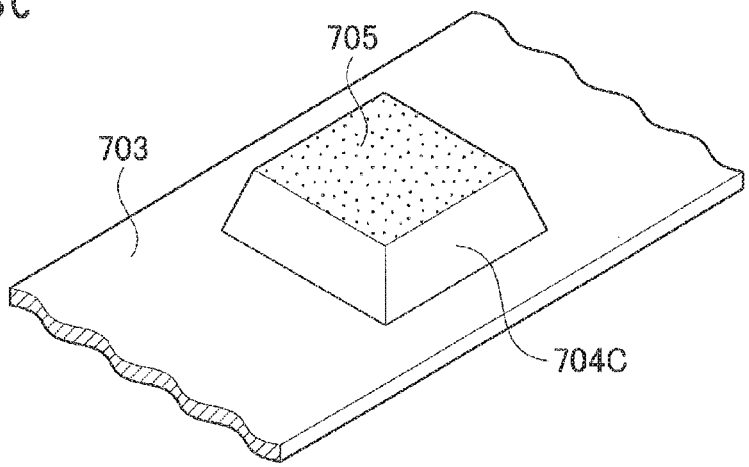
FIG. 78C is a perspective view of an indent portion according to a third modification of the tenth embodiment.

FIGS. 78A to 78C illustrate indent portions 704A, 704B, and 704C according to first to third modifications of the tenth embodiment. The indent portion 704A according to the first modification in FIG. 78A has a truncated cone. A top surface 705 is circular similarly to the tenth embodiment. The indent portion 704B according to the second modification in FIG. 78B has a quadrangular prism. A top surface 705 is quadrangular. The indent portion 704C according to the third modification in FIG. 78C has a quadrangular truncated pyramid. A top surface 705 is quadrangular. Each of the top surfaces 705 is formed so as to have a surface having rough surface roughness.

Each of the indent portions 704A to 704C according to the first to third modifications can acquire a function and an effect the same as those according to the tenth embodiment.

The shapes of the indent portions 704 and 704A to 704C are not limited to the tenth embodiment and the first to third modifications, respectively, and may have a shape having a top surface 705.

As described above, the contact connection structure has the first contact portion including the indent portion protruding and the plating layer formed on the outer surface, and a second contact portion including the plating layer formed on the outer surface. During the terminal inserting process, the indent portion of the first contact portion slides on the contact surface of the second contact portion. At the terminal insertion completed position, the indent portion comes in contact with the contact surface of the second contact portion. The indent portion has the top surface to be in contact with the second contact portion. The top surface is formed so as to have the surface having rough surface roughness. At least the region at which the indent portion is positioned at the terminal insertion completed position, on the contact surface of the second contact portion, is formed so as to have the surface having rough surface roughness.

The indent portion may be columnar.

According to the above configuration, the outer diameter of the top surface of the indent portion becomes the apparent contact surface diameter. The apparent contact surface diameter is larger than that in the previous case. Each of the top surface of the indent portion and the contact surface of the second contact portion includes the protruding shapes in large quantities depending on its surface roughness, formed thereon. The protruding shapes in large quantities accelerate the destruction of the oxide films. Accordingly, the contact portions between the plating layers increase in quantity. Thus, when the indent portion and the contact surface of the second contact portion are in comparison to a case where both of the portions have a flat and smooth surface, the number of actual contact surfaces between the indent portion and the second contact portion increases. As described above, the contact resistance can be reduced without the terminals increased in size and complicated as much as possible.

In this way, the present invention includes various embodiments not described above. Therefore, the scope of the present invention is determined only by the invention identification matters according to claims reasonable from the foregoing description.

What is claimed is:

1. A contact connection structure comprising:

a first contact portion including an indent portion spherically protruding toward a second contact portion, the first contact portion including a plating layer formed on an outer surface of the first contact portion including the indent portion; and the second contact portion including a plating layer formed on a surface of the second contact portion, wherein the indent portion of the first contact portion and a contact surface of the second contact portion are slidable on each other, the contact surface of the second contact portion includes an oxide-film shaving portion having an annular arc portion that makes contact along a circumference portion of the indent portion, and the indent portion of the first contact portion is in contact with the oxide-film shaving portion of the second contact portion at a terminal insertion completed position.

2. The contact connection structure according to claim 1, wherein the oxide-film shaving portion has a protruding shape with a leading end of the oxide-film shaving portion having an acute angle.

3. The contact connection structure according to claim 1, wherein the oxide-film shaving portion comprises an annular groove portion having an edge portion as the annular arc portion.

4. The contact connection structure according to claim 1, wherein the outer surface of the first contact portion including the indent portion comprises a base material upon which the plating layer is formed, an outer surface of the base material provided with an unevenness formed thereon to inhibit movement of the plating layer.

5. The contact connection structure according to claim 4, wherein the unevenness is regularly arranged lengthwise and crosswise.

6. The contact connection structure according to claim 4, wherein the unevenness is randomly arranged.

* * * * *